US005534395A

United States Patent [19]

Kamada et al.

[11] Patent Number: 5,534,395

[45] Date of Patent: Jul. 9, 1996

[54] METHOD OF PROCESSING SILVER HALIDE COLOR PHOTOGRAPHIC MATERIALS

[75] Inventors: Katsushige Kamada; Kazuaki Yoshida, both of Minami-ashigara, Japan

[73] Assignee: Fuji Photo Film Co., Ltd., Kanagawa, Japan

[21] Appl. No.: 472,047

[22] Filed: Jun. 6, 1995

[30] Foreign Application Priority Data

Jun. 9, 1994 [JP] Japan ..... 6-150647
Aug. 11, 1994 [JP] Japan ..... 6-298002

[51] Int. Cl.[6] ..... G03C 7/00; G03C 5/38; G03C 11/00; G03C 5/18

[52] U.S. Cl. ..... 430/400; 430/393; 430/418; 430/428; 430/430; 430/373; 430/467; 430/933

[58] Field of Search ..... 430/393, 400, 430/418, 430, 428, 933, 467, 372

[56] References Cited

U.S. PATENT DOCUMENTS

| | | | |
|---|---|---|---|
| 4,837,139 | 6/1989 | Kobayashi et al. | 430/467 |
| 4,948,713 | 8/1990 | Kobayashi et al. | 430/467 |
| 5,006,456 | 4/1991 | Morigaki et al. | 430/393 |
| 5,028,517 | 7/1991 | Kuse et al. | 430/467 |
| 5,039,599 | 8/1991 | Ueda | 430/393 |
| 5,176,988 | 1/1993 | Fujita et al. | 430/430 |
| 5,310,633 | 5/1994 | Yoshida et al. | 430/458 |
| 5,316,898 | 5/1994 | Ueda et al. | 430/400 |
| 5,460,923 | 10/1995 | Goto et al. | 430/393 |

FOREIGN PATENT DOCUMENTS

| | | | |
|---|---|---|---|
| 0255292 | 2/1988 | European Pat. Off. | 430/467 |
| 0553569 | 8/1993 | European Pat. Off. | 430/400 |
| 0567126A1 | 10/1993 | European Pat. Off. . | |
| 49-40943 | 4/1974 | Japan . | |
| 63-4234 | 1/1988 | Japan | 430/467 |
| 63-46455 | 2/1988 | Japan | 430/430 |
| 63-48549 | 3/1988 | Japan | 430/467 |
| 3-63647 | 3/1991 | Japan | 430/430 |
| 4-9945 | 1/1992 | Japan . | |
| 5-72695 | 3/1993 | Japan | 430/430 |
| 6-123950 | 5/1994 | Japan . | |
| 6-230539 | 8/1994 | Japan | 430/418 |
| 6-324449 | 11/1994 | Japan | 430/430 |

*Primary Examiner*—Charles L. Bowers, Jr.
*Assistant Examiner*—J. Pasterczyk
*Attorney, Agent, or Firm*—Birch, Stewart, Kolasch & Birch

[57] ABSTRACT

A method of processing a silver halide color photographic material by processing with a color developing solution an imagewise exposed silver halide color photographic material comprising a support having thereon at least one light-sensitive silver halide emulsion layer and immediately thereafter processing said photographic material with a bleach-fixing solution, wherein said bleach-fixing solution contains an imidazole compound represented by the following formula (α) and the replenishment rate of said bleach-fixing solution is 200 ml or less per $m^2$ of the photographic material:

(α)

wherein $R_1$, $R_2$, $R_3$ and $R_4$ each represents a hydrogen atom, an alkyl group having from 1 to 5 carbon atoms, a hydroxyalkyl group having from 1 to 5 carbon atoms, or an alkenyl group.

17 Claims, 1 Drawing Sheet

METHOD OF PROCESSING SILVER HALIDE COLOR PHOTOGRAPHIC MATERIALS

FIELD OF THE INVENTION

The present invention relates to a method of processing a silver halide photographic material and, particularly, to a method of processing a silver halide photographic material in which the white portions after processing are excellent.

BACKGROUND OF THE INVENTION

The processing of a silver halide color photographic material primarily comprises two steps of color development processing and desilvering processing, and the desilvering processing comprises a bleaching step and a fixing step, or a monobath bleach-fixing step which is used in combination with these steps or used alone. Additional steps, that is, water washing, stop processing, stabilization processing, pretreatment for development acceleration and the like are employed, if necessary.

Reduction of the amount of waste solutions of photographic processing solutions has been strongly desired in recent years with the progress of the speedup of the processing for purposes of reduction of environmental pollution, saving resources, and reduction of the production cost. However, reductions of the replenisher and waste solution have not been practiced yet.

Reduction of the replenishers, in particular, reduction of a bleach-fixing solution replenisher causes a problem of coloring of the white portions after processing of the photographic material. This is presumably because the mixing rate of a color developing solution increases and the salt concentration of the bleach-fixing solution increases, and washing out of the water-soluble components contained in the photographic material is deteriorated. This problem is especially conspicuous when the washing or rinsing step after the bleach-fixing step is conducted in a water saving step, and techniques for solving this problem have been desired.

On the other hand, JP-A-49-40943 (the term "JP-A" as used herein means a "published unexamined Japanese patent application) discloses the use of an imidazole compound in a bleach-fixing solution for improving desilvering property.

However, this patent application does not refer to the realization of extremely low replenishment of late years, therefore, the improvement of pure whiteness of the photographic material after processing cannot be expected particularly in a method in which usually the salt concentration becomes high.

SUMMARY OF THE INVENTION

Accordingly, an object of the present invention is to provide a method of processing a silver halide photographic material in which very excellent white portions after processing can be obtained even when the replenishment rate of the bleach-fixing solution is extremely reduced.

As a result of discussion about the above problem, the present inevntors have found that the above object of the present invention can be achieved by the following processing method.

(1) A method of processing a silver halide color photographic material by processing with a color developing solution an imagewise exposed silver halide color photographic material comprising a support having thereon at least one light-sensitive silver halide emulsion layer and immediately thereafter processing said photographic material with a bleach-fixing solution, wherein said bleach-fixing solution contains an imidazole compound represented by the following formula (α) and the replenishment rate of said bleach-fixing solution is 200 ml or less per $m^2$ of the photographic material:

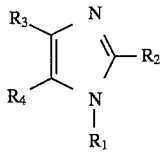

(α)

wherein $R_1$, $R_2$, $R_3$ and $R_4$ each represents a hydrogen atom, an alkyl group having from 1 to 5 carbon atoms, a hydroxyalkyl group having from 1 to 5 carbon atoms, or an alkenyl group.

(2) A method of processing a silver halide color photographic material as described in (1), wherein said color developing solution contains a triazinyl-4,4-diaminostilbene based brightening agent.

(3) A method of processing a silver halide color photographic material as described in (1) or (2), wherein said bleach-fixing solution contains a compound represented by the following formula (S):

$$R(SO_2M)_n \qquad (S)$$

wherein R represents an alkyl group, an alkenyl group, an aralkyl group, a cycloalkyl group, an aryl group or a heterocyclic group; M represents a cation; and n represents 1 or 2.

The present invention could find a solution to the problem of improving whiteness of the photographic material after processing in case of using the reduced replenisher of the bleach-fixing solution by the unexpected contrary means to the usual, that is, by means of increasing the salt concentration in the processing solution by the inclusion of an imidazole compound in the bleach-fixing solution. The technique disclosed in the above-described JP-A-49-40943 concerns the usage of an imidazole compound in a bleach-fixing solution for improving desilvering property, and there is no disclosure in the patent application about the reduction of a bleach-fixing solution replenisher and the whiteness after processing of the photographic material as in the present invention, and does not suggest the present invention at all.

DESCRIPTION OF CHARACTERS

Figure 1:
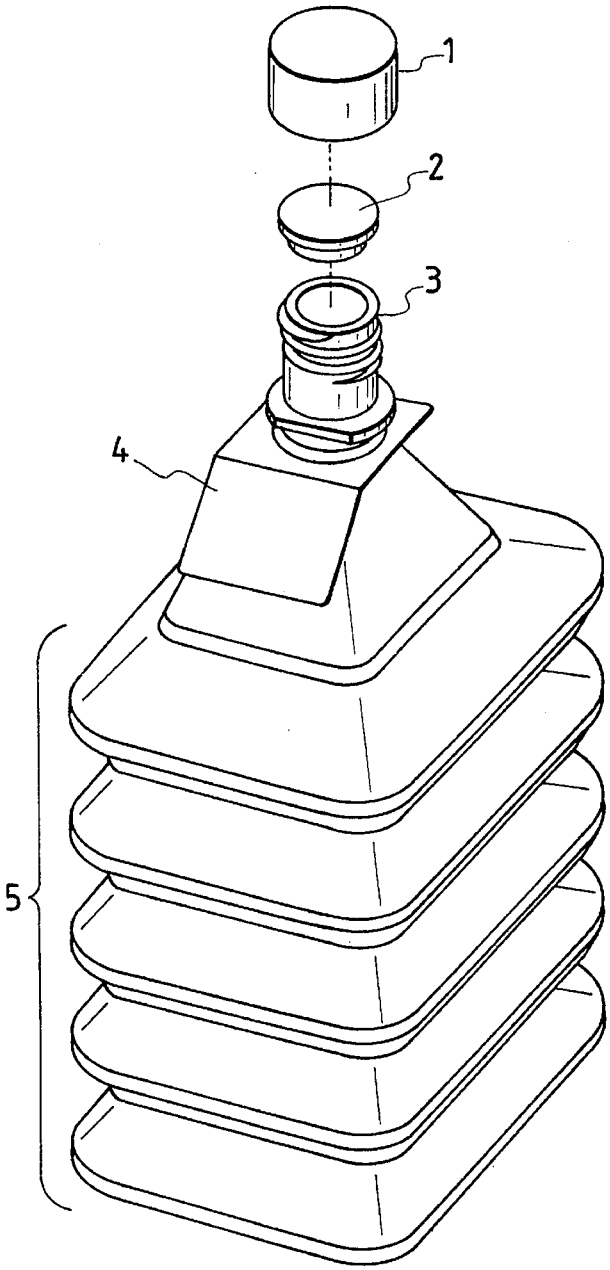
FIG. 1 is an oblique view of a nearly square type flexible vessel for a processing solution having a bellows part.

1: Cap
2: Inner stopper
3: Opening part
4: Label
5: Bellows part

DETAILED DESCRIPTION OF THE INVENTION

The present invention is described in detail below.

Imidazole compounds which are used in the present invention are described below. Imidazole compounds for use in the present invention are represented by the above formula (α).

Specific examples of preferred compounds represented by the above formula (α) include imidazole, 1-methylimidazole, 1-ethylimidazole, 1-allylimidazole, 1-vinylimidzole, 1-(β-hydroxyethyl)imidazole, 2-methylimidazole, 2-ethylimidazole, 2-amylimidazole, 2-hydroxymethylimidazole, 1-isoamyl-2-methylimidazole, 4-methylimidazole, 4-hydroxymethylimidazole, 4-(β-hydroxyethyl)imidazole, 2,4-dimethylimidazole, 2-ethyl-4-methylimidazole, 4,5-dimethylimidazole, 4-hydroxymethyl-5-methylimidazole, 4-(β-hydroxyethyl)-5-methylimidazole, and 2,4,5-trimethylimidazole, but the present invention is not limited thereto.

Particularly preferred of them are imidazole, 2-methylimidazole, 1-methylimidazole and 1-(β-hydroxyethyl)imidazole, and most preferred are imidazole and 2-methylimidazole.

The above imidazole compounds are added to a bleach-fixing solution in an amount of generally from 0.02 to 2 mol, preferably from 0.05 to 1.5 mol, and particularly preferably from 0.07 to 1.0 mol, per liter of the bleach-fixing solution.

The replenishment of the bleach-fixing solution of the present invention is described below.

The present invention is characterized in that the replenishing amount of the bleach-fixing solution is 200 ml or less per $m^2$ of the photographic material, and the lower limit is 5 ml or more, preferably from 100 ml to 5 ml, more preferably from 60 ml to 10 ml. The effect of the present invention is conspicuous when the replenishing amount is in the preferred range. The replenishment may be either a system in which replenisher components in solid states are directly added to a processing tank and then water for dilution is added, or a system in which a replenisher is divided in several parts and replenished. The replenisher amount of the bleach-fixing solution of the present invention in these systems is such that in the former system in which replenisher components in solid states are directly added to a processing tank and then water for dilution is added the addition amount of water is 200 ml or less per $m^2$ of the photographic material, and in the latter system in which a replenisher is divided in several parts and replenished the total amount of the replenishers of several parts is 200 ml or less per $m^2$ of the photographic material.

Iron complex salts of organic acids can be included in the bleach-fixing solution replenisher of the present invention in an amount of from 0.10 to 1.0 mol per liter of the replenisher, but the amount is preferably from 0.15 to 0.4 mol/liter, and particularly preferably from 0.20 to 0.30 mol/liter, from the viewpoint of the stability of the replenisher, desilvering property, and the prevention of the formation of leuco cyan dyes.

Iron complex salts of organic acids can be included in the bleach-fixing solution of the present invention in an amount of from 0.02 to 0.50 mol per liter of the bleach-fixing solution, but the amount is preferably from 0.05 to 0.30 mol/liter, and particularly preferably from 0.08 to 0.20 mol/liter, from the viewpoint of the stability of the bleach-fixing solution, desilvering property, and the prevention of the formation of leuco cyan dyes.

Examples of organic acid compounds for forming iron complex salts of organic acids which are used as a bleaching agent of a bleach-fixing solution include ethylenediaminetetraacetic acid, diethylenetriaminepentaacetic acid, ethylenediamine-N-(β-oxyethyl)-N,N',N'-triacetic acid, 1,2-diaminopropanetetraacetic acid, 1,3-diaminopropanetetraacetic acid, nitrilotriacetic acid, nitrilo-N-2-carboxy-N,N-diacetic acid, N-(2-acetamido)iminodiacetic acid, cyclohexanediaminetetraacetic acid, iminodiacetic acid, dihydroxyethylglycine, ethyl ether diaminetetraacetic acid, glycol ether diaminetetraacetic acid, ethylenediaminetetrapropionic acid, phenylenediaminetetraacetic acid, 1,3-diaminopropanol-N,N,N',N'-tetramethylenephosphonic acid, ethylenediamine-N,N,N',N'-tetramethylenephosphonic acid, 1,3-propylenediamine-N,N,N',N'-tetramethylenephosphonic acid, and sodium salts and ammonium salt of these compounds. 1,3-Diaminopropanetetraacetic acid, nitrilo-N-2-carboxy-N,N-diacetic acid, N-(2-acetamido)iminodiacetic acid and ethylenediaminetetraacetic acid are particularly preferred of them.

The compounds represented by the following formula (E) are also particularly preferred.

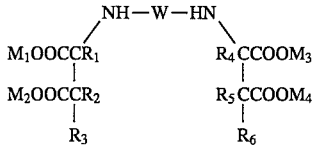

(E)

wherein $R_1$, $R_2$, $R_3$, $R_4$, $R_5$ and $R_6$ each represents a hydrogen atom, an aliphatic group, an aromatic group or a hydroxy group; W represents a divalent linking group containing a carbon atom; and $M_1$, $M_2$, $M_3$ and $M_4$ each represents a hydrogen atom or a cation.

Specific examples of the compounds represented by formula (E) are shown below.

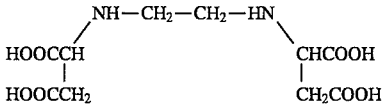

E-1.

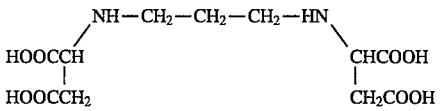

E-2.

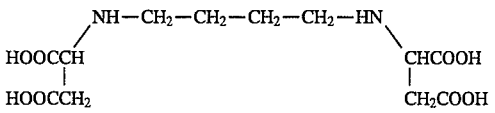

E-3.

-continued
E-4.
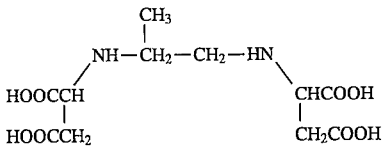
E-5.
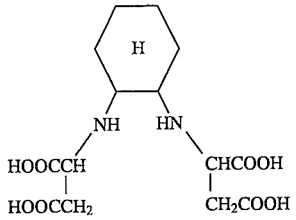
E-6.
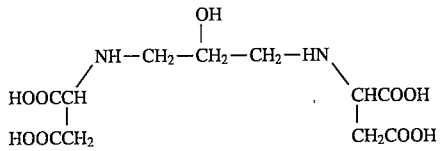
E-7.
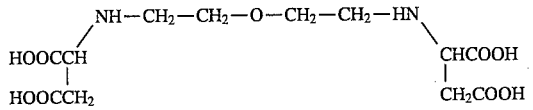
E-8.
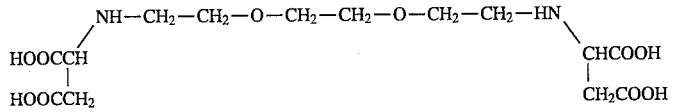
E-9.
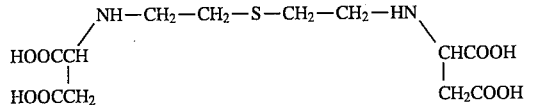
E-10.
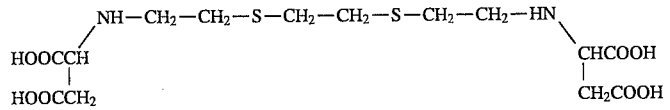
E-11.
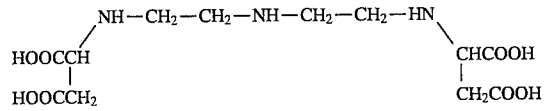
E-12.
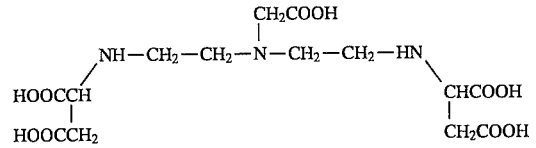
E-13.
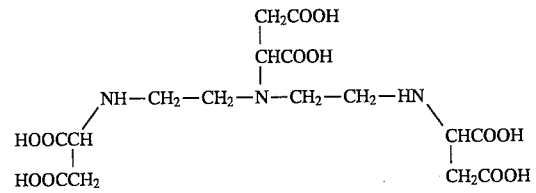
E-14.
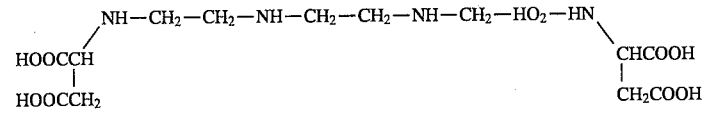
E-15.
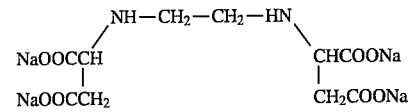

The compounds represented by formula (E) may be any optical isomers.

They may be [S.S] isomer, [S.R] isomer, [R.S] isomer, or [R.R] isomer, or mixtures of these isomers. Above all, compounds synthesized from amino acid of L isomer as a raw material such as [S.S] isomers of compounds (E-1) and (E-2) are particularly preferred in the present invention, from the viewpoint of the stability of the bleach-fixing solution, desilvering property and biodegradation property.

The above described iron complex salts of organic acids may be used alone or in combination of two or more of them as a bleaching agent in the present invention.

The circulating amount per minute of the bleach-fixing solution in the bleach-fixing processing tank of the present invention is preferably from 30% to 150%, more preferably from 40% to 120%, and particularly preferably from 50% to 100%, of the total amount of the bleach-fixing solution (inclusive of the processing tank and circulating system), from the viewpoint of the stability of the bleach-fixing solution, desilvering property, and the prevention of the formation of leuco cyan dyes.

Desilvering step which is applicable to the present invention is described below. Desilvering step in the present invention includes bleach-fixing step, for example, bleach-fixing step, bleaching step—bleach-fixing step, bleach-fixing step—fixing step, and bleaching step— bleach-fixing step—fixing step. From the simplification and speedup of desilvering step, it is preferred in the present invention to employ bleach-fixing step alone.

Other components of the bleach-fixing solution of the present invention are described below.

It is preferred for the bleach-fixing solution to contain halides such as chloride, bromide or iodide as a rehalogenating agent for accelerating oxidation of silver. Further, organic ligands which comprise scarcely soluble silver salt may be included in place of halides. Silver halides are added in the form of alkali metal salts or ammonium salt, or salts of guanidine, and amine. Specifically, there are potassium bromide, sodium bromide, ammonium bromide, potassium chloride, and guanidine hydrochlorid, and preferably potassium bromide or sodium bromide. The amount of a rehalogenating agent to be added to the bleach-fixing solution is appropriately 2 mol/liter or less, preferably from 0.001 to 2.0 mol/liter, and more preferably from 0.1 to 1.0 mol/liter.

The bleach-fixing solution of the present invention can include, if desired, other additives such as a bleaching accelerator, a corrosion inhibitor for preventing the corrosion of processing tanks, a pH buffer for maintaining the pH of the processing solution, a brightening agent, and a defoaming agent.

Specific examples of bleaching accelerators which can be used in the present invention include, for example, compounds having a mercapto group or a disulfide group disclosed in U.S. Pat. No. 3,893,858, German Patent 1,290,812, U.S. Pat. No. 1,138,842, JP-A-53-95630, and *Research Disclosure,* No. 17129 (1978), thiazolidine derivatives disclosed in JP-A-50-140129, thiourea derivatives disclosed in U.S. Pat. No. 3,706,561, polyethylene oxides disclosed in German Patent 2,748,430, polyamine compounds disclosed in JP-B-45-8836 (the term "JP-B" as used herein means an "examined Japanese patent publication"), and imidazole compounds disclosed in JP-A-49-40493. Mercapto compounds disclosed in U.S. Pat. No. 1,138,842 are particularly preferred of them.

Further, nitrates such as ammonium nitrate, sodium nitrate, and potassium nitrate are preferably used as a corrosion inhibitor. The addition amount thereof is generally from 0.01 to 2.0 mol/liter, and preferably from 0.05 to 0.5 mol/liter.

The total of the ammonium ion concentration in the bleach-fixing solution of the present invention is preferably 0.3 g ion/liter or less. This mode is preferred from the viewpoint of image storage characteristics and environmental protection, and the concentration of 0.1 mol/liter or less is more preferred in the present invention.

Any compounds which are difficult to be oxidized by a bleaching agent and have a buffering effect at a pH range of from 3.0 to 8.0 can be used as a pH buffer in the present invention. Examples include organic acids such as acetic acid, glycolic acid, lactic acid, propionic acid, butyric acid, malic acid, chloroacetic acid, levulinic acid, ureidopropionic acid, nitric acid, malonic acid, succinic acid, glutaric acid, maleic acid, fumaric acid, citraconic acid, itaconic acid, β-hydroxypropionic acid, tartaric acid, citric acid, oxalacetic acid, diglycolic acid, benzoic acid, and phthalic acid, organic bases such as pyridine, dimethylpyrazole, 2-methyl-o-oxazoline, and aminoacetonitrile, phosphoric acid, imidazoles such as imidazole, 1-methylimidazole, 2-methylimidazole, and 1-ethylimidazole, triethanolamine, N-allylmorpholine, and N-benzoylpiperazine. The total addition amount of these buffers is 3.0 mol or less, preferably from 0.1 to 1.0 mol, per liter of the bleach-fixing solution.

Various known fixing agents are used in the bleach-fixing solution of the present invention. Examples thereof include thiosulfates, thiocyanates, thioethers, amines, mercaptos, thiones, thioureas, iodides, and mesoionic compounds, for example, ammonium thiosulfate, sodium thiosulfate, potassium thiosulfate, guanidine thiosulfate, potassium thiocyanate, dihydroxyethyl thioether, 3,6-dithia-1,8-octanediol, and imidazole. Thiosulfates, in particular, ammonium thiosulfate, are preferably used for carrying out rapid fixing process. Further, a combined use of two or more fixing agents can ensure more rapid fixing process. For example, it is preferred to use, in addition to ammonium thiosulfate, the above described ammonium thiocyanate, imidazole, thiourea, and thioether, in combination, and in such a case, the addition amount of the second fixing agents is from 0.01 to 100 mol % based on ammonium thiosulfate.

The amount of the fixing agent is from 0.1 to 3.0 mol, preferably from 0.5 to 2.0 mol, per liter of the bleach-fixing solution.

The addition of preservatives to the bleach-fixing solution can raise the stability of the solution with the lapse of time. Sulfites and/or hydroxylamines, hydrazines, bisulfite addition products of aldehyde (for example, bisulfite addition products of acetaldehyde, particularly preferably bisulfite addition products of aromatic aldehyde disclosed in JP-A-1-298935) are effective as preservatives when the bleach-fixing solution or the fixing solution contains thiosulfate. The use of the sulfinic acid compounds disclosed in JP-A-62-143048 is also preferred.

The above-described formula (S) is described in detail below.

R represents a substituted or unsubstituted alkyl group (methyl, ethyl, n-propyl, hydroxyethyl, sulfoethyl, carboxyethyl, methoxyethyl), a substituted or unsubstituted alkenyl group (allyl, butenyl), a substituted or unsubstituted aralkyl group (benzyl, phenethyl, 4-carboxyphenylmethyl, 3-sulfophenylmethyl), a substituted or unsubstituted cycloalkyl group (cyclohexyl), a substituted or unsubstituted aryl group (phenyl, 4-methylphenyl, naphthyl, 3-carboxyphenyl, 4-methoxyphenyl, 3-sulfophenyl, 4-carboxymethoxyphenyl, 3-carboxymethoxyphenyl, 4-carboxyethoxyphenyl, 4-sulfoethoxyphenyl, 4-carboxymethylphenyl, 4-(N-carboxymethyl-N-methyl)phenyl), or a substituted or unsubstituted heterocyclic group (pyridyl, furyl, thienyl, pyrazolyl, indolyl).

M represents a cation, for example, a hydrogen atom, an alkali metal, an alkaline earth metal, a nitrogen-containing organic base or an ammonium group. As an alkali metal, Na, K, and Li can be enumerated, as an alkaline earth metal, Ca and Ba, as a nitrogen-containing organic base, ordinary amines capable of forming salts with sulfinic acid, and as an ammonium group, an unsubstituted ammonium group and a tetramethylammonium group can be enumerated.

In formula (S), when the groups represented by R have substituents, examples of the substituents include a nitro group, a halogen atom (chlorine, bromine), a cyano group, an alkyl group (methyl, ethyl, propyl, carboxymethyl, carboxyethyl, carboxypropyl, sulfoethyl, sulfopropyl, dimethylaminoethyl), an aryl group (phenyl, naphthyl, carboxyphenyl, sulfophenyl), an alkenyl group (allyl, butenyl), an aralkyl group (benzyl, phenethyl), a sulfonyl group (methanesulfonyl, p-toluenesulfonyl), an acyl group (acetyl, benzoyl), a carbamoyl group (unsubstituted carbamoyl, dimethylcarbamoyl), a sulfamoyl group (unsubstituted sulfamoyl, methylsulfamoyl, dimethylsulfamoyl), a carbonamide group (acetamide, benzamide), a sulfonamide group (methanesulfonamide, benzenesulfonamide), an acyloxy group (acetyloxy, benzoyloxy), a sulfonyloxy group (methanesulfonyloxy), a ureido group (unsubstituted ureido), a thioureido group (unsubstituted thioureido, methylthioureido), carboxylic acid or salts thereof, sulfonic acid or salts thereof, a hydroxy group, an alkoxy group (methoxy, ethoxy, carboxyethoxy, carboxymethoxy, sulfoethoxy, sulfopropyloxy), an alkylthio group (methylthio, carboxymethylthio, sulfoethylthio), an amino group (unsubstituted amino, dimethylamino, N-carboxyethyl-N-methylamino).

Specific compounds represented by formula (S) are shown below.

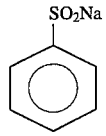

(S-1)

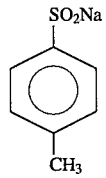

(S-2)

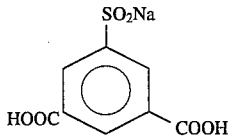

(S-3)

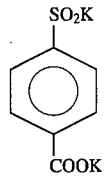

(S-4)

-continued

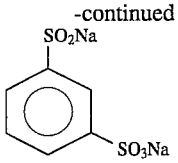

(S-5)

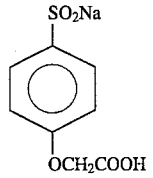

(S-6)

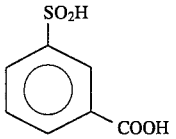

(S-7)

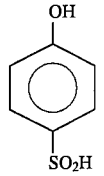

(S-8)

$CH_3SO_2NH_4$ (S-9)

$CH_3CH_2SO_2NH_4$ (S-10)

$CH_3SO_2Na$ (S-11)

$CH_3CH_2SO_2Na$ (S-12)

The amount of the sulfinic acid for use in the present invention is generally from 0.001 to 1.0 mol/liter, and preferably from 0.002 to 0.2 mol/liter.

It is preferred to include antifungal and anti-bacterial agents after bleach-fixation or in the replenisher or concentrated solution, which are to be described later at sections of washing water and stabilizing solution.

The pH of the bleach-fixing solution of the present invention is appropriately from 4.5 to 7.5 and preferably from 5.0 to 7.0. The pH of the bleach-fixing solution replenisher of the present invention is appropriately from 4.0 to 7.0 and preferably from 4.5 to 6.5.

Although the bleach-fixing step can be carried out in a temperature range of between 30° C. and 50° C., preferably between 35° C. and 40° C.

The processing time of the bleach-fixing step is from 10 seconds to 2 minutes, but is preferably from 10 seconds to 1 minute, and more preferably from 15 seconds to 45 seconds.

In a case of a photographic material which requires a plenty amount of coating silver such as a reversal process, the processing time is from 30 seconds to 5 minutes, preferably from 40 seconds to 3 minutes.

The color developing solution replenisher and the color developing solution which are used in the present invention are described below.

The color developing solution replenisher and the color developing solution which are used in the present invention contain conventionally known aromatic primary amine color developing agents. Preferred examples are p-phenylenediamine derivatives, and representative examples thereof include N,N-diethyl-p-phenylenediamine, 2-amino-5-diethylaminotoluene, 2-amino-5-(N-ethyl-N-laurylamino)-toluene, 4-[N-ethyl-N-(β-hydroxyethyl)amino]aniline, 2-methyl-4-[N-ethyl-N-(β-hydroxyethyl)amino]aniline, 2-methyl-4-[N-ethyl-N-(β-hydroxybutyl)amino]aniline, 4-amino-3-methyl-N-ethyl-N-[β-(methanesulfonamido)ethyl]aniline, N-(2-amino-5-diethylaminophenylethyl-)methanesulfonamide, N,N-dimethyl-p-phenylenediamine, 4-amino-3-methyl-N-ethyl-N-methoxyethylaniline, 4-amino-3-methyl-N-ethyl-N-β-ethoxyethylaniline, and 4-amino-3-methyl-N-ethyl-N-β-butoxyethylaniline. 4-Amino-3-methyl-N-ethyl-N-[β-(methanesulfonamido)ethyl]aniline and 2-methyl-4-[N-ethyl-N-(β-hydroxybutyl)amino]aniline are particularly preferred of them.

Further, these p-phenylenediamine derivatives may take the form of a salt such as sulfate, hydrochloride, sulfite, and p-toluenesulfonate. The amount used of the aromatic primary amine developing agent is generally from about 4 mmol to 50 mmol per liter of the color developing solution, but the amount used in the color developing solution replenisher is preferably in the concentration of from about 20 mmol to 100 mmol, more preferably from about 28 mmol to 75 mmol per liter of the replenisher.

It is preferred in the present invention to include p-toluenesulfonic acid in a color developing solution. p-Toluenesulfonic acid may be added as a counter salt of a color developing agent or may be added separately. The preferred content is generally from 0.1 to 100 g, preferably from 1 to 50 g, and more preferably from 3 to 30 g, as p-toluenesulfonic acid, per liter of the color developing solution.

The use of substantially benzyl alcohol free color developing solution replenisher and color developing solution is preferred for the execution of the present invention with a view to prevention of the deposition of the replenisher and fluctuations in photographic characteristics due to fluctuations in processing amounts. Here, the terminology "substantially benzyl alcohol free" means that the benzyl alcohol concentration is preferably 2 ml/liter or less, more preferably 0.5 ml/liter or less, and most preferably the color developing solution replenisher and color developing solution do not contain benzyl alcohol at all.

The use of substantially sulfite free and hydroxylamine free color developing solution replenisher and color developing solution is preferred from the viewpoint of prevention of the deposition of the replenisher and fluctuations in photographic characteristics due to fluctuations in processing amounts.

Particularly, when a color developing solution replenisher and a color developing solution do not contain sulfite and hydroxylamine, prevention of the deposition of the replenisher is extremely improved. Here, the terminology "substantially free" means that the content thereof is 4 mmol or less per liter of the color developing solution replenisher and color developing solution, more preferably 2 mmol or less, and most preferably not containing at all.

The inclusion of the compound represented by the following formula (I) is preferred in the present invention from the viewpoint of the preservability and the prevention of fluctuations in photographic characteristics due to fluctuations in processing amounts. In particular, the preservability is extremely improved by the presence of the compound represented by formula (I).

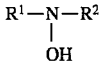

(I)

wherein $R^1$ and $R^2$ each represents a hydrogen atom, a substituted or unsubstituted alkyl group, a substituted or unsubstituted alkenyl group, a substituted or unsubstituted aryl group, or a heterocyclic aromatic group. $R^1$ and $R^2$ do not represent hydrogen atoms at the same time, and they may be linked each other to form a heterocyclic ring together with a nitrogen atom. The ring structure of the heterocyclic ring is a 5- or 6-membered ring comprising a carbon atom, a hydrogen atom, a halogen atom, an oxygen atom, a nitrogen atom and a sulfur atom, and saturated or unsaturated.

$R^1$ and $R^2$ preferably represent an alkyl group or an alkenyl group having preferably from 1 to 10, particularly preferably from 1 to 5, carbon atoms. Examples of the nitrogen-containing heterocyclic ring formed by linking of $R^1$ and $R^2$ include a piperidyl group, a pyrrolidyl group, an N-alkylpiperadyl group, a morpholyl group, an indolinyl group and a benzotriazole group.

Specific examples of compounds represented by formula (I) of the present invention are shown below, but the present invention is not limited thereto.

The addition amount of the following compounds to the color developing solution and the color developing solution replenisher is preferably such that the concentration becomes from 0.005 mol/liter to 0.5 mol/liter, preferably from 0.03 mol/liter to 0.1 mol/liter.

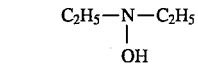

I-1

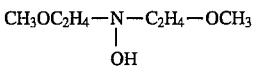

I-2

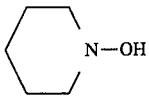

I-3

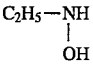

I-4

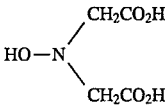

I-5

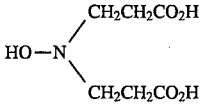

I-6

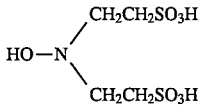

I-7

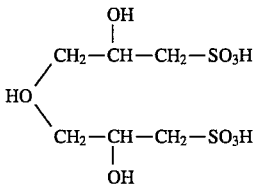

I-8

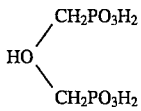

I-9

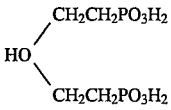

I-10

-continued

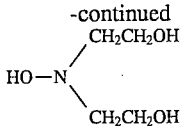
I-11

$HO-NH-CH_2CO_2H$ I-12

$HO-NH-CH_2CH_2SO_3H$ I-13

$HO-NH-CH_2PO_3H$ I-14

$HO-NH-CH_2CH_2OH$ I-15

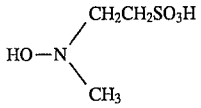
I-16

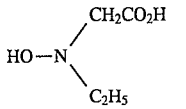
I-17

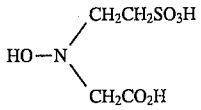
I-18

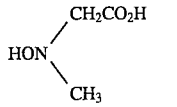
I-19

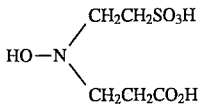
I-20

Organic preservatives other than the compounds represented by formula (I) may be used in addition to the compounds represented by formula (I) in the present invention, if necessary.

Organic preservatives herein means general organic compounds which reduce the deterioration speed of the aromatic primary amine color developing agent when added to a processing solution for a color photographic material. That is, organic preservatives herein means organic compounds which have functions to prevent the air oxidation of color developing agents and, above all, hydroxamic acids, hydrazines, hydrazides, phenols, α-hydroxyketones, α-aminoketones, sugars, monoamines, diamines, polyamines, quaternary ammonium salts, nitroxy radicals, alcohols, oximes, diamide compounds, and condensed ring amines are particularly effective organic preservatives. These organic preservatives are disclosed in JP-B-48-30496, JP-A-52-143020, JP-A-63-4235, JP-A-63-30845, JP-A-63-21647, JP-A-63-44655, JP-A-63-53551, JP-A-63-43140, JP-A-63-56654, JP-A-63-58346, JP-A-63-43138, JP-A-63-146041, JP-A-63-44657, JP-A-63-44656, U.S. Pat. Nos. 3,615,503, 2,494,903, JP-A-1-97953, JP-A-1-186939, JP-A-1-186940, JP-A-1-187557, and JP-A-2-306244. The various metals disclosed in JP-A-57-44148 and JP-A-57-53749, the salicylic acids disclosed in JP-A-59-180588, the amines disclosed in JP-A-63-239447, JP-A-63-128340, JP-A-1-186939 and JP-A-1-187557, the alkanolamines disclosed in JP-A-54-3532, the polyethyleneimines disclosed in JP-A-56-94349, and the aromatic polyhydroxy compounds disclosed in U.S. Pat. No. 3,746,544 may be used as preservatives, if necessary. The addition of alkanolamines such as triethanolamine is particularly preferred.

The inclusion of aromatic polyhydroxy compounds is particularly preferred in the present invention from the viewpoint of the improvement of the stability of a developing solution.

In general, aromatic polyhydroxy compounds are compounds which have at least 2 hydroxy groups at the ortho positions to each other on the aromatic ring. Preferably, these polyhydroxy compounds are compounds which have at least 2 hydroxy groups at the ortho positions to each other on the aromatic ring and do not have exocyclic unsaturation. The various aromatic polyhydroxy compounds of a wide range of the present invention include the compounds represented by the following formula (II) such as benzene and naphthalene compounds.

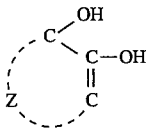
(II)

wherein Z represents an atomic group necessary to complete an aromatic nucleus of benzene or naphthalene.

The above compounds may be substituted with a group or an atom such as, for example, a sulfo group, a carboxy group or a halogen atom, in addition to the hydroxy group.

General examples of aromatic polyhydroxy compounds which are preferably used in the present invention include the following:

II-1 Pyrocatechol
II-2 4,5-Dihydroxy-m-benzene-1,3-disulfonic acid
II-3 4,5-Dihydroxy-m-benzene-1,3-disulfonic acid•disodium salt
II-4 Tetrabromopyrocatechol
II-5 Pyrogallol
II-6 Sodium 5,6-dihydroxy-1,2,4-benzenetrisulfonate
II-7 Gallic acid
II-8 Methyl gallate
II-9 Propyl gallate
II-10 2,3-Dihydroxynaphthalene-6-sulfonic acid
II-11 2,3,8-Trihydroxynaphthalene-6-sulfonic acid These compounds are included in a color developing solution or a color developing solution replenisher, and the addition amount is from 0.00005 to 0.1 mol, generally from 0.0002 to 0.04 mol, and preferably from 0.0002 to 0.004 mol per liter of the developing solution.

The color developing solution for use in the present invention has pH of preferably from 9 to 12, and more preferably from 9 to 11.0. Other known developing solution component compounds can be included in the color developing solution.

The color developing solution replenisher for use in the present invention has pH of preferably from 11 to 14, and more preferably from 11.5 to 13.5. pH of from 12.0 to 13.0 is particularly preferred from the viewpoint of prevention of the deposition of the replenisher and the reduced replenishment rate.

The use of various buffers is preferred for maintaining the above pH level. Examples of buffers which can be used include carbonates, phosphates, borates, tetraborates, hydroxybenzoates, glycyl salts, N,N-dimethylglycine salts, leucine salts, norleucine salts, guanine salts, 3,4-dihydroxyphenylalanine salts, alanine salts, aminobutyrates, 2-amino-2-methyl-1,3-propanediol salts, valine salts, proline salts, trishydroxyaminomethane salts, and lysine salts. Carbonates, phosphates, tetraborates and hydroxybenzoates are excellent in solubility and buffering ability in a high pH range of pH 9.0 or more, and do not adversely affect photographic characteristics (such as to cause fogging) when added to a color developing solution and inexpensive, therefore, the use of these buffers is particularly preferred.

Specific examples of these buffers include sodium carbonate, potassium carbonate, sodium bicarbonate, potassium bicarbonate, trisodium phosphate, tripotassium phosphate, disodium phosphate, dipotassium phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffers are added to a color developing solution and a color developing solution replenisher in an amount of preferably 0.1 mol/liter or more, and particularly preferably from 0.1 mol/liter to 0.4 mol/liter.

Various chelating agents can be used in a color developing solution of the present invention for the purpose of preventing the precipitation of calcium and magnesium or improving the stability of the color developing solution. Examples of such chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenephosphonic acid, trans-cyclohexanediaminetetraacetic acid, 1,2-diaminopropanetetraacetic acid, glycol ether diaminetetraacetic acid, ethylenediamine-o-hydroxyphenylacetic acid, 2-phosphonobutane- 1,2,4-tricarboxylic acid, 1-hydroxyethylidene-1, 1-diphosphonic acid, N,N'-bis(2-hydroxybenzyl)ethylenediamine-N,N'-diacetic acid, and hydroxyethyliminodiacetic acid. These chelating agents may be used in combination of two or more of them, if necessary.

The addition amount of these chelating agents should be sufficient to mask the metal ions present in the color developing solution, and the amount is, for example, about 0.1 g to 10 g per liter.

A color developing solution can contain a development accelerator, if necessary.

For example, the thioether based compounds disclosed in JP-B-37-16088, JP-B-37-5987, JP-B-38-7826, JP-B-44-12380, JP-B-45-9015 and U.S. Pat. No. 3,318,247, the p-phenylenediaamine based compounds disclosed in JP-A-52-49829 and JP-A-50-15554, the quaternary ammonium salts disclosed in JP-A-50-137726, JP-B-44-30074, JP-A-56-156826 and JP-A-52-43429, the amine based compounds disclosed in U.S. Pat. Nos. 2,494,903, 3,128,182, 4,230,796, 3,253,919, JP-B-41-11431, U.S. Pat. Nos. 2,482,546, 2,596,926, and 3,582,346, and the polyalkylene oxides disclosed in JP-B-37-16088, JP-B-42-25201, U.S. Pat. No. 3,128,183, JP-B-41-11431, JP-B-42-23883 and U.S. Pat. No. 3,532,501, and also 1-phenyl-3-pyrazolidones and imidazoles can be added as a development accelerator, if necessary. Benzyl alcohol is as described above.

An antifoggant can be included arbitrarily in the present invention, if desired. Alkali metal halides such as sodium chloride, potassium bromide and potassium iodide, and organic antifoggants can be used as an antifoggant. Specific examples of organic antifoggants include nitrogen-containing heterocyclic compounds such as benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine and adenine.

The chloride ion concentration in the color developing solution of the present invention is preferably from $5\times10^{-2}$ to $2\times10^{-1}$ mol/liter from the viewpoint of preventing the fluctuations in photographic characteristics, and more preferably from $6\times10^{-2}$ to $1.5\times10^{-1}$ mol/liter, and particularly preferably from $8\times10^{-2}$ to $1.3\times10^{-1}$ mol/liter.

Further, the bromide ion concentration in the color developing solution of the present invention is preferably from $1\times10^{-4}$ to $4\times10^{-4}$ mol/liter from the viewpoint of preventing the fluctuations in photographic characteristics, and more preferably from $1.2\times10^{-4}$ to $3.8\times10^{-2}$ mol/liter, and particularly preferably from $1.5\times10^{-4}$ to $3.5\times10^{-4}$ mol/liter. In addition, it is most preferred that chloride ion and bromide ion in the above cited ranges exist together.

The color developing solution and the color developing solution replenisher of the present invention can include a brightening agent, if desired.

Triazinyl-4,4-diaminostilbene based compounds are preferred as a brightening agent. Above all, the compounds represented by the following formula (SR) are preferred in view of solubility to the replenisher, prevention of the deposition of the replenisher and the reduced stain of the photographic material after processing.

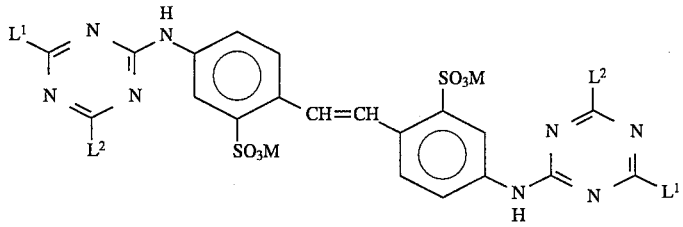

wherein $L^1$ and $L^2$, which may be the same or different, each represents $—OR^1$ or $—NR^2R^3$ (wherein $R^1$, $R^2$ and $R^3$ each represents a hydrogen atom or an alkyl group), and satisfy at least one of the following conditions (1) and (2).

(1) Four substituents $L^1$ and $R^2$ in formula (SR) have the total substituents of 4 or more selected from formula (A) group.

(2) Four substituents $L^1$ and $L^2$ in formula (SR) have the total substituents of 2 selected from formula (A) group and the total substituents of 2 or more selected from formula (B) group.

Formula (A) Group $$—SO_3M,\ —OSO_3M,\ —COOM,\ —NR_3X$$

Formula (B ) Group $$—OH,\ —NH_2,\ —CN,\ —NHCONH_2$$

In formula (A) group, X represents a halogen atom and R represents an alkyl group.

In formula (SR) and formula (A) group, M represents a hydrogen atom, an alkaline earth metal, ammonium or pyridinium.

The diaminostilbene based brightening agents represented by formula (SR) which are used in the present invention are exemplified as specific structures in which $L^1$ and $L^2$ are represented by the following atomic groups, however, the present invention is not limited thereto.

TABLE 1

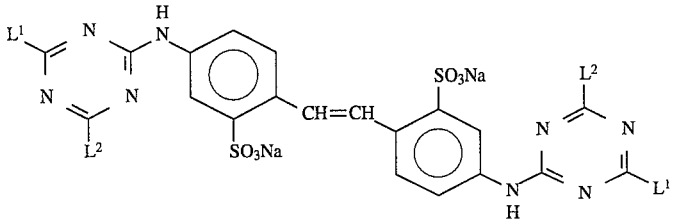

| Cpd. No. | $L^1$ | $L^2$ |
|---|---|---|
| SR-1 | $-NHCH_2CH(CH_3)SO_3Na$ | $-NHCH_2CH(CH_3)SO_3Na$ |
| SR-2 | $-OC_2H_4OSO_3Na$ | $-OC_2H_4OSO_3Na$ |
| SR-3 | $-N(C_2H_4OSO_3Na)_2$ | $-N(C_2H_4OSO_3Na)_2$ |
| SR-4 | $-OC_2H_4SO_3H$ | $-OC_2H_4SO_3H$ |
| SR-5 | $-NHC_2H_4SO_3H$ | $-NHC_2H_4SO_3H$ |
| SR-6 | $-NHC_2H_4SO_3(NH_4)$ | $-NHC_2H_4SO_3(NH_4)$ |
| SR-7 | $-NHC_2H_4COOH$ | $-NHC_2H_4COOH$ |
| SR-8 | " | $-NHC_2H_4SO_3Na$ |
| SR-9 | $-NHC_2H_4COONa$ | $-NHC_2H_4COONa$ |
| SR-10 | " | $-NHC_2H_4SO_3Na$ |
| SR-11 | $-N(CH_3)_3Cl$ | $-N(CH_3)_3Cl$ |

TABLE 2

| Cpd. No. | $L^1$ | $L^2$ |
|---|---|---|
| SR-12 | $-OC_2H_4SO_3Na$ | $-OC_2H_4SO_3Na$ |
| SR-13 | $-NHC_2H_4SO_3Na$ | $-NHC_2H_4SO_3Na$ |
| SR-14 | $-N(CH_3)(C_2H_4SO_3Na)$ | $-N(CH_3)(C_2H_4SO_3Na)$ |
| SR-15 | $-N(C_2H_5)(C_2H_4SO_3Na)$ | $-N(C_2H_5)(C_2H_4SO_3Na)$ |
| SR-16 | $-N(C_2H_4SO_3Na)_2$ | $-N(C_2H_4SO_3Na)_2$ |
| SR-17 | $-N(C_2H_4SO_3Na)_2$ | $-OCH_3$ |
| SR-18 | " | $-OH$ |
| SR-19 | " | $-OC_2H_4OH$ |
| SR-20 | " | $-NH_2$ |
| SR-21 | " | $-NHC_2H_4OH$ |
| SR-22 | " | $-OC_2H_4NH_2$ |
| SR-23 | " | $-NHC_2H_4N(CH_3)_2$ |
| SR-24 | $-NHC_2H_4SO_3Na$ | $-OC_2H_4SO_3Na$ |

TABLE 2-continued

| Cpd. No. | $L^1$ | $L^2$ |
|---|---|---|
| SR-25 | " | $-N(CH_3)(C_2H_4SO_3Na)$ |
| SR-26 | " | $-N(C_2H_4OSO_3Na)_2$ |
| SR-27 | " | $-NHCH_2CH(CH_3)SO_3Na$ |

TABLE 3

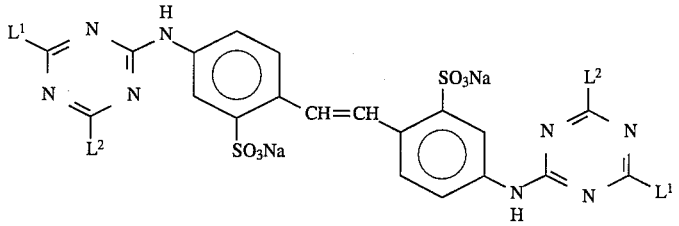

| Cpd. No. | $L^1$ | $L^2$ |
|---|---|---|
| SR-28 | $-OC_2H_4SO_3Na$ | $-OH$ |
| SR-29 | " | $-OC_2H_4NH_2$ |
| SR-30 | " | $-OCH_2CH(OH)CH_3$ |
| SR-31 | " | $-OC_2H_4OH$ |
| SR-32 | " | $-NH_2$ |
| SR-33 | " | $-N(C_2H_4OH)_2$ |
| SR-34 | " | $-NHC_2H_4OH$ |
| SR-35 | $-NHC_2H_4SO_3Na$ | $-OH$ |
| SR-36 | " | $-OC_2H_4NH_2$ |
| SR-37 | " | $-OCH_2CH(OH)CH_3$ |
| SR-38 | " | $-OC_2H_4OH$ |
| SR-39 | " | $-NH_2$ |
| SR-40 | " | $-N(C_2H_4OH)_2$ |
| SR-41 | " | $-NHC_2H_4OH$ |

TABLE 4

| Cpd. No. | $L^1$ | $L^2$ |
|---|---|---|
| SR-42 | $-NHC_2H_4SO_3Na$ | $-N(CH_3)(C_2H_4OH)$ |
| SR-43 | " | $-NHC_2H_4NHCONH_2$ |
| SR-44 | " | $-NHCH(CH_3)CH_2OH$ |
| SR-45 | " | $-N(C_2H_4OH)_2$ |
| SR-46 | " | $-OC_2H_4OSO_3Na$ |
| SR-47 | $-NHC_2H_4SO_3H$ | $-OH$ |
| SR-48 | " | $-OC_2H_4NH_2$ |
| SR-49 | " | $-OCH_2CH(OH)CH_3$ |
| SR-50 | " | $-OC_2H_4OH$ |
| SR-51 | " | $-NH_2$ |
| SR-52 | " | $-N(C_2H_4OH)_2$ |
| SR-53 | " | $-NHC_2H_4OH$ |

TABLE 4-continued

| Cpd. No. | $L^1$ | $L^2$ |
|---|---|---|
| SR-54 | " | $-N(CH_3)(C_2H_4OH)$ |

TABLE 5

| Cpd. No. | $L^1$ | $L^2$ |
|---|---|---|
| SR-55 | $-N(CH_3)(C_2H_4SO_3Na)$ | $-OH$ |
| SR-56 | " | $-OC_2H_4NH_2$ |
| SR-57 | " | $-OC_2H_4OH$ |
| SR-58 | " | $-NHC_2H_4OH$ |
| SR-59 | " | $-N(C_2H_4OH)_2$ |
| SR-60 | $-OC_2H_4OSO_3Na$ | $-OH$ |
| SR-61 | " | $-OC_2H_4NH_2$ |
| SR-62 | " | $-OC_2H_4COOH$ |
| SR-63 | " | $-NH_2$ |
| SR-64 | " | $-NHC_2H_4OH$ |

TABLE 5-continued

| Cpd. No. | $L^1$ | $L^2$ |
|---|---|---|
| SR-65 | " | $-N(C_2H_4OH)_2$ |
| SR-66 | $-NHC_2H_4COONa$ | $-OH$ |
| SR-67 | " | $-OC_2H_4NH_2$ |
| SR-68 | " | $-OC_2H_4OH$ |

TABLE 6

| Cpd. No. | $L^1$ | $L^2$ |
|---|---|---|
| SR-69 | $-NHC_2H_4COONa$ | $-NH_2$ |
| SR-70 | " | $-N(C_2H_4OH)_2$ |
| SR-71 | " | $-NHC_2H_4OH$ |

The compounds represented by formula (SR) may be used alone or may be used together with a plurality of other diaminostilbene based compounds, but in the case of the combined use the compounds to be used together are preferably the compounds represented by formula (SR) or the compounds represented by the following formula (SR-c).

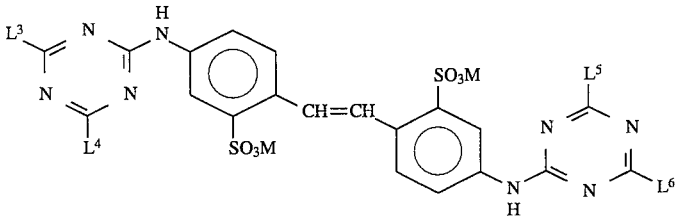

(SR-c)

wherein $L^3$, $L^4$, $L^5$ and $L^6$, which may be the same or different, each represents $—OR^8$ or $—NR^9R^{10}$, $R^8$, $R^9$ and $R^{10}$ each represents a hydrogen atom, an alkyl group, or an alkyl group which may be substituted.

Specific examples of the compounds represented by formula (SR-c) are shown in Table 7 below.

TABLE 7

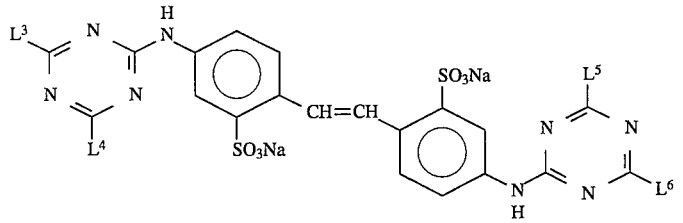

| Cpd. No. | $L^3$ | $L^4$ | $L^5$ | $L^6$ |
|---|---|---|---|---|
| B-1 | $-NHC_2H_4SO_3Na$ | $-OCH_3$ | $-OCH_3$ | $-N(C_2H_4OH)_2$ |
| B-2 | $-NHC_2H_4SO_3Na$ | $-OCH_3$ | $-OCH_3$ | $-NHC_2H_4OH$ |
| B-3 | $-NHC_2H_4SO_3Na$ | $-NHC_2H_5$ | $-NHC_2H_5$ | $-NHC_2H_4OH$ |
| B-4 | $-NHC_2H_4OH$ | $-NHC_2H_4OH$ | $-NHC_2H_4OH$ | $-NHC_2H_4OH$ |
| B-5 | $-OC_2H_4OH$ | $-OC_2H_4OH$ | $-OC_2H_4OH$ | $-OC_2H_4OH$ |
| B-6 | $-OC_2H_4OH$ | $-OH$ | $-OH$ | $-OC_2H_4OH$ |

TABLE 7-continued

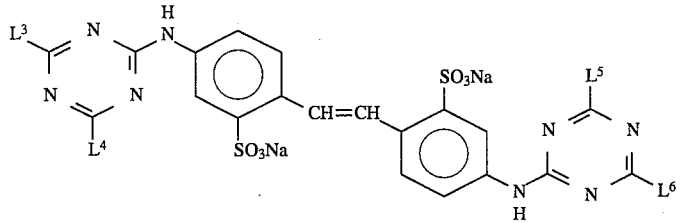

| Cpd. No. | $L^3$ | $L^4$ | $L^5$ | $L^6$ |
|---|---|---|---|---|
| B-7 | $-OC_2H_4OH$ | $-NH_2$ | $-NH_2$ | $-OC_2H_4OH$ |
| B-8 | $-OC_2H_4OH$ | $-OCH_3$ | $-OCH_3$ | $-OC_2H_4OH$ |
| B-9 | $-OC_2H_4OH$ | $-OC_2H_4NH_2$ | $-OC_2H_4NH_2$ | $-OC_2H_4OH$ |
| B-10 | $-NHC_2H_4OH$ | $-OC_2H_5$ | $-OC_2H_5$ | $-NHC_2H_4OH$ |
| B-11 | $-OC_2H_4OH$ | $-NHC_2H_5$ | $-NHC_2H_5$ | $-OC_2H_4OH$ |
| B-12 | $-N(C_2H_5)(C_2H_4OH)$ | $-OH$ | $-OH$ | $-N(C_2H_5)(C_2H_4OH)$ |

Moreover, conventionally available diaminostilbene based brightening agents may be used together with the compounds represented by formula (SR) of the present invention. Examples of conventionally available compounds are disclosed in *Dyeing Note,* 19th Ed., pp. 165 to 168, Senshoku-sha, and Whitex RP or Whitex BRF liq. are preferred of them.

Further, various kinds of surfactants can be added, if desired. Specific examples of surfactants include compounds represented by formulae (I) and (II) of JP-A-4-195037 and compounds represented by formulae (I) to (X) of JP-A-4-81750.

In addition, it is preferred to set the surface tension of a color developing solution and a color developing solution replenisher at 20 to 60 dyne/cm by the addition of the above compounds.

The compounds represented by formula (I) of JP-A-5-333505 are particularly preferably used to prevent deposition, in particular, the deposition of the color developing agent, at the part where the tank or rack and the developing solution in the processing bath contact the air.

The processing temperature of a color developing solution applicable to the present invention is generally from 20° C. to 50° C., and preferably from 30° C. to 45° C. The processing time is generally from 20 seconds to 5 minutes, and preferably from 30 seconds to 2 minutes.

The replenishment rate of the color developing solution in the present invention is appropriately from 20 to 1,000 ml, preferably from 30 to 200 ml, and more preferably from 35 to 80 ml, per $m^2$ of the photographic material.

It is preferred to cover the surface of a color developing solution replenisher, as well as a bleach-fixing solution replenisher, with a floatable liquid, which is described later, from the viewpoint of improving stability.

Water washing processing is, in general, carried out after the processing step with a fixing ability. A simple processing method can be employed such that stabilization processing is conducted without substantial water washing after processing with a processing solution having a fixing ability.

The replenishing amount in the water washing step or the stabilization step is from 3 to 50 times, and preferably from 3 to 30 times, per unit area of the photographic material of the carryover from the prebath thereof. In the case of carrying out stabilization processing after water washing, the method of the present invention is effective in a processing system in which the replenishing amount in the final stabilization processing is at least from 3 to 50 times the carryover from the prebath. The replenishment may be carried out continuously or intermittently. The solution which has been used in the water washing and/or the stabilization step can further be used in the prebath thereof. One such example is that the amount of the water washing tank is reduced by a multistage countercurrent system and the overflow of the water washing tank is introduced into the preceding bleach-fixing tank, and a concentrated solution is fed to the bleach-fixing tank for replenishment to thereby reduce the amount of waste solution.

The amount of washing water used in a water washing step can be selected within a wide range depending on the characteristics (for example, the materials employed, such as couplers) and applications of the photographic material, the temperature of washing water, the number of water washing tanks (the number of water washing stages), the replenishment system, that is, whether a countercurrent system is used or a cocurrent system is used, and other various factors. In general, the number of stages in a multistage countercurrent system is preferably from 2 to 6, and particularly preferably from 2 to 4.

The amount of washing water can be greatly reduced using a multistage countercurrent system and washing can be achieved with 0.5 to 1 liter of water per $m^2$ of a photographic material. However, bacteria proliferate due to the increased residence time of the water in the tanks and problems arise such that suspended matter formed adheres to the photographic material. The method in which the calcium and magnesium concentrations are reduced as disclosed in JP-A-62-288838 can be very effectively utilized as a means of overcoming these sorts of problems.

In addition, it is preferred to use the water sterilized by halogen, an ultraviolet germicidal lamp, or an ozonator.

It is also preferred for washing water and a stabilizing solution to contain various antibacterial agents or antimolds for inhibiting the generation of scale or the generation of mold over the processed photographic materials. Examples of such antibacterial agents and antimolds include thiazolylbenzimidazole based compounds disclosed in JP-A-57-157244 and JP-A-58-105145, isothiazolone based compounds disclosed in JP-A-57-8542, chlorophenol based compounds represented by trichlorophenol, bromophenol based compounds, organotin compounds, organozinc compounds, acid amide based compounds, diazine based compounds, triazine based compounds, thiourea based compounds, benzotriazole based compounds, alkylguanidine compounds, quaternary ammonium salts represented by benzalconium chloride, antibiotics represented by penicillin, and general purpose antimolds disclosed in *J. Antibact. Antifung. Agents,* Vol. 1, No. 5, pp. 207 to 223 (1983), Hiroshi Horiguchi, Bohkin Bohbai no Kagaku (*Antibacterial and Antifungal Chemistry*), published by Sankyo Shuppan K.K. (1986), Biseibutsu no Mekkin, Sakkin, Bohbai Gijutsu (*Germicidal and Antifungal Techniques of Microorganisms*), edited by Eisei Gijutsukai, published by Kogyo Gijutsukai (1982), and Bohkin Bohbai Zai Jiten (*Antibacterial and Antifungal Agents Thesaurus*), edited by Nippon Bohkin Bohbai Gakkai (1986). They may be used in combination of two or more. Further, various fungicides disclosed in JP-A-48-83820 may also be used.

It is preferred for a washing water and a stabilizing solution to contain various surfactants to prevent water marks during drying the processed photographic materials. Examples of such a surfactant include polyethylene glycol type nonionic surfactants, polyhydric alcohol type nonionic surfactants, alkylbenzenesulfonate type anionic surfactants, higher alcohol sulfate type anionic surfactants, alkylnaphthalenesulfonate type anionic surfactants, quaternary ammonium salt type cationic surfactants, amine salt type cationic surfactants, amino salt type amphoteric surfactants, and betaine type amphoteric surfactants. Nonionic surfactants are preferably used and ethylene oxide addition product of alkylphenol is particularly preferred. Octyl-, nonyl-, dodecyl-, and dinonylphenol are particularly preferred as the alkylphenol and the addition mol number of the ethylene oxide is particularly preferably from 8 to 14. Further, it is preferred to use silicone based surfactants which have a high defoaming effect.

Also, it is preferred to include various kinds of chelating agents in a washing water and a stabilizing solution. Preferred chelating agents include aminopolycaraboxylic acid, e.g., ethylenediaminetetraacetic acid and diethylenetriaminepentaacetic acid, organic phosphonic acid, e.g., 1-hydroxyethylidene-1,1-diphosphonic acid, ethylenediaminetetraacetic acid, diethylenetriamine-N,N,N',N'-tetramethylenephosphonic acid, and a hydrolysis product of a maleic anhydride polymer disclosed in EP 345172A1, and the like.

A stabilizing solution contains color image stabilizing compounds, for example, formalin, hexamethylenetetramine and derivatives thereof, hexahydrotriazine and derivatives thereof, dimethylolurea, N-methylol compounds such as N-methylolpyrazole, organic acids and pH buffers. The preferred addition amount of these compounds is from 0.001 to 0.02 mol per liter of the stabilizing solution, but the lower the concentration of the free formaldehyde in the stabilizing solution, the less is the splashing of the formaldehyde gas, and is preferred. From these points, hexamethylenetetramine, N-methylolazoles such as N-methylol-pyrazole disclosed in JP-A-5-34889, and azolylmethylamine such as N,N'-bis(1,2,4-triazol-1-yl)piperazine, etc., disclosed in JP-A-4-313753 are preferred as color image stabilizers. Further, it is preferred to include various compounds in the stabilizing solution, if necessary, for example, ammonium compounds such as ammonium chloride and ammonium sulfite, metallic compounds such as Bi and Al, a brightening agent, a hardening agent, alkanolamine disclosed in U.S. Pat. No. 4,786,583, and preservatives which can be included in the aforementioned fixing solution and bleach-fixing solution. For example, sulfinic acid compounds as disclosed in JP-A-1-231051 (benzenesulfinic acid, toluene-sulfinic acid, or sodium salt and potassium salt of them) are preferred of them. The addition amount of these compounds is preferably from $1\times10^{-5}$ to $1\times10^{-3}$ mol, and particularly preferably from $3\times10^{-5}$ to $5\times10^{-4}$ mol, per liter of the stabilizing solution.

The replenishing amount in the water washing step or the stabilization step is generally from 50 to 2,000 ml, and preferably from 100 to 1,000 ml, per $m^2$ of the photographic material.

The method of reverse osmosis processing using a reverse osmosis membrane as disclosed in JP-A-3-55542 can be effectively utilized to reduce the replenishing rate without impairing the stability of color images.

Processing a washing water and/or a stabilizing solution with a reverse osmosis membrane means that the solution in at least one of the tanks comprising the water washing step and/or stabilizing step is allowed to contact the reverse osmosis membrane and the solution which permeated the reverse osmosis membrane is returned to a tank comprising the water washing step and/or stabilizing step.

The water washing step and/or stabilizing step in the multistage countercurrent system preferably comprise(s) from 2 to 6 tanks, more preferably from 3 to 5 tanks, and most preferably from 4 to 5 tanks. All of these tanks may be water washing tanks or all of them may be stabilizing tanks.

When the water washing step and/or stabilizing step in the multistage countercurrent system comprise(s) 3 or more tanks, a tank to be installed with a reverse osmosis membrane is preferably the second or after and next to the last tank. In this case, it is preferred that the permeated solution which passed through the reverse osmosis membrane and purified is returned to a tank positioned after the tank installed with the reverse osmosis membrane, and the concentrated solution is returned to the tank installed with the reverse osmosis membrane.

The case in which the water washing step and/or stabilizing step in the multistage countercurrent system comprise(s) 4 or more tanks, and the reverse osmosis membrane is installed in the third or after tank is particularly preferred in the present invention.

There are a high pressure reverse osmosis membrane, a middle pressure reverse osmosis membrane, and a low pressure reverse osmosis membrane as a reverse osmosis membrane, and the use of a low pressure reverse osmosis membrane is preferred in the present invention.

Specifically, when an aqueous solution containing 2,000 ppm of NaCl is processed with a reverse osmosis membrane at 25° C. and a pressure of 5 $kg/cm^2$, a reverse osmosis membrane having the removal rate of NaCl in the permeated solution of from 30 to 90% is preferred. With such a loose reverse osmosis membrane, a large amount of solution can be permeated even at low pressure, and EDTA-Fe which is a cause of generation of stain can be sufficiently removed.

These reverse osmosis membranes comprise a skin layer which controls a solution permeating amount, a removal rate and s membrane performance, and a supporting layer which supports a skin layer, and there are an asymmetrical membrane in which two layers comprise the same material and a complex membrane in which two layers comprise different materials.

A synthetic complex membrane is preferably used in view of a removal rate, a solution permeating amount and durability against EDTA-Fe.

The details about a synthetic complex membrane are disclosed in *Development and Practical Use of High Separation Technique,* a separate volume "Chemical Industry 29-7", pages 156 to 172, published by Kagaku Kogyo.

There are DRA-40, DRA-80 and DRA-89, products of Daicel Chemical Industries Ltd., and SU-200, SU-210 and SU-220, products of Toray Industries Inc., as specific examples of synthetic complex membranes.

The solution feed pressure applied to a processing solution fed to a reverse osmosis membrane is preferably from 2 to 20 $kg/cm^2$, more preferably from 3 to 15 $kg/cm^2$, and most preferably from 3 to 6 $kg/cm^2$.

When a permeation solution feed amount (the amount of a solution which is permeated through a reverse osmosis membrane, purified, and fed to a processing tank positioned after the tank installed with the reverse osmosis membrane) is taken as F, a concentrated solution amount (the amount of a solution which is concentrated by a reverse osmosis membrane and returned to the tank installed with the reverse osmosis membrane) as C, and a fresh replenisher as R, a permeation solution feed amount F is preferably more than a fresh replenisher R, more preferably F is from 2 to 200 times of R, still more preferably from 5 to 150 times, and particularly preferably from 10 to 100 times. Further, a concentrated solution amount C is preferably more than a permeation solution feed amount F, more preferably C is 2 to 100 times of F, still more preferably from 3 to 50 times, and particularly preferably from 5 to 30 times. Here, flowing amounts of F, C and R are each a flowing amount per one day.

In a method in which the reverse osmosis process is carried out using a reverse osmosis membrane, the replenishing amount in the water washing or stabilization step may be 200 ml or less, preferably from 30 to 200 ml, and more preferably from 50 to 150 ml, per $m^2$ of the photographic material.

The pH of the washing water and stabilizing solution is generally from 4 to 10 but is preferably from 6 to 9.

The temperature of the washing water and stabilizing solution is preferably from 30° to 45° C.

The processing time is generally from 10 seconds to 2 minutes, and particularly preferably from 10 to 60 seconds.

It is preferred to use various methods of regeneration in combination to further reduce the above described amounts of replenishers for environmental protection. Regeneration may be carried out while a processing solution is circulating in an automatic processor, or a processing solution may be once removed from an automatic processor and undergone an appropriate regeneration treatment and then returned to a processing tank as a replenisher.

In particular, a developing solution can be regenerated and reused.

Regeneration of a used developing solution is carried out by anion exchange resins or electrodialysis, or by adding treatment chemicals called regenerants to raise the activity of the developing solution, and the treated solution is reused as a processing solution. In this case, a regeneration rate (a rate of an overflow solution in a replenisher) is preferably 50% or more, particularly preferably 70% or more.

As a process employing a developing solution regeneration, there is a process in which an overflow solution of a developing solution is regenerated and reused as a replenisher. Anion exchange resins are preferably used for regeneration. With respect to particularly preferred compositions of anion exchange resins and the regeneration method of the resins, *Diaion Manual* (*I*), 14th Ed., 1986, published by Mitsubishi Kasei Corp. can be referred to. The resins having the compositions disclosed in JP-A-2-952 and JP-A-1-281152 are preferably used in the present invention.

A method in which regeneration is carried out by only adding regenerants to an overflow solution to recover a replenisher and not treating with anion exchange resins or electrodialysis as disclosed in JP-A-3-174154 is most preferred for simplicity.

As metal chelate bleaching agents in a bleaching solution and/or a bleach-fixing solution are reduced as a bleaching process progresses, it is preferred to subject a bleaching solution and/or a bleach-fixing solution to a continuous regenerating treatment in cooperation with the bleaching and/or bleach-fixing process(es). Specifically, it is preferred to blow air to a bleaching solution and/or a bleach-fixing solution by an air pump to reoxidize the reduced metal chelate with oxygen, that is, aeration. Regeneration can also be achieved by the addition of oxidizing agents such as hydrogen peroxide, persulfate and bromate.

Regeneration of a fixing solution and a bleach-fixing solution is conducted by electrolytic reduction of accumulated silver ions. Removal of accumulated halogen ions with anion exchange resins is preferred for maintaining a fixing ability as well.

The method disclosed in EP 479262A1 in which only regenerants are added to an overflow solution to thereby obtain a replenisher without aeration or removal of silver ions by anion exchange resins is the most preferred regeneration method of a bleach-fixing solution for its simplicity.

Silver recovery from a processing solution having a fixing ability can be carried out according to known methods, and the regenerated solution after the silver recovery can be used in the present invention. Preferred methods of the silver recovery include an electrolysis method (disclosed in French Patent 2,299,667), a precipitation method (disclosed in JP-A-52-73037 and German Patent 2,331,220), an ion exchange method (disclosed in JP-A-51-17114 and German Patent 2,548,237), and a metal substitution method (disclosed in British Patent 1,353,805). It is preferred to conduct these silver recovery methods by an in-line system from the solution in a tank to further improve the rapid processability.

The present invention is applicable to processing of color reversal photographic materials. In such a case, the following processing steps are conducted prior to the color development.

(1) Black-and-white development—water washing—reversal exposure—color development (2) Black-and-white development—water washing—reversal processing—color development (3) Black-and-white development—water washing—color development In the case of (3), it is preferred that a fogging agent for reversal processing is previously included in a color developing solution. The compounds and processing conditions disclosed in JP-A-3-71130, from p. 14, right lower column, last line to p. 16, right upper column, line 3 can be applied to each process of color reversal processing. Hydroxylamines having substituents described above at the part of a color developing solution are preferably used in a black-and-white developing solution.

The processing of the present invention is carried out using an automatic processor. Automatic processors which are preferably in the present invention are described below.

It is preferred that the contact area of air with the processing solution in a processing tank and a replenisher tank (aperture area) of the present invention is as small as possible. For example, when the aperture ratio is represented by the equation dividing the aperture area ($cm^2$) by the volume of the processing solution in a tank ($cm^3$), the aperture ratio is preferably 0.01 ($cm^{-1}$) or less, more preferably 0.005 or less, and particularly preferably 0.001 or less.

It is preferred to provide a solid or liquid non-contact means with air which is floating on the surface of the solution in a processing tank or a replenisher tank to reduce the aperture area.

Specifically, means of covering the surface of the solution with a floating lid of plastics or shielding with a liquid immiscible with and not chemically reacting with a processing solution are preferred. Liquid paraffin and liquid saturated hydrocarbon are preferred examples of such liquids.

The crossover time required for a photographic material to transfer from one processing tank to another processing tank in the air is preferred to be as short as possible for carrying out processing rapidly, preferably 10 seconds or less, more preferably 7 seconds or less, and most preferably 5 seconds or less. The use of a cinema type automatic processor is preferred in the present invention for achieving such a short crossover time, and particularly a leader conveyance system is preferred. This system is adopted in an automatic processor FP-560B, a product of Fuji Photo Film Co., Ltd. The line velocity of conveyance is preferred to be larger, generally from 30 cm to 30 m, and preferably from 50 cm to 10 m, per minute.

A belt conveyor system disclosed in JP-A-60-191257, JP-A-60-191258 and JP-A-60-191259 is preferred as a conveying system of a leader or a photographic material, and the systems disclosed in JP-A-3-126944, JP-A-3-127062 and JP-A-3- 127061 are preferably adopted as conveyor structures.

The structure of a crossover rack which is provided with a mixture inhibiting plate disclosed in JP-A-3-126943 is preferred for use in the present invention for shortening the crossover time and inhibiting the mixture of the processing solutions.

It is preferred in the present invention that the amounts corresponding to the evaporated processing solutions be supplemented with water, that is, a so-called evaporation compensation, and it is particularly preferred with regard to a color developing solution, a bleaching solution and a bleach-fixing solution.

There is no particular limitation on the method of supplementing water, but the following methods are preferred of all, e.g., a method wherein a monitoring water tank is arranged separately from the bleaching tank, and the amount of water evaporated from the bleaching tank is calculated from the amount of water evaporated from the monitoring water tank, and water is replenished to the bleaching tank in proportion to this amount of evaporation, which is disclosed in JP-A-1-254959 and JP-A-1-254960, and a method wherein a liquid level sensor or an overflow sensor is used to compensate the evaporated amount of water, which is disclosed in JP-A-3-248155, JP-A-3-249644, JP-A-3-249645, JP-A-3-49646, and JP-A-4-14042. The most preferred evaporation compensation method is a method wherein the presumed amount of water corresponding to the evaporation amount calculated from the coefficient previously determined based on the information of operating time, stopping time and temperature controlling time of the automatic processor is added, which is disclosed in Nippon Hatsumei Kyokai Kokai Giho, 94-49925, p. 1, right column, line 26 to p. 3, left column, line 28, and JP-A-4-1756.

Further, means to reduce the evaporation amount are necessary, for example, reducing the aperture area or controlling the air capacity of an exhaust fan are required. As the preferred aperture ratio of a color developing solution is as described above, it is preferred to reduce aperture areas with respect to other processing solutions as well.

Figure 2:
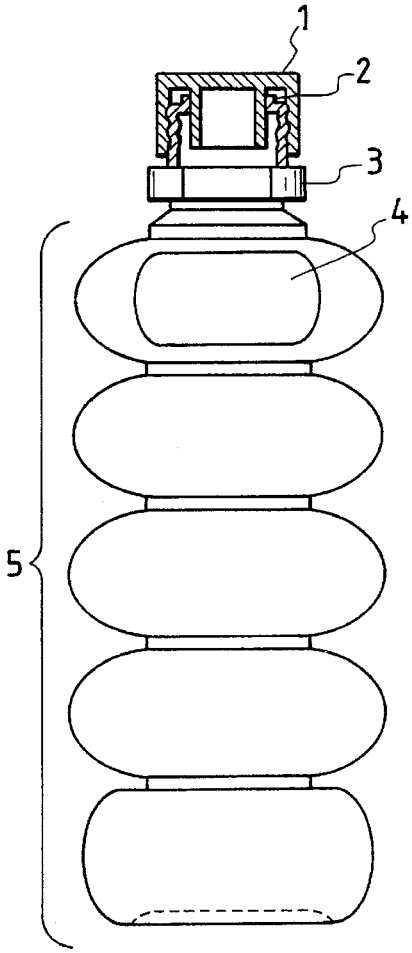
FIG. 2 is a front view of a nearly round type flexible vessel for a processing solution having a bellows part.

As a means to reduce the evaporation amount, "maintaining the humidity of the upper space of the processing bath at 80% RH or more" as disclosed in JP-A-6-110171 is particularly preferred, and it is preferred to be provided with the automatic washer for the rack and roller illustrated in FIGS. 1 and 2.

An exhaust fan is provided for preventing the dew condensation during temperature controlling, and the preferred displacement is from 0.1 $m^3$ to 1 $m^3$, particularly preferably from 0.2 $m^3$ to 0.4 $m^3$, per minute.

Drying conditions of photographic materials also affect the evaporation of processing solutions. The use of a hot air heater made of ceramic is a preferred drying system, and the supplying air capacity is preferably from 4 $m^3$ to 20 $m^3$, and particularly preferably from 6 $m^3$, to 10 $m^3$, per minute.

A superheating preventing thermostat of a hot air heater made of ceramic is preferably a system actuated by heat transfer and is preferably installed on the leeward side or on the windward side through the radiation fin or the heat transfer part. Drying temperature is preferred to be controlled according to the water content of the photographic material to be processed, and optimal temperature ranges are from 45° to 55° C. in the case of a 35 mm width film and from 55° to 65° C. in the case of a Brownie film.

As a replenishing pump is used in the replenishment of processing solutions, a bellows type replenishing pump is preferred. As a method of improving the accuracy of replenishment, making the diameter of a liquid pipe to a replenishing nozzle smaller is effective to prevent the backflow at stopping time. The inside diameter is preferably from 1 to 8 mm, and particularly preferably from 2 to 5 mm.

There are used various parts of materials in an automatic processor, and preferred materials are described below.

Modified PPO (modified polyphenylene oxide) and modified PPE (modified polyphenylene ether) resins are preferred as materials of tanks such as a processing tank and a temperature controlling tank. An example of modified PPO includes "Noryl", a product of Nippon G.E. Plastics, and examples of modified PPE include "Zailon", a product of Asahi Chemical Industry Co., Ltd. and "Yupiace", a product of Mitsubishi Gas Chemical Co., Inc. Further, these materials are suitable for parts which might contact with processing solutions, such as a processing rack or a crossover.

PVC (polyvinyl chloride), PP (polypropylene), PE (polyethylene) and TPX (polymethylpentene) resins are suitable as materials for rollers of processing parts. In addition, these materials are usable for other parts which might contact with processing solutions. PE resin is also preferred as a material for a replenisher tank made by blow molding.

PA (polyamide), PBT (polybutyleneterephthalate), UHMPE (ultrahigh molecular weight polyethylene), PPS (polyphenylenesulfide), LCP (totally aromatic polyester resin, liquid crystal polymer) resins are preferred as materials for processing parts, gears, sprockets and bearings.

PA resin is a polyamide resin such as 66 nylon, 12 nylon and 6 nylon, and those containing glass fibers and carbon fibers are fast to swelling by processing solutions and which are usable.

A high molecular weight product such as MC nylon or a compression molded product are usable without fiber reinforcement. A UHMPE resin is preferably not reinforced, and preferred and commercially available products thereof include "Lubmer", "Hizex Million", Mitsui Petrochemical Industries, Ltd., "New Light", Sakushin Kogyo Co., Ltd., and "Sunfine", Asahi Chemical Industry Co., Ltd. The molecular weight is preferably 1,000,000 or more, and more preferably from 1,000,000 to 5,000,000.

The preferred PPS resins are those reinforced with glass fibers or carbon fibers. Examples of commercially available LCP resins include "Victrex", a product of ICI Japan Co., Ltd., "Ekonol", Sumitomo Chemical Co., Ltd., "Zaider", Nippon Oil Co., Ltd., and "Vectra", Polyplastics Co., Ltd.

Ultrahigh tenacity polyethylene fibers or polyvinylidene fluoride resins described in JP-A-4-151656 are preferred as materials of a conveyor belt.

Vinyl chloride foam resins, silicone foam resins and urethane foam resins are preferred as flexible materials for squeegee rollers and the like. An example of urethane foam resin includes "Lubicel", a product of Toyo Polymer Co., Ltd.

EPDM rubber, silicone rubber and biton rubber are preferred as rubber materials for couplings of piping, couplings of agitation jet pipe and sealing materials.

Drying time is preferably from 30 seconds to 2 minutes and particularly from 40 seconds to 80 seconds.

Continuous processing primarily by a replenishment system has been described hitherto, however, a batch system in which processing is carried out with a fixed amount of a processing solution without replenishing, subsequently processing is carried out again by replacing the entire or a partial processing solution with a new processing solution can also preferably be used in the present invention.

It is preferred to use the following automatic processors in the present invention.

Printer Processor PP400, PP401B, PP540B, PP1040B, PP1270, PP1250V, PP1820V, PP2600B, PP700W, Film Processor FP230B, FP350, FP550B, FP560B and FP20, manufactured by Fuji Photo Film Co., Ltd.

RPV2-204, 2-206, 2-209, 2-212, 2-404, 2-406, 2-409, 2-412, 2-416, 2-430, CSR3-2070, 3-24100, 3-31100, 3-44100, 3-54100, QSS-1102V2, 1700V2, 1501, 1401, 1602, 1701V, 1702V, and QSS-MICRO, manufactured by Noritsu Koki Co., Ltd.

CL-PP1501QA, PP1721QA, PP1771VQA, PP1772VQA, PP801A/B, CL-NP30QAII, CL-KP50QA, KP32QA and NPS-103, manufactured by Konica Corp.

The detailed explanations of the above processors are disclosed in annexed manuals, for example, Printer Processor PP1250V of Fuji Photo Film Co., Ltd. is explained in the instruction manual (for superintendent), 1st Ed. (012DC296A/Feb. 7, 1992), the instruction manual (for operator), 1st Ed. (012DC291A/Jan. 16, 1992), a service manual, 1st Ed. (012DD291A/Jun. 20, 1992), and the list of parts, 2nd Ed. (012DE291B/February, 1992), respectively.

The processing chemicals which can be used in the present invention may be supplied in the form of one part type or may be supplied in the form of a plural part type concentrated solutions, and they may be dusting powders, tablets, granulated powders or paste. Further, they may be supplied in the form of a solution immediately usable as it is, or arbitrary combinations of concentrated solutions, dusting powders, tablets, granulated powders, paste and a solution immediately usable as it is.

When the processing chemicals to be used are in the form of one part type concentrated solution, it is diluted and used as a replenisher. In this case, it is preferred that the concentrated solution is set in the automatic processor and automatically diluted with water in the replenisher tank. It is preferred that the water to be used for dilution is the water in the washing water replenisher tank. Further, a concentrated solution may be directly supplied to a processing tank as it is and the water corresponding to the diluting rate may be directly added to the processing tank. This method is suitable for a compact processor not having a replenisher tank.

The method is the same with a plural part type concentrated solutions. It is preferred that the concentrated solutions are set in the automatic processor and automatically diluted with water in the replenisher tank. It is preferred that the water to be used for dilution is the water in the washing water replenisher tank. Further, each part of the concentrated solutions may be directly supplied to a processing tank as they are and the water corresponding to the diluting rate may be directly added to the processing tank.

The method is also the same in the case of the processing chemicals in the form of dusting powders, tablets, granulated powders or paste. It is preferred that the chemicals are directly added to the processing tank and the water corresponding to the diluting rate may be directly added to the processing tank. Moreover, it is also preferred that they are automatically dissolved and diluted in the replenisher tank and used as a replenisher.

The materials of the replenisher cartridge for use in the present invention may be any of paper, plastics or metals, but plastic materials having an oxygen permeation coefficient of 50 $ml/m^2 \cdot atm \cdot day$ or less are particularly preferred. Further, an oxygen permeation coefficient can be calculated according to the method disclosed in $O_2$ Permeation of Plastic Container, Modern Packing, N.J., Calyan, December, 1968, pages 143 to 145.

Specific examples of preferred plastic materials include vinylidene chloride (PVDC), nylon (NY), polyethylene (PE), polypropylene (PP), polyester (PES), ethylene-vinyl acetate copolymer (EVA), ethylene-vinyl alcohol copolymer (EVAL), polyacrylonitrile (PAN), polyvinyl alcohol (PVA), and polyethylene terephthalate (PET).

The use of PVDC, NY, PE, EVA, EVAL and PET is preferred in the present invention for the purpose of reducing oxygen permeability.

These materials may be used alone, molded, or several sheets may be laminated (so-called laminated film). The shape of a vessel may be a bottle type, a cubic type, or a pillow type, but a cubic type or a corresponding structure is particularly preferred in the present invention which is flexible, handleable and the volume can be reduced after use.

When these materials are used in the form of a laminated film, the following structures are particularly preferred but the present invention is not limited thereto. PE/EVAL/PE, PE/aluminum foil/PE, NY/PE/NY, NY/PE/EVAL, PE/NY/PE/WVAL/PE, PE/NY/PE/PE/PE/NY/PE, PE/$SiO_2$ film/PE, PE/PVDC/PE, PE/NY/aluminum foil/PE, PE/PP/aluminum foil/PE, NY/PE/PVDC/NY, NY/EVAL/PE/EVAL/NY, NY/PE/EVAL/NY, NY/PE/PVDC/NY/EVAL/PE, PP/EVAL/PE, PP/EVAL/PP, NY/EVAL/PE, NY/aluminum foil/PE, paper/aluminum foil/PE, paper/PE/aluminum foil/PE, PE/PVDC/NY/PE, NY/PE/alumunum foil/PE, PET/EVAL/PE, PET/aluminum foil/PE, PET/aluminum foil/PET/PE.

The thickness of the above laminated film is from about 5 to 1,500 μm, and preferably from about 10 to 1,000 μm. The volume of the finished vessel is from about 100 ml to 20 liters, and preferably from about 500 ml to 10 liters.

The above vessel (cartridge) may have a case of corrugated cardboard or plastics or may be molded integrally with the case.

The cartridge of the present invention can be charged with various processing solutions, for example, a color developing solution, a black-and-white developing solution, a bleaching solution, a compensating solution, a reversal solution, a fixing solution, a bleach-fixing solution, and a stabilizing solution. Particularly, a cartridge having a low oxygen permeation coefficient is suitable for the use of a color developing solution, a black-and-white developing solution, a fixing solution and a bleach-fixing solution.

Conventionally used rigid vessels for processing solutions of a monolayer material such as high density polyethylene (HDPE), polyvinyl chloride resin (PVC), and polyethylene terephthalate (PET) and a multilayer material such as nylon/polyethylene (NY/PE) can be used.

A flexible vessel for processing solutions the volume of which can be reduced after the content is discharged and empty, that is, the required space can be reduced, can also be used.

It is preferred to use the above flexible vessel in the present invention. One specific example of the above flexible vessel is a vessel for a solution comprising a flexible vessel body which is opened and closed by a cap member matching a hard opening part protruding upward from the vessel body, the vessel body and the opening part are integral-molded and at least one part of the vessel body toward the height direction has a bellows part (FIG. 1 and FIG. 2).

A flexible vessel having a bellows part is described below.

The shape of the vessel is a structure which has a bellows part and a horizontal cross section is a nearly square type (FIG. 1), a nearly hexagonal type, a nearly octagonal type, a nearly round type (FIG. 2), or an oval type.

A nearly square type or a nearly hexagonal type is preferred to reduce the required space under the conditions charged with the content. With respect to the belllows part (concave and convex parts), the number of the convex parts is preferably from 2 to 20, more preferably from 3 to 10, and particularly preferably from 4 to 8.

There is no particular limitation on the degree of concave and convex parts, but the outer circumferential dimension of the concave part is 85% or less, preferably from 40 to 75%, and more preferably from 50 to 75%, based on the outer circumferential dimension of the convex part.

The ratio of the total height of the vessel body after the bellows part is completely compressed to the total height of the vessel body before the bellows part is compressed is preferably 50% or less, more preferably 40% or less and particularly preferably from 10 to 30%. It is preferred to design and manufacture so that this ratio be 10% or more.

It is possible to impart to the above vessel a necessary gas barrier ability by changing materials and raw materials to be used. For example, when a high oxygen barrier ability is necessary such as a developing solution, a gas barrier ability of 25 ml/m$^2$·day·atm (20° C., 65%) or less, preferably from 0.5 to 10 ml/m$^2$·day·atm (20° C., 65%) can be obtained by molding the vessel using a multilayer structure comprising a low density polyethylene as a major component such as a three-layer structure of low density polyethylene/polyvinyl alcohol-ethylene copolymer/low density polyethylene (LDPE/EVOH/LDPE) or a layer structure of low density polyethylene/nylon (LDPE/NY).

When an oxygen barrier ability is not necessarily required, as for a bleaching solution, for example, it is possible to mold the vessel using a low density polyethylene (LDPE) alone or ethylene-vinyl acetate copolymer (EVA). The low density polyethylene which can be used include a low density polyethylene having a density of 0.940 g/cc or less, preferably from 0.90 to 0.94 g/cc, and more preferably from 0.905 to 0.925 g/cc. In this case, the obtained gas barrier ability can be made to be 50 ml/m$^2$·day·atm (20° C., 65%) or more, for example, from 100 to 5,000 ml/m$^2$·day·atm (20° C., 65%).

The vessel is molded so that the average thickness of the opening part of the vessel, flange part and the vicinities of these parts becomes preferably from 1 to 4 mm, more preferably from 1 to 3 mm, and particularly preferably from 1.2 to 2.5 mm, so that the thickness of the vessel body becomes preferably from 0.1 to 1.5 mm, more preferably from 0.2 to 1.0 mm, and particularly preferably from 0.3 to 0.7 mm, and so that the difference between both becomes preferably 0.2 mm, and more preferably about 0.5 mm.

The ratio of the surface area of the vessel (cm$^2$) to the content volume of the vessel (cm$^3$) increases according to the structure of the bellows part, but is preferably from 0.3 to 1.5 cm$^{-1}$, more preferably from 0.4 to 1.2 cm$^{-1}$, and particularly preferably from 0.5 to 1.0 cm$^{-1}$.

If the head space (the upper space of the inside of the vessel not containing the processing solution) of the vessel is little, it is preferred from the viewpoint of the stability of the solution when charging the solution to the vessel, but if the head space is too little, the solution is liable to spill during charging or use. The charging rate of the above vessel is preferably from 65 to 95%, and more preferably from 70 to 90%.

The cap or the inner stopper of the above vessel is preferably made of the same material with the vessel body for the purpose of easy selection for recycling for reclaiming. The cap or the inner stopper can be given the necessary gas barrier ability by changing the materials and raw materials thereof in the same manner as the above described vessel body.

There is no limitation about the content volume of the above vessel, but it is preferred from 50 ml to 5 liters from the viewpoint of handleability.

Examples of flexible vessels for processing solutions A to D which have bellows parts are shown below.

| Name of the vessel | Vessel A | Vessel B |
|---|---|---|
| Shape | Nearly square (FIG. 1) | Nearly round (FIG. 2) |
| Outer circumference of the convex part of the bellows part (cm) | 24 cm | 24 cm |
| Outer circumference of the concave part of the bellows part (cm) | 16 cm | 16 cm |
| Outer circumference of the concave part/outer circumference of the convex part (%) | 67% | 67% |
| Height before the bellows part is compressed (cm) | 18 cm | 18 cm |
| Height after the bellows part is compressed (cm) | 4 cm | 4 cm |
| Reduction rate of the height by the compression of the bellows part (%) | 22% | 22% |
| Content volume (ml) | 580 ml | 580 ml |
| Charge volume (ml) | 580 ml | 500 ml |
| Rate of charge (%) | 86% | 86% |
| Material of the vessel body | LDPE (density: 0.91 g/cc) | LDPE (density: 0.91 g/cc)/NY/ LDPE (density: 0.91 g/cc) |
| Material of cap and inner stopper | LDPE (density: 0.91 g/cc) | LDPE (density: 0.91 g/cc)/NY/ LDPE (density: 0.91 g/cc) |
| Oxygen permeability (ml/m$^2$ · day · atm (20° C., 65%)) | 100 | 1.0 |
| Thickness of the vessel body (mm) | 0.5 | 0.5 |
| Surface area of the vessel body (cm$^2$) | 520 | 505 |

| Name of the vessel | Vessel C | Vessel D |
|---|---|---|
| Shape | Nearly square (FIG. 1) | Nearly square (FIG. 1) |
| Outer circumference of the convex part of the bellows part (cm) | 35 cm | 35 cm |
| Outer circumference of the concave part of the bellows part (cm) | 24 cm | 24 cm |
| Outer circumference of the concave part/outer circumference of the convex part (%) | 67% | 67% |
| Height before the bellows part is compressed (cm) | 31 cm | 35 cm |
| Height after the bellows part is compressed (cm) | 7 cm | 8 cm |
| Reduction rate of the height by the compression of the bellows part (%) | 23% | 23% |
| Content volume (ml) | 2,300 ml | 2,900 ml |
| Charge volume (ml) | 2,000 ml | 2,500 ml |
| Rate of charge (%) | 86% | 86% |
| Material of the vessel body | LDPE (density: 0.91 g/cc) | LDPE (density: 0.91 g/cc)/NY/ LDPE (density: 0.91 g/cc) |
| Material of cap and inner stopper | LDPE (density: 0.91 g/cc) | LDPE (density: 0.91 g/cc)/NY/ LDPE (density: 0.91 g/cc) |
| Oxygen permeability (ml/m$^2$ · day · atm (20° C., 65%)) | 80 | 0.9 |
| Thickness of the vessel body (mm) | 0.7 | 0.6 |
| Surface area of the vessel body (cm$^2$) | 1,900 | 1,940 |

The present invention is applicable to any photographic materials. Preferred examples of silver halide emulsions and other substances (additives or the like) for use in the present invention, photographic constitutional layers (arrangement of the layers or the like), and processing methods for processing the photographic materials and additives for processing are disclosed in the patent publications described below, and those disclosed in European Patent EP 0,355,660A2 (corresponding to JP-A-2-139544) are particularly preferably used.

TABLE 8

| Photographic Constitutional Element | JP-A-62-215272 | JP-A-2-33144 | EP 0,355,660A2 |
|---|---|---|---|
| Silver Halide Emulsion | p. 10, right upper column, l 6 to p. 12, left lower column, l. 5, p. 12, right lower column, 4 line up from the bottom to p. 13, left upper column, l. 17 | p. 28, right upper column, l. 16 to p. 29, right lower column, l. 11 p. 30, ll. 2 to 5 | p. 45, l 53 to p. 47, l. 3 p. 47, ll. 20 to 22 |
| Silver Halide Solvent | p. 12, left lower column, ll. 6 to 14 p. 13, left upper column, 3 line up from the bottom to p. 18, left lower column, last line | — | — |
| Chemical Sensitizer | p. 12, left lower column, 3 line up from the bottom to right lower column, 5 line up from the bottom p. 18, right lower column, l. 1 to p. 22, right upper column, 9 line up from the bottom | p. 29, right lower column, l. 12 to last line | p. 47, ll. 4 to 9 |
| Spectral Sensitizer (spectral sensitizing method) | p. 22, right upper column, 8 line up from the bottom to p. 38, last line | p. 30, left upper column, ll. 1 to 13 | p. 47, ll. 10 to 15 |
| Emulsion Stabilizer | p. 39, left upper column, l. 1 to p. 72, right upper column, last line | p. 30, left upper column, l. 14 to right upper column, l. 1 | p. 47, ll. 16 to 19 |
| Development Accelerator | p. 72, left lower column, l. 1 to p. 91, right upper column, l. 3 | — | — |

TABLE 9

| Photographic Constitutional Element | JP-A-62-215272 | JP-A-2-33144 | EP 0,355,660A2 |
|---|---|---|---|
| Color Coupler (cyan, magenta, yellow) | p. 91, right upper column, l. 4 to p. 121, left upper column, l. 6 | p. 3, right upper column, l. 14 to p. 18, left upper column, last line p. 30, right upper column, l. 6 to p. 35, right lower column, l. 11 | p. 4, ll. 15 to 27 p. 5, l. 30 to p. 28, last line p. 45, ll. 29 to 31 p. 47, l. 23 to p. 63 l. 50 |
| Supersensitizer | p. 121, left upper column, l. 7 to p. 125, right upper column, l. 1 | — | — |
| UV Absorbing Agent | p. 125, right upper column, l. 2 to p. 127, left lower column, last line | p. 37, right lower column, l. 14 to p. 38, left upper column, l. 11 | p. 65, pp. 22 to 31 |
| Discoloration Inhibitor (image stabilizing agent) | p. 127, right lower column, l. 1 to p. 137, left lower column, l. 8 | p. 36, right upper column, l. 12 to p. 37, left upper column, l. 19 | p. 4, l. 30 to p. 5, l. 23 p. 29, l. 1 to p. 45, l. 25 p. 45, ll. 33 to 40 p. 65, ll. 2 to 21 |
| High Boiling Point and/or Low Boiling Point Organic Solvent | p. 137, left lower column, l. 9 to p. 144, right upper column, last line | p. 35, right lower column, l. 14 to p. 36, left upper column, 4 line up from the bottom | p. 64, ll. 1 to 51 |
| Dispersing Method of Photographic Additives | p. 144, left lower column, l. 1 to p. 146, right upper | p. 27, right lower column, l. 10 to p. 28, left upper | p. 63, l. 51 to p. 64, l. 56 |

TABLE 9-continued

| Photographic Constitutional Element | JP-A-62-215272 | JP-A-2-33144 | EP 0,355,660A2 |
|---|---|---|---|
| | column, l. 7 | column, last line<br>p. 35, right lower column, l. 12 to p. 36, right upper column, l. 7 | |

TABLE 10

| Photographic Constitutional Element | JP-A-62-215272 | JP-A-2-33144 | EP 0,355,660A2 |
|---|---|---|---|
| Stain Inhibitor | p. 188, right lower column, l. 9 to p. 193, right lower column, l. 10 | p. 37, left upper column, last line to right lower column, l. 13 | p. 65, l. 32 to p. 66, l. 17 |
| Surfactant | p. 201, left lower column, l. 1 to p. 210, right upper column, last line | p. 18, right upper column, l. 1 to p. 24, right lower column, last line<br>p. 27, left lower column, 10 line up from the bottom to right lower column, l. 9 | — |
| Fluorine-Containing Compound (as anti-static agent, coating aid, lubricant, adhesion preventive agent) | p. 210, left lower column, l. 1 to p. 222, left lower column, l. 5 | p. 25, left upper column, l. 1 to p. 27, right lower column, l. 9 | — |
| Binder (hydrophilic colloid) | p. 222, left lower column, l. 6 to p. 225, left upper column, last line | p. 38, right upper column, ll. 8 to 18 | p. 66, ll. 23 to 28 |
| Thickener | p. 225, right upper column, l. 1 to p. 227, right upper column, l. 2 | — | — |
| Antistatic Agent | p. 227, right upper column, l. 3 to p. 230, left upper column, l. 1 | — | — |

TABLE 11

| Photographic Constitutional Element | JP-A-62-215272 | JP-A-2-33144 | EP 0,355,660A2 |
|---|---|---|---|
| Hardening Agent | p. 146, right upper column, l. 8 to p. 155, left lower column, l. 4 | — | — |
| Developing Agent Precursor | p. 155, left lower column, l. 5 to p. 155, right lower column, l. 2 | — | — |
| DIR Compound | p. 155, right lower column, ll. 3 to 9 | — | — |
| Support | p. 155, right lower column, l. 19 to p. 156, left upper column, l. 14 | p. 38, right upper column, l. 18, to p. 39, left upper column, l. 3 | p. 66, l. 29 to p. 67, l. 13 |
| Layer Composition of Photographic Material | p. 156, left upper column, l. 15 to p. 156, right lower column, l. 14 | p. 28, right upper column, ll. 1 to 15 | p. 45, ll. 41 to 52 |
| Dye | p. 156, right lower column, l. 15 to p. 184, right lower column, last line | p. 38, left upper column, l. 12 to right upper column, l. 7 | p. 66, ll. 18 to 22 |
| Color Mixture Inhibitor | p. 185, left upper column, l. 1 to p. 188, right lower column, l. 3 | p. 36, right upper column, ll. 8 to 11 | p. 64, l. 57 to p. 65, l. 1 |
| Gradation Controlling Agent | p. 188, right lower column, ll. 4 to 8 | — | — |

TABLE 12

| Photographic Constitutional Element | JP-A-62-215272 | JP-A-2-33144 | EP 0,355,660A2 |
|---|---|---|---|
| Polymer Latex | p. 230, left upper column, l. 2 to p. 239, last line | — | — |
| Matting Agent | p. 240, left upper column, l. 1 to p. 240, right upper column, last line | — | — |
| Photographic Processing Method (processing step and additives) | p. 3, right upper column, l. 7 to p. 10, right upper column, l. 5 | p. 39, left upper column, l. 4 to p. 42, left upper column, last line | p. 67, l. 14 to p. 69, l. 28 |

Note)
References in column JP-A-62-215272 include contents amended by The Amendment dated March 16, 1987, which appears at the end of the Patent Publication.
Of couplers described above, so-called short wave type yellow couplers disclosed in JP-A-63-231451, JP-A-63-123047, JP-A-63-241547, JP-A-1-173499, JP-A-1-213648 and JP-A-1-250944 are preferably used as yellow couplers.

The use of pyrazolotriazole type magenta couplers is particularly preferred as a magenta coupler. Specific examples of the preferred pyrazolotriazole type magenta couplers are shown below.

M-1
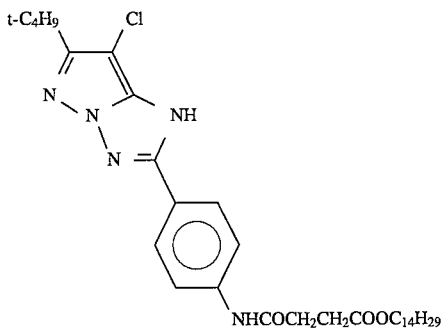
M-2
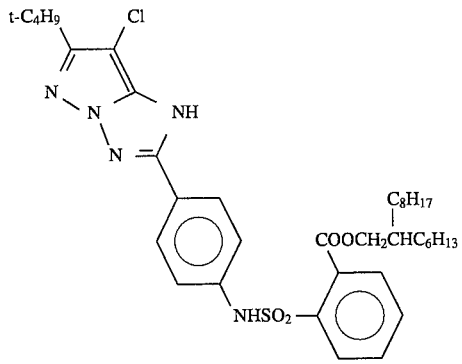
M-3
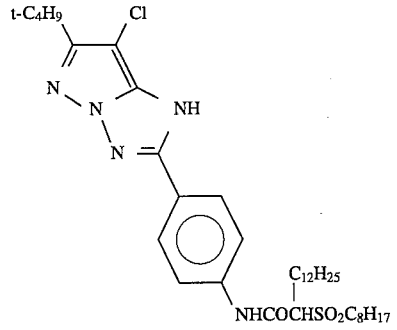
M-4
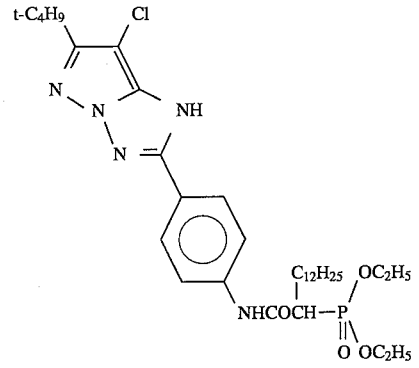

-continued
M-5
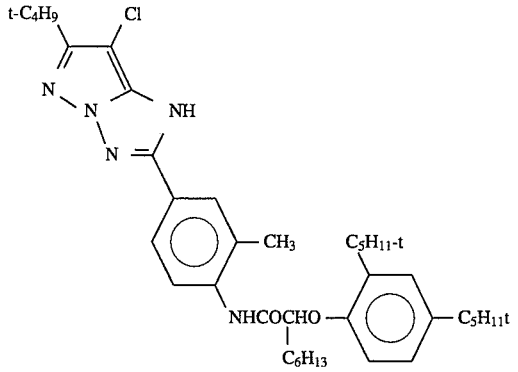
M-6
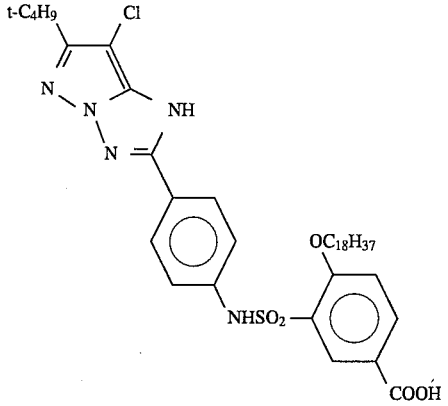
M-7
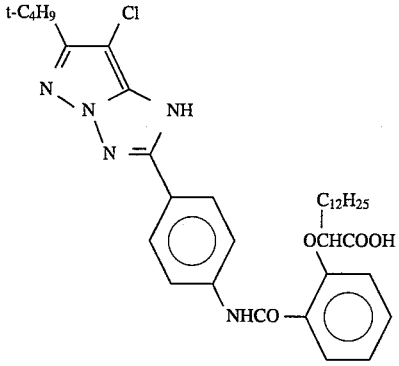
M-8
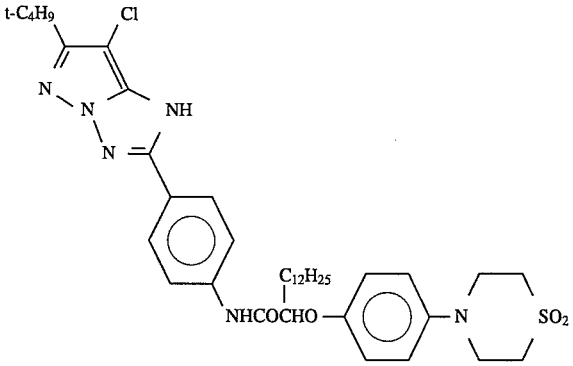

-continued
M-9
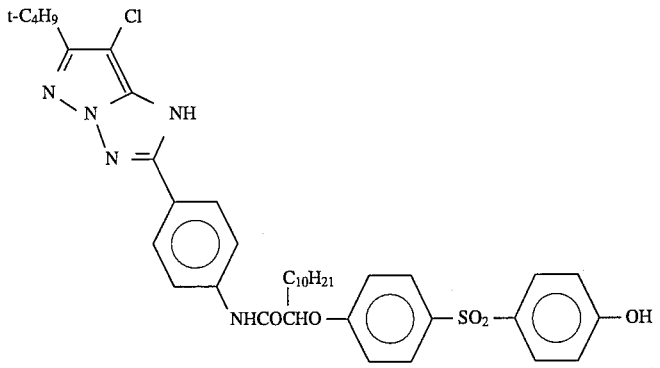
M-10
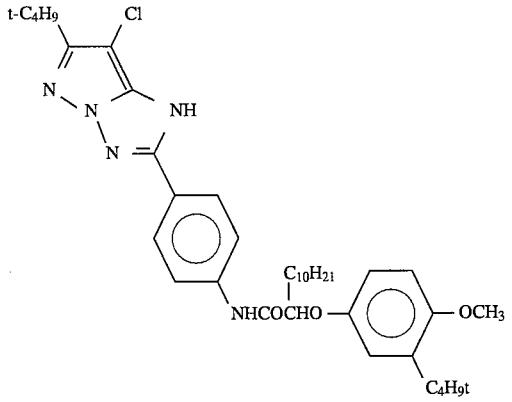
M-11
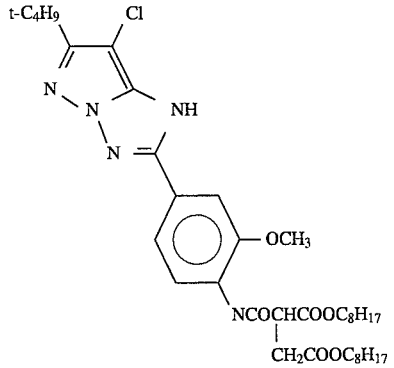
M-12
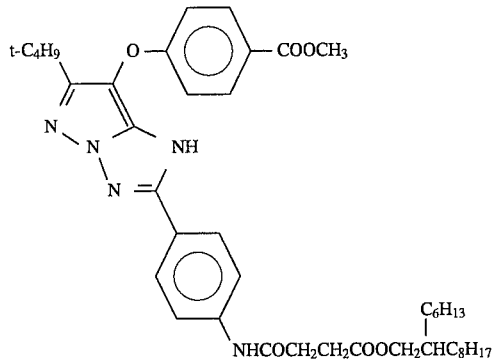

-continued
M-13
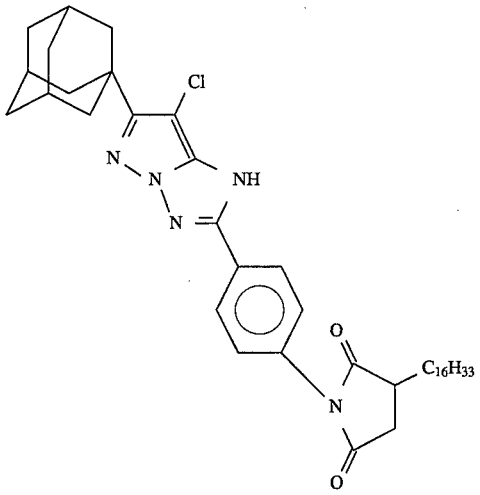
M-14
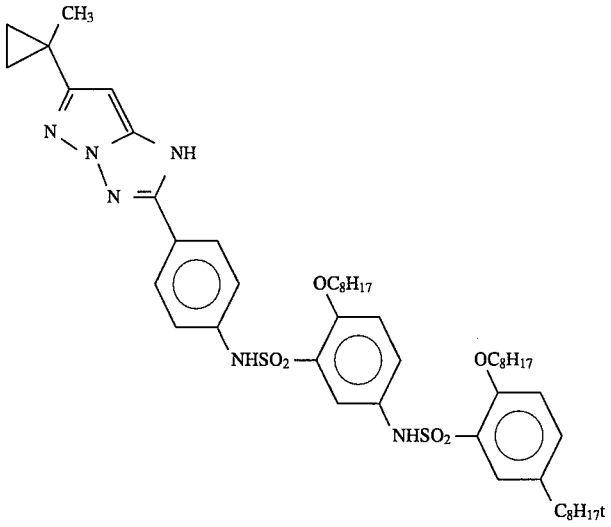
M-15
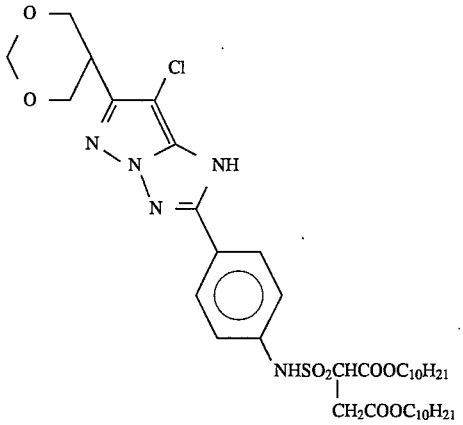

-continued

M-16

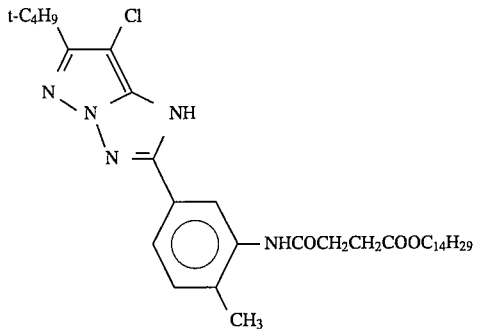

In addition to the diphenylimidazole based cyan couplers disclosed in JP-A-2-33144, the use of 3-hydroxypyridine based cyan couplers disclosed in EP 0,333,185A2 (above all, Coupler (42), a 4-equivalent coupler is rendered 2-equivalent by having a chlorine releasing group, and Couplers (6) and (9), cited as specific examples, are particularly preferred) and the cyclic active methylene based cyan couplers disclosed in JP-A-64-32260 (above all, Couplers 3, 8 and 34 cited as specific examples are particularly preferred) is also preferred as cyan couplers.

The silver halide for use in the present invention includes silver chloride, silver bromide, silver chlorobromide, silver iodochlorobromide and silver iodobromide. However, silver chlorobromide having a silver chloride content of 90 mol % or more, preferably 95% mol % or more, and more preferably 98 mol % or more, and substantially not containing silver iodide is preferably used for the purpose of rapid processing. As photographic materials which are used in the method of the present invention, it is particularly preferred for high silver chloride type color photographic material for print (e.g., color paper).

Further, it is preferred for the hydrophilic colloid layer of the photographic material of the present invention to contain a dye capable of decoloring by processing (especially oxonol dyes), disclosed in EP 0,337,490A2, pp. 27 to 76, so as to make the optical reflection density at 680 nm of the photographic material become 0.70 or more, or for the water resistant resin layer of the support to contain 12 wt % or more (more preferably 14 wt % or more) of a titanium oxide surface treated with divalent to tetravalent alcohols (for example, trimethylol ethane or the like), for the purpose of improving sharpness of images.

Further, it is preferred to use the color image storability improving compounds as disclosed in EP 0,277,589A2 together with the couplers in the photographic material of the present invention. In particular, use in combination with pyrazoloazole couplers is preferred.

That is, compound (F) which produces a chemically inert and substantially colorless compound by chemical bonding with the aromatic amine based developing agent remaining after color development processing and/or compound (G) which produces a chemically inert and substantially colorless compound by chemical bonding with the oxidation product of the aromatic amine based color developing agent remaining after color development processing are used in combination or individually to effectively prevent generation of stains during storage after processing which is due to formation of a dye by the reaction of a coupler with a color developing agent or its oxidation product remaining in the film, and to prevent other side reactions.

It is preferred for the photographic material for use in the present invention to contain bactericides as disclosed in JP-A-63-271247 to prevent propagation of various bacteria and mold in a hydrophilic colloid layer which deteriorate color images.

It is particularly preferred for the photographic layer of the silver halide color photographic material of the present invention to have the degree of swelling of from 1.1 to 3.0 from the viewpoint of improving the adhesive property of the color photographic material after processing.

The degree of swelling in the present invention means the value obtained by dividing the film thickness of the photographic layer after the color photographic material is immersed in distilled water at 33° C. for 2 minutes by the dry film thickness of the photographic layer. The degree of swelling is more preferably from 1.3 to 2.7. The dry film thickness of the photographic layer is preferably from 5 to 25 μm and more preferably from 7 to 20 μm.

Further, herein, the photographic layer means laminated hydrophilic colloid group layer containing at least one light-sensitive silver halide emulsion layer and hydrophilic colloid layers are in water permeable relationship with this silver halide emulsion layer each other. The backing layer provided on the other side of the photographic light-sensitive layer side of the support is not included in the photographic layer. The photographic layer comprises a plurality of layers concerning formation of photographic images and includes an interlayer, a filter layer, an anti-halation layer and a protective layer besides the silver halide emulsion layer.

Any methods can be used to control the degree of swelling within the range of the present invention, for example, it can be controlled by changing the amount and the kind of gelatin for use in the photographic film, the amount and the kind of hardening agent, or changing the drying conditions of the photographic layer after coating or aging conditions. The use of gelatin is preferred for the photographic layer, but other hydrophilic colloids can also be used. For example, gelatin derivatives, graft polymers of gelatin with other high molecular weight compounds, proteins such as albumin and casein, cellulose derivatives such as hydroxyethyl cellulose, carboxymethyl cellulose and cellulose sulfate, sugar derivatives such as sodium alginate and starch derivatives, and various synthetic hydrophilic polymer materials such as polyvinyl alcohol, partially acetalated polyvinyl alcohol, poly-N-vinylpyrrolidone, polyacrylic acid, polymethacrylic acid, polyacrylamide, polyvinylimidazole and polyvinylpyrazole, either as homopolymers or copolymers, can be used.

Acid-processed gelatin can be used as well as lime-processed gelatin, and gelatin hydrolysis products and enzymatic decomposition products of gelatin can also be used. Those which can be obtained by reacting gelatin with, for example, acid halide, acid anhydride, isocyanates, bromoacetic acid, alkanesultones, vinylsulfonamides, maleinimide compounds, polyalkylene oxides, and epoxy compounds can be used as gelatin derivatives.

Those grafted gelatin with homopolymers or copolymers of vinyl monomers such as acrylic acid, methacrylic acid, derivatives thereof such as esters and amides, acrylonitrile, and styrene can be used as graft polymers of gelatin. In particular, graft polymers with polymers compatible with gelatin in a certain degree, e.g., acrylic acid, methacrylic acid, acrylamide, methacrylamide, and hydroxyacrylmethacrylate are preferred. Examples thereof are disclosed in U.S. Pat. Nos. 2,763,625, 2,831,767 and 2,956,884. Representative synthetic hydrophilic high molecular weight compounds are disclosed, for example, in German Patent Application (OLS) No. 2,312,708, U.S. Pat. Nos. 3,620,751, 3,879,205 and JP-B-43-7561.

The following compounds can be used alone or in combination as a hardening agent, for example, chromium salts (chrome alum and chromium acetate), aldehydes (formaldehyde, glyoxal, glutaraldehyde), N-methylol compounds (dimethylolurea, methyloldimethylhydantoin), dioxane derivatives (2,3-dihydroxydioxane), active vinyl compounds (1,3,5-triacryloylhexahydro-s-triazine, bis(vinylsulfonyl)methyl ether, N,N'-methylenebis[β-(vinylsulfonyl-)propionamide]), active halogen compounds (2,4-dichloro-6-hydroxy-s-triazine), mucohalogenic acids (mucochloric acid, mucophenoxychloric acid), isooxazoles, dialdehyde starches, 2-chloro-6-hydroxytriazinylated gelatin.

Particularly preferred hardening agents are aldehydes, active vinyl compounds and active halogen compounds.

Further, the film swelling rate $T_{1/2}$ of the photographic material of the present invention is preferably 20 seconds or less, and more preferably 10 seconds or less. $T_{1/2}$ is defined as the time to reach ½ of the saturated film thickness, taking 90% of the maximum swollen film thickness reached when being processed at 38° C. for 3 min and 15 sec in a color developing solution as the saturated film thickness.

In addition, a white polyester type support, or a support having a layer containing a white pigment provided on the same side as a silver halide emulsion layer side of the support may be used in the photographic material of the present invention for a display. Further, it is preferred to provide an antihalation layer on the same side as the silver halide emulsion layer side of the support or on the back surface thereof for improving sharpness. The transmission density of the support is preferably set in the range of from 0.35 to 0.8 so as to enjoy a display in either of reflected light or transmitted light.

The photographic material of the present invention may be exposed by either visible light or infrared light. An exposure may be either of a low intensity exposure or a high intensity short time exposure, and in the latter case, a laser scanning exposure, whose exposure time per one picture element is shorter than $10^{-4}$ sec. is preferred.

Moreover, it is preferred to use a band-stop filter disclosed in U.S. Pat. No. 4,880,726, by which the color stain by light is prevented and the color reproduction is extremely improved.

EXAMPLE

The present invention is described in detail with reference to the examples, but it should not be construed as being limited thereto.

Example 1

3.3 g of sodium chloride was added to a 3% aqueous solution of lime-processed gelatin, then 3.2 ml of N,N'-dimethylimidazolidine- 2-thione (a 1% aqueous solution) was added thereto. After the pH of this solution was adjusted to 3.5, an aqueous solution containing 0.2 mol of silver nitrate and an aqueous solution containing 0.12 mol of sodium chloride and 0.8 mol of potassium bromide were added to the solution with vigorous stirring at 52° C., and mixed. Subsequently, an aqueous solution containing 0.8 mol of silver nitrate and an aqueous solution containing 0.48 mol of sodium chloride, 0.32 mol of potassium bromide and 0.02 mg of potassium hexachloroiridate(IV) were added to the solution with vigorous stirring at 52° C., and mixed. After maintaining the temperature at 52° C. for 5 minutes, the reaction product was subjected to desalting and washing, and 90.0 g of lime-processed gelatin was further added thereto. The pH of the obtained emulsion was adjusted to 6.5, Spectral Sensitizing Dye R-1 was added to the emulsion at 54° C., and further sodium thiosulfate and chloroauric acid were added to conduct spectral sensitization, sulfur sensitization and gold sensitization. 150 mg of 1-(3-methylureidophenyl)-5-mercaptotetrazole was added to the emulsion at the time of termination of chemical sensitization for the purpose of stabilization and prevention of fogging. Further, 2.6 g of Compound R-2 was added. The thus obtained silver chlorobromide emulsion (average grain size: 0.53 μm, a cubic grain having a grain size distribution variation coefficient of 8%, silver bromide: 40 mol %) was designated Emulsion 101.

Emulsion 102 was prepared in the same manner as the preparation of Emulsion 101, but the temperature at the time of grain formation was changed to obtain an average grain size of 0.45 μm, and the spectral sensitizing dye that was added before chemical sensitization was replaced with Spectral Sensitizing Dye G-1. The thus obtained silver chlorobromide emulsion (average grain size: 0.45 μm, a cubic grain having a grain size distribution variation coefficient of 8%, silver bromide: 40 mol %) was designated Emulsion 102. In this case, the addition amount of potassium hexachloroiridate(IV) was 0.032 mg, the addition amount of 1-(3-methylureidophenyl)-5-mercaptotetrazole was 180 mg, and Compound R-2 was not added.

Further, an emulsion was prepared in the same manner as the preparation of Emulsion 101, but the temperature at the time of grain formation was changed to obtain an average grain size of 0.86 μm, and the spectral sensitizing dye that was added before chemical sensitization was replaced with Spectral Sensitizing Dye B-1. The thus obtained silver chlorobromide emulsion (average grain size: 0.86 μm, a cubic grain having a grain size distribution variation coefficient of 7%, silver bromide: 40 mol %) was designated Emulsion 103. In this case, the addition amount of potassium hexachloroiridate(IV) was 0.006 mg, the addition amount of 1-(3-methylureidophenyl)-5-mercaptotetrazole was 90 mg, and Compound R-2 was not added.

Spectral sensitizing dyes that were used in each emulsion were as follows.

Spectral Sensitizing Dye R-1
1/1 mixture (by mol ratio) of
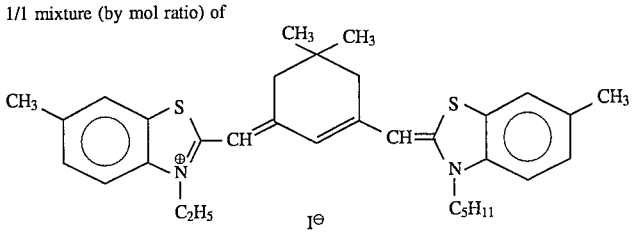
and
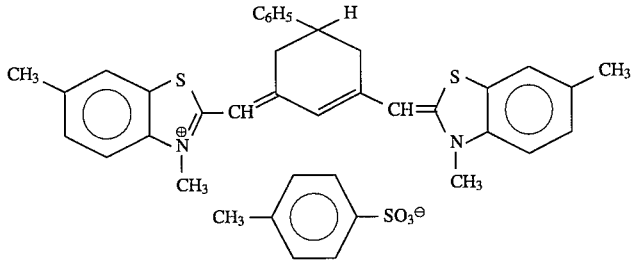
($1.5 \times 10^{-5}$ mol per mol of silver halide)
Compound R-2
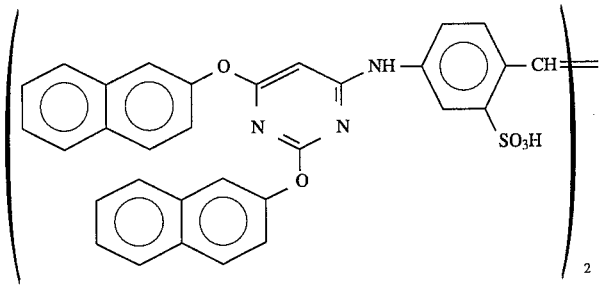
Spectral Sensitizing Dye G-1
6/1/3 (by mol ratio) of
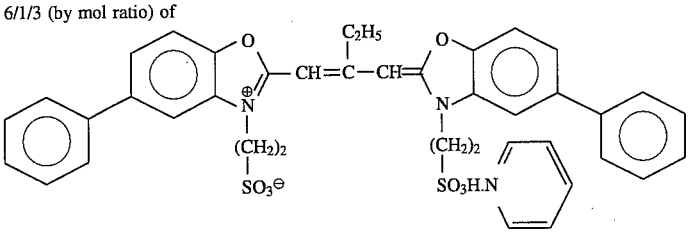
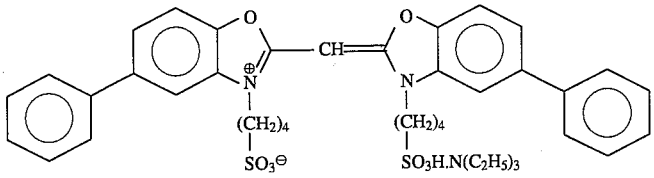
and
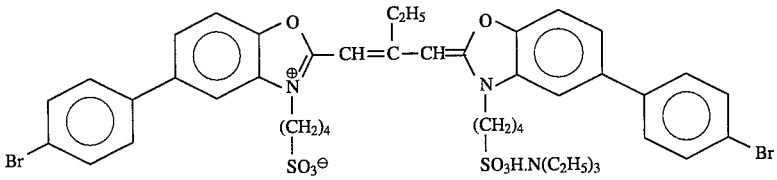
($4.0 \times 10^{-4}$ mol per mol of silver halide)

-continued

Spectral Sensitizing Dye B-1

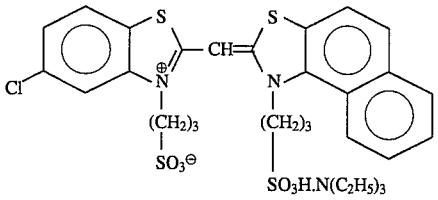

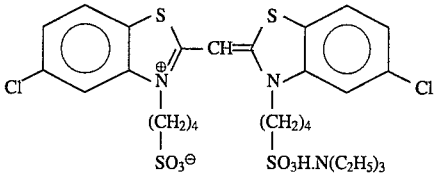

and

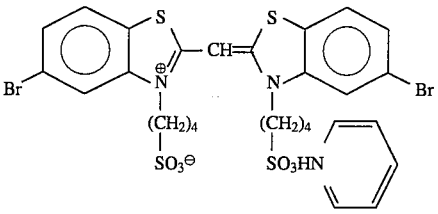

(6.0 × $10^{-4}$ mol per mol of silver halide)

A multilayer color photographic material was prepared using these emulsions. A coating solution was prepared as follows.

Preparation of Coating Solution for First Layer 122.0 g of a yellow coupler (ExY), 15.4 g of a color image stabilizer (Cpd-1), 7.5 g of a color image stabilizer (Cpd-2), 16.7 g of a color image stabilizer (Cpd-3) were dissolved in 44 g of a solvent (Solv-1) and 180 cc of ethyl acetate, and this solution was mixed to 1,000 g of a 10% aqueous gelatin solution containing 86 cc of 10% sodium dodecylbenzenesulfonate and dispersed in an emulsified condition with vigorously stirring using a homogenizer to obtain Emulsified Dispersion A. This Emulsified Dispersion A was mixed with the foregoing Emulsion 103 and dissolved, and the amount of gelatin was adjusted to obtain a coating solution for the first layer having the composition described below. The coating amount of the emulsion was calculated in terms of silver.

The coating solutions for from the second to seventh layers were prepared in the same manner as the coating solution for the first layer. 1-Oxo-3,5-dichloro-s-triazine sodium salt was used as a gelatin hardening agent in each layer.

Further, Cpd-12, Cpd-13, Cpd-14 and Cpd-15 were added to each layer so that the total coating amount becomes 15 mg/$m^2$, 60 mg/$m^2$, 5 mg/$m^2$ and 10 mg/$m^2$, respectively. Further, 1-(5-methylureidophenyl)-5-mercaptotetrazole was added to the second, fourth, sixth and seventh layers so as to provide a coating amount of 0.15 mg/$m^2$, 0.15 mg/$m^2$, 0.6 mg/$m^2$ and 0.1 mg/$m^2$, respectively.

In addition, 4-hydroxy-6-methyl-1,3,3a,7-tetraazaindene was added to the first and third layers in an amount of $1\times10^{-4}$ mol and $2\times10^{-4}$ mol, respectively, per mol of silver halide.

Moreover, the following water-soluble dyes were added to emulsion layers for preventing irradiation (the numerals in parentheses represent the coating amount).

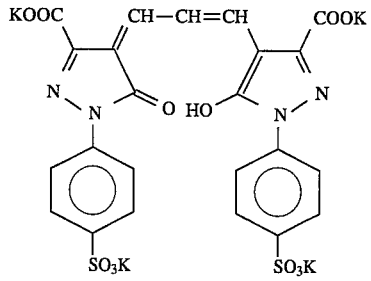

(10 mg/$m^2$)

and

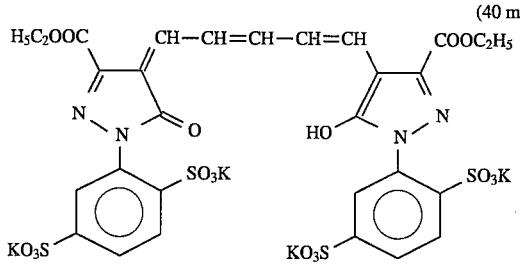

(40 mg/$m^2$)

The surface of a paper support laminated on both sides with polyethylene (the laminated layer on the emulsion coating side comprised two layers of an upper layer having a thickness of 17 μm containing 19% of $TiO_2$ and a trace amount of ultramarine and a lower layer having a thickness of 10 μm not containing $TiO_2$) was corona discharged. The support was provided with a subbing layer containing sodium dodecylbenzenesulfonate, and further, the above coating solutions were multilayer coated to have the following composition and a multilayer color photographic paper Sample 101 was prepared.

Layer Composition

The composition of each layer is described below. The numeral represents the coating amount g/m$^2$. The numeral for the silver halide emulsion represents the coating amount in terms of silver.

Support:

Polyethylene-laminated paper (a white pigment ($TiO_2$) and a blue dye (ultramarine) were added to the polyethylene of the first layer side).

| | |
|---|---|
| First Layer (blue-sensitive emulsion layer) | |
| Silver Chlorobromide Emulsion 103 described above | 0.30 |
| Gelatin | 1.33 |
| Yellow Coupler (ExY) | 0.76 |
| Color Image Stabilizer (Cpd-1) | 0.10 |
| Color Image Stabilizer (Cpd-2) | 0.05 |
| Color Image Stabilizer (Cpd-3) | 0.10 |
| Solvent (Solv-1) | 0.28 |
| Second Layer (color mixture inhibiting layer) | |
| Gelatin | 1.09 |
| Color Mixture Inhibitor (Cpd-4) | 0.11 |
| Solvent (Solv-1) | 0.07 |
| Solvent (Solv-2) | 0.25 |
| Solvent (Solv-3) | 0.19 |
| Solvent (Solv-7) | 0.09 |
| Third Layer (green-sensitive emulsion layer) | |
| Silver Chlorobromide Emulsion 102 described above | 0.15 |
| Gelatin | 1.19 |
| Magenta Coupler (ExM) | 0.15 |
| UV Absorbing Agent (UV-1) | 0.15 |
| Color Image Stabilizer (Cpd-2) | 0.013 |
| Color Image Stabilizer (Cpd-5) | 0.013 |
| Color Image Stabilizer (Cpd-6) | 0.013 |
| Color Image Stabilizer (Cpd-7) | 0.10 |
| Color Image Stabilizer (Cpd-8) | 0.013 |
| Solvent (Solv-4) | 0.38 |
| Solvent (Solv-5) | 0.19 |
| Fourth Layer (color mixture inhibiting layer) | |
| Gelatin | 0.77 |
| Color Mixture Inhibitor (Cpd-4) | 0.08 |
| Solvent (Solv-1) | 0.05 |
| Solvent (Solv-2) | 0.18 |
| Solvent (Solv-3) | 0.14 |
| Solvent (Solv-7) | 0.06 |
| Fifth Layer (red-sensitive emulsion layer) | |
| Silver Chlorobromide Emulsion 101 described above | 0.25 |
| Gelatin | 1.00 |
| Cyan Coupler (ExC) | 0.35 |
| UV Absorbing Agent (UV-3) | 0.24 |
| Color Image Stabilizer (Cpd-1) | 0.30 |
| Color Image Stabilizer (Cpd-6) | 0.013 |
| Color Image Stabilizer (Cpd-8) | 0.013 |
| Color Image Stabilizer (Cpd-9) | 0.05 |
| Color Image Stabilizer (Cpd-10) | 0.013 |
| Solvent (Solv-1) | 0.013 |
| Solvent (Solv-6) | 0.26 |
| Sixth Layer (UV absorbing layer) | |
| Gelatin | 0.64 |
| UV Absorbing Agent (UV-2) | 0.39 |
| Color Image Stabilizer (Cpd-7) | 0.05 |
| Solvent (Solv-8) | 0.05 |
| Seventh Layer (protective layer) | |
| Gelatin | 0.98 |
| Acryl-Modified Copolymer of Polyvinyl Alcohol (modification degree: 17%) | 0.04 |
| Liquid Paraffin | 0.01 |
| Surfactant (Cpd-11) | 0.01 |

(ExY) Yellow Coupler
1/1 mixture (by mol ratio) of
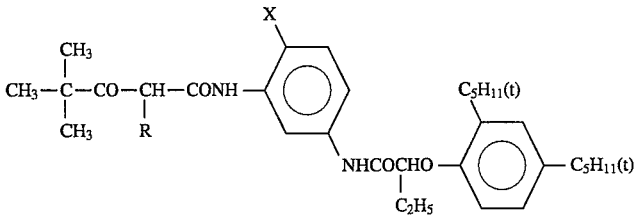
R = 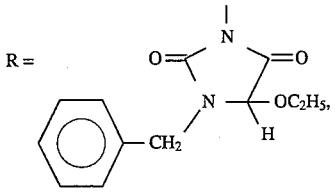 X = Cl and R = 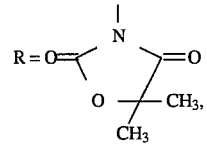 X = $OCH_3$
(ExM) Magenta Coupler
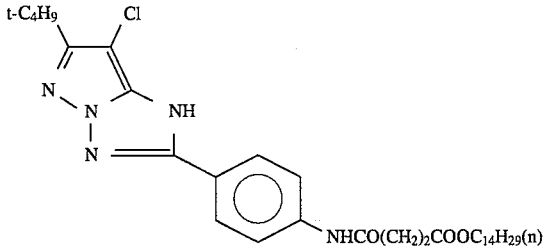
(ExC) Cyan Coupler
25/75 mixture (by mol ratio) of
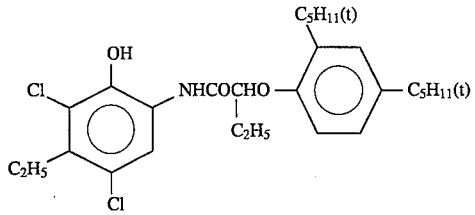
and
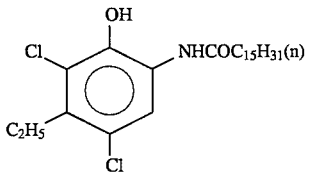
(Cpd-1) Color Image Stabilizer
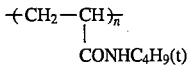
number average molecular weight: 60,000
(Cpd-2) Color Image Stabilizer
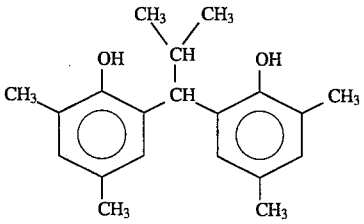
(Cpd-3) Color Image Stabilizer
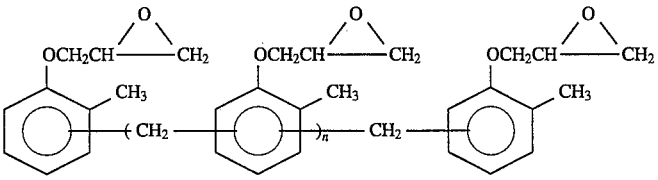
n = 7–8 (average value)

(Cpd-4) Color Mixture Inhibitor
1/1/1 mixture (by weight ratio) of
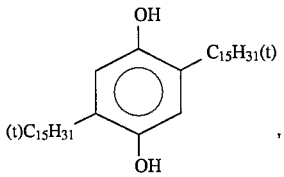
,
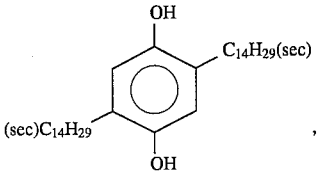
, and
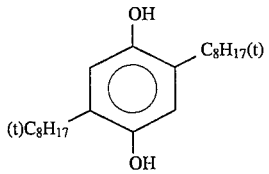
(Cpd-5) Color Image Stabilizer
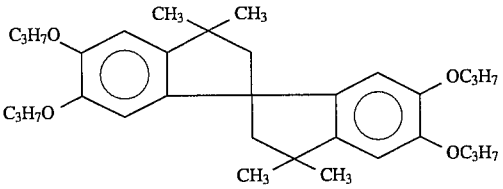
(Cpd-6) Color Image Stabilizer
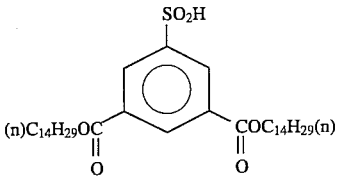
(Cpd-7) Color Image Stabilizer
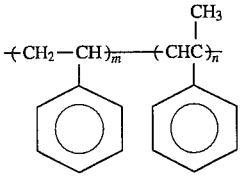
number average molecular weight: 600
m/n = 10/90
(Cpd-8) Color Image Stabilizer
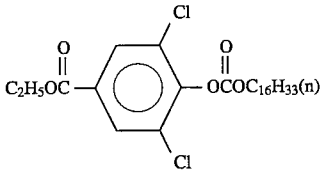
(Cpd-9) Color Image Stabilizer
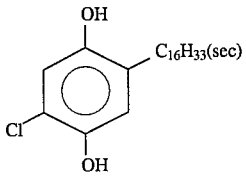
(Cpd-10) Color Image Stabilizer
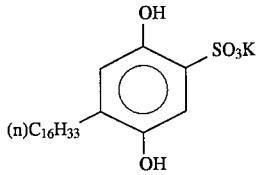
(Cpd-11) Surfactant
7/3 mixture (by weight ratio) of
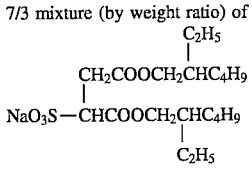
and
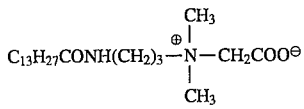
(Cpd-12) Preservative
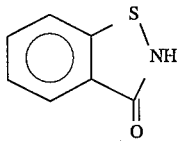

-continued
(Cpd-13) Preservative
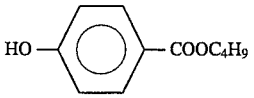
(Cpd-14) Preservative
1/1/1/1 mixture (by weight ratio) of a/b/c/d
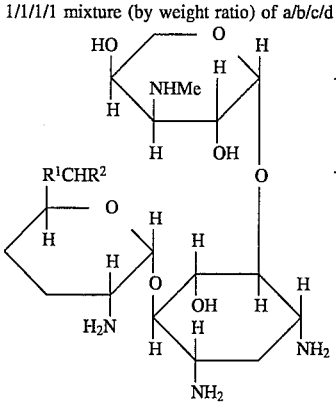
| | $R^1$ | $R^2$ |
|---|---|---|
| a | —Me | —NHMe |
| b | —Me | —$NH_2$ |
| c | —H | —$NH_2$ |
| d | —H | —NHMe |
(Cpd-15) Preservative
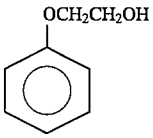
(UV-1) UV Absorbing Agent
1/3/4 mixture (by weight ratio) of
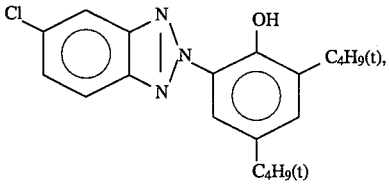
and
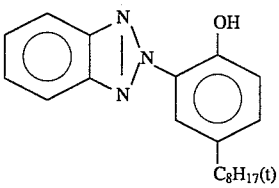
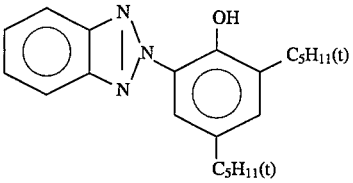
(UV-2) UV Absorbing Agent
1/2/2/3/1 mixture (by weight ratio) of
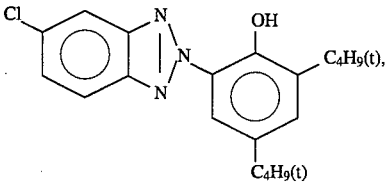
,
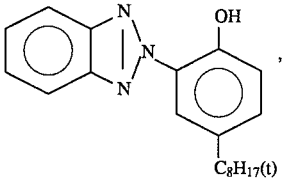
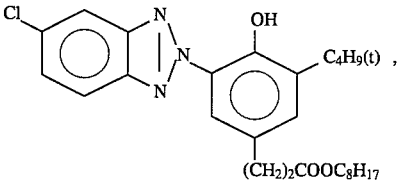
,
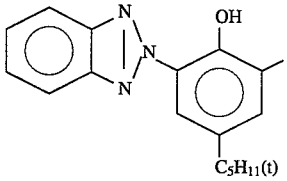
and -continued

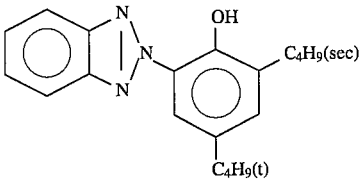

(UV-3) UV Absorbing Agent

1/3/2/1 mixture (by weight ratio) of

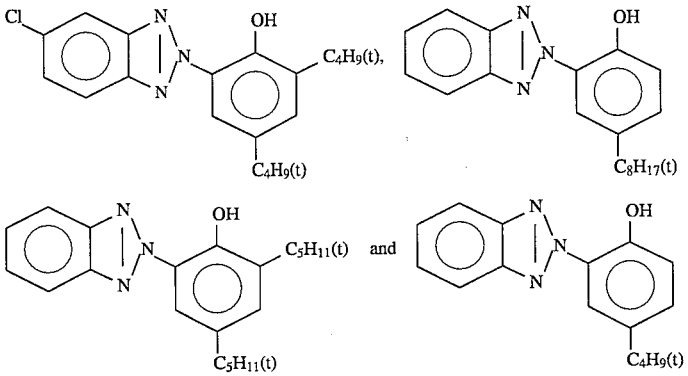

(Solv-1) Solvent $C_8H_{17}CH(O)CH(CH_2)_7COOC_8H_{17}$ (Solv-2) Solvent

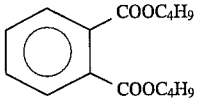

(Solv-3) Solvent

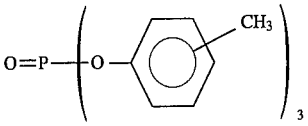

(Solv-4) Solvent $O{=}P{-}(O{-}C_6H_{13}(n))_3$ (Solv-5) Solvent $(COOC_4H_{19})_2(CH_2)_8$ (Solv-6) Solvent

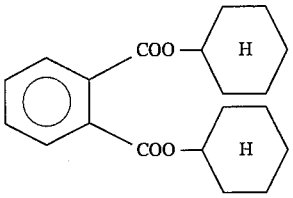

(Solv-7) Solvent

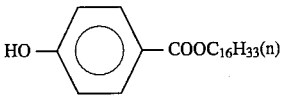

(Solv-8) Solvent $(COOC_8H_{17})_2(CH_2)_8$

The imagewise exposed above sample was continuously processed (running test) according to the following processing step until the bleach-fixing solution replenisher amount reached 2.5 times the tank capacity using a color photographic paper processor (the aperture ratio of the color developing solution: 0.005 $cm^{-1}$, the carryover of the color developing solution by the photographic material: 30 $ml/m^2$, traveling speed: 1,000 mm/min). The replenishing amount and the composition of the bleach-fixing solution replenisher in the running test were adjusted as shown in Table 13 below.

| | Processing Step | | | |
|---|---|---|---|---|
| Step | Processing Temperature (°C.) | Processing Time (sec) | Replenishment Rate* (ml) | Tank Capacity (liter) |
| Color Development | 40.0 | 45 | 45 | 5 |
| Bleach-Fixing | 35 | 45 | shown in Table 13 | 5 |

-continued

| Step | Processing Temperature (°C.) | Processing Time (sec) | Replenishment Rate* (ml) | Tank Capacity (liter) |
|---|---|---|---|---|
| | Processing Step | | | |
| Rinsing (1) | 35 | 20 | — | 2 |
| Rinsing (2) | 35 | 20 | — | 2 |
| Rinsing (3)** | 35 | 20 | — | 2 |
| Rinsing (4)** | 35 | 30 | 90 | 3 |

Rinsing was conducted in a 4-tank countercurrent system from rinsing (4) to (1).

*Replenishment rate per $m^2$ of the photographic material

**Reverse osmosis membrane module RC-30, a product of Fuji Photo Film Co., Ltd., was installed in rinsing tank (3), the solution in tank (3) was removed, and the removed solution was supplied to RC-30 by a pump. The permeated water obtained by this apparatus was supplied to rinsing tank (4) and the concentrated solution was returned to rinsing tank (3). The pressure of the pump was controlled to maintain the permeation rate of the solution by this reverse osmosis membrane module of from 200 to 300 ml/min and was operated for 10 hours a day.

The composition of each processing solution used is described below.

| | Tank Solution | Replenisher |
|---|---|---|
| Color Developing Solution | | |
| Cation Exchange Water | 800 ml | 800 ml |
| Compound A (shown below) | 0.10 g | 0.10 g |
| Triethanolamine | 14.5 g | 14.5 g |
| Potassium Hydroxide | 3.0 g | 10.0 g |
| Ethylenediaminetetraacetic Acid | 4.0 g | 4.0 g |
| Sodium 4,5-dihydroxybenzene-1,3-disulfonate | 0.5 g | 0.5 g |
| Potassium Chloride | 14.0 g | — |
| Potassium Bromide | 0.04 g | 0.01 g |
| Brightening Agent (SR-13) | 2.5 g | 4.5 g |
| Sodium Sulfite | 0.1 g | 0.2 g |
| Disodium-N,N-bis(sulfonato-ethyl)hydroxylamine | 8.5 g | 11.1 g |
| N-Ethyl-N-(β-methanesulfon-amidoethyl)-3-methyl-4-amino-4-aminoaniline·3/2 Sulfate·Monohydrate | 5.0 g | 15.7 g |
| Potassium Carbonate | 26.3 g | 26.3 g |
| Water to make | 1,000 ml | 1,000 ml |
| pH (25° C., adjusted with KOH or sulfuric acid) | 10.15 | 12.45 |

Compound A

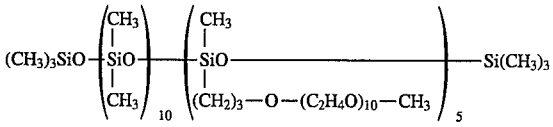

| | Tank Solution | Replenisher |
|---|---|---|
| Bleach-Fixing Solution | | |
| Water | 700 ml | 600 ml |
| Ammonium Thiosulfate (750 g/liter) | 100 ml | 215 ml |
| Ammonium Sulfite | 35.0 g | 90.0 g |
| Ammonium Ethylenediamine-tetraacetato Ferrate | 43.0 g | 90.0 g |
| Compound of formula (α) (shown in Table 13) | 0.2 mol | 0.43 mol |
| Compound (S-6) | 7.7 g | 16.5 g |
| Water to make | 1,000 ml | shown in Table 13 |
| pH (25° C., adjusted with nitric acid or aqueous ammonia) | 7.00 | shown in Table 13 |
| Rinsing Solution (the tank solution and the replenisher are the same) | | |
| Sodium Chlorinated Isocyanurate | | 0.02 g |
| Demineralized water (electric conductivity: 5 μs/cm or less) | | 1,000 ml |
| pH | | 6.5 |

After the termination of the running test, the above coated samples were processed and whiteness was compared.

With respect to the comparison of whiteness, after the reflectance spectrum of the unexposed part of the processed sample was measured using a spectrophotometer, the sample was washed again with a hot water of 35° C. for 5 minutes, and after drying, the reflectance spectrum of the same spot was measured again. The whiteness was evaluated by the difference in absorbance at 450 nm between before and after washing. Specifically, the difference within the range of from 0.000 to 0.005 means no practical problem, the difference within the range of from 0.005 to 0.02 means a level in which if a coloring component is decomposed by light and like and the whiteness is changed, the difference of colors of photographs is appreciable (the flesh tint, especially the human faces), and 0.02 or more is a level in which coloring after processing is apparent and if a coloring component is decomposed and the hue of the color changes, the human face appears blue to cyan color, and this is not good.

The results obtained are shown in Table 13.

TABLE 13

| No. | Amount of Bleach-Fixing Replenisher (ml) | Bleach-Fixing Replenisher: Amount of Finished Solution (ml) | Bleach-Fixing Replenisher: pH | Compound of Formula (α) | Difference in Absorbance at 450 nm | Remarks |
|---|---|---|---|---|---|---|
| 1 | 220 | 1,640 | 6.50 | None | 0.005 | Comparison |
| 2 | 180 | 1,600 | 6.40 | None | 0.021 | Comparison |
| 3 | 80 | 1,350 | 6.20 | None | 0.033 | Comparison |
| 4 | 35 | 1,000 | 6.00 | None | 0.046 | Comparison |
| 5 | 220 | 1,640 | 6.50 | Imidazole | 0.009 | Comparison |
| 6 | 180 | 1,600 | 6.40 | Imidazole | 0.005 | Invention |
| 7 | 80 | 1,350 | 6.20 | Imidazole | 0.003 | Invention |
| 8 | 35 | 1,000 | 6.00 | Imidazole | 0.000 | Invention |
| 9 | 80 | 1,350 | 6.20 | 1-Methyl-imidazole | 0.003 | Invention |
| 10 | 35 | 1,000 | 6.00 | 1-Methyl-imidazole | 0.001 | Invention |
| 11 | 35 | 1,000 | 6.00 | 2-Methyl-imidazole | 0.003 | Invention |

As can be seen from the above table, when the replenishing amount of the bleach-fixing solution is reduced, those which do not contain imidazole compounds deteriorate whiteness, on the contrary, those which contain imidazole compounds improve whiteness.

Example 2

Running test was conducted in the same manner as in Example 1 except for using Fuji Color Paper FAV (Lot 942-406, glossy area), manufactured by Fuji Photo Film Co., Ltd. and Fuji Mini Labo Paper Printer Processor PP1250V, manufactured by Fuji Photo Film Co., Ltd.

The processing steps and the compositions of the processing solutions are shown below.

| Step | Processing Step: Processing Temperature (°C.) | Processing Time (sec) | Replenishment Rate* (ml) |
|---|---|---|---|
| Color Development | 40 | 45 | 45 |
| Bleach-Fixing | 38 | 45 | 35 |
| Rinsing (1) | 38 | 20 | — |
| Rinsing (2) | 38 | 20 | — |
| Rinsing (3)** | 38 | 20 | — |
| Rinsing (4)** | 38 | 30 | 90 |

Rinsing was conducted in a 4-tank countercurrent system from rinsing (4) to (1).

*Replenishment rate per $m^2$ of the photographic material

**Reverse osmosis membrane module RC-30, a product of Fuji Photo Film Co., Ltd., was installed in rinsing tank (3), the solution in tank (3) was removed, and the removed solution was supplied to RC-30 by a pump. The permeated water obtained by this apparatus was supplied to rinsing tank (4) and the concentrated solution was returned to rinsing tank (3).

The pressure of the pump was controlled to maintain the permeation rate of the solution by this reverse osmosis membrane module of from 200 to 300 ml/min and was operated for 10 hours a day.

| | Tank Solution | Replenisher |
|---|---|---|
| Color Developing Solution | | |
| Cation Exchange Water | 800 ml | 800 ml |

-continued

| | Tank Solution | Replenisher |
|---|---|---|
| Compound A (shown above) | 0.10 g | 0.10 g |
| Triethanolamine | 14.5 g | 14.5 g |
| Potassium Hydroxide | 3.0 g | 10.0 g |
| Ethylenediaminetetraacetic Acid | 4.0 g | 4.0 g |
| Sodium 4,5-dihydroxybenzene-1,3-disulfonate | 0.5 g | 0.5 g |
| Potassium Chloride | 14.0 g | — |
| Potassium Bromide | 0.04 g | 0.01 g |
| Brightening Agent (shown in Table 14) | 2.5 g | 4.5 g |
| Sodium Sulfite | 0.1 g | 0.2 g |
| Disodium-N,N-bis(sulfonato-ethyl)hydroxylamine | 8.5 g | 11.1 g |
| N-Ethyl-N-(β-methanesulfon-amidoethyl)-3-methyl-4-amino-4-aminoaniline.3/2 Sulfate. Monohydrate | 5.0 g | 15.7 g |
| Potassium Carbonate | 26.3 g | 26.3 g |
| Water to make | 1,000 ml | 1,000 ml |
| pH (25° C., adjusted with KOH or sulfuric acid) | 10.15 | 12.45 |
| Bleach-Fixing Solution | | |
| Water | 700 ml | 600 ml |
| Ammonium Thiosulfate (750 g/liter) | 100 ml | 215 ml |
| Ammonium Sulfite | 35.0 g | 90.0 g |
| Ammonium Ethylenediamine-tetraacetato Ferrate | 43.0 g | 180.0 g |
| Imidazole | 0.2 mol | 0.43 mol |
| Compound of formula (S) (shown in Table 14) | 40 mmol | 90 mmol |
| Water to make | 1,000 ml | 1,000 ml |
| pH (25° C., adjusted with nitric acid or aqueous ammonia) | 7.00 | 6.00 |
| Rinsing Solution | | |
| (the tank solution and the replenisher are the same) | | |
| Sodium Chlorinated Isocyanurate | 0.02 g | |
| Demineralized Water (electric conductivity: 5 μs/cm or less) | 1,000 ml | |
| pH | 6.5 | |

The color developing solution replenisher and the bleach-fixing solution replenisher were each put in the flexible vessel for a processing solution having bellows part described in the present specification and each solution was prepared as follows.

Color Developing Solution Replenisher:

Content volume: 2,500 ml, Vessel D

Bleach-Fixing Solution Replenisher:

Content volume: 2,500 ml, Vessel C

After completion of the running test, the above samples were processed and whiteness was determined in the same manner as in Example 1.

Further, the sample was exposed so as to provide a cyan color density of 2.0 and processed. After the sample had been put under a temperature of 100° C. for 3 weeks, cyan color density was measured using an X-rite densitometer and compared the change from the density of 2.0. The results obtained are shown in Table 14.

TABLE 14

| No. | Brightening Agent | Compound of Formula (S) | Difference in Absorbance at 450 nm | Cyan Color Density after 3 Week Aging |
|---|---|---|---|---|
| 1 | None | None | 0.009 | 1.90 |
| 2 | SR-13 | None | 0.005 | 1.95 |
| 3 | SR-17 | None | 0.004 | 1.95 |
| 4 | None | S-7 | 0.004 | 1.94 |
| 5 | None | S-6 | 0.003 | 1.95 |
| 6 | SR-13 | S-7 | 0.000 | 1.99 |
| 7 | SR-7 | S-7 | 0.000 | 1.98 |
| 8 | SR-13 | S-6 | 0.001 | 1.98 |

As is apparent from the above table, the use of triazinyl-4,4-diaminostilbene based brightening agents in the color developing solution and sulfinic acid compounds represented by formula (S) in the bleach-fixing solution in the present invention remarkably improves whiteness.

Further, according to the present invention the color image stability of a cyan dye can also be effectively improved.

Example 3

Running test was conducted in the same manner as in Example 2 using the same coating sample prepared in Example 1 and Fuji Mini Labo Paper Printer Processor PP1250V, manufactured by Fuji Photo Film Co., Ltd.

| | Processing Step | | |
|---|---|---|---|
| Step | Processing Temperature (°C.) | Processing Time (sec) | Replenishment Rate* (ml) |
| Color Development | 40 | 45 | 40 |
| Bleach-Fixing | 40 | 45 | 35 |
| Rinsing (1) | 40 | 20 | — |
| Rinsing (2) | 40 | 20 | — |
| Rinsing (3) | 40 | 20 | — |
| Rinsing (4) | 40 | 20 | 150 |

*Replenishment rate per $m^2$ of the photographic material

Color Developing Solution

The same solution as used in Example 1.

| Bleach-Fixing Solution | |
|---|---|
| Part A | |
| Water | 250 ml |
| Ammonium Ethylenediamine-tetraacetato Ferrate | 0.23 mol |
| Compound (S-7) | 0.18 mol |
| Water to make | 500 ml |
| pH (25° C., adjusted with nitric acid or aqueous ammonia) | 6.0 |
| Part B | |
| Water | 100 ml |
| Ammonium Thiosulfate (750 g/liter) | 210 ml |
| Ammonium Sulfite | 90 g |
| Imidazole | 0.2 mol |
| Water to make | 500 ml |
| pH (25° C., adjusted with nitric acid or aqueous ammonia) | 6.0 |
| Replenisher | |
| 500 ml of Part A and 500 ml of Bart B | |
| Tank Solution | |
| 500 ml of water and 500 ml of replenisher pH was adjusted to 7.00 with nitric acid or aqueous ammonia. | |
| Rinsing Solution | |
| (the tank solution and the replenisher are the same) | |
| Sodium Chlorinated Isocyanurate | 0.2 g |
| Demineralized Water (electric conductivity: 5 μs/cm or less) | 1,000 ml |
| pH | 6.5 |

The above color developing tank solution, color developing solution replenisher, bleach-fixing solutions Part A and Part B were each put in the flexible vessel for a processing solution having bellows part described in the present specification and each solution was prepared as follows.

Color Developing Tank Solution:

Content volume: 2,500 ml, Vessel D

Color Developing Solution Replenisher:

Content volume: 2,500 ml, Vessel D

Bleach-Fixing Solution Replenisher Part A:

Content volume: 2,000 ml, Vessel C

Bleach-Fixing Solution Replenisher Part B:

Content volume: 2,000 ml, Vessel C

The bleach-fixing solution replenisher was prepared in a manner such that Part A was added to the replenishing tank at first and then Part B was added without stirring. Part A and Part B were homogeneously mixed without stirring.

The imagewise exposed above coating sample was continuously processed according to the above processing step until the bleach-fixing solution replenisher amount reached 2 times the tank capacity using the above printer processor.

Further, the above printer processor was modified so that vessels for Part A and Part B of the bleach-fixing solution replenisher themselves could be installed in the processor. In this case, the replenishment rates of Part A and Part B were each 17.5 ml per $m^2$ of the photographic material and the same running test was conducted.

After the termination of the running test, evaluation of whiteness was conducted in the same manner as in Example 1 using the sample prepared in Example 1. The result was that in both cases when the bleach-fixing solutions were previously mixed and replenished and when they were separately replenished, the change in absorbance at 450 nm after rewashing was 0.001 or less.

Example 4

Running test was conducted in the same manner as Experiment No. 8 of Example 1 except that ammonium ethylenediaminetetraacetato ferrate, the bleaching agent, in the bleach-fixing solution and the bleach-fixing solution replenisher was replaced with ferric ammonium salt of Compound E-1 ([S.S] isomer) in the present specification in the same concentration and ethylenediaminetetraacetic acid was replaced with E-1 in the present specification in the same concentration. Excellent results were obtained.

Example 5

The following first to twelfth layers were multilayer coated on a paper support having a thickness of 220 μm both surfaces of which were laminated with polyethylene. The polyethylene on the side coated with the first layer contained 15 wt % of anatase-type titanium oxide as a white pigment and a trace amount of ultramarine as a blue dye. The chromaticity of the surface of the support was L*, a*, b*, respectively, 89.0, −0.18, −0.73.

Composition of Light-Sensitive Layer:

The composition and the coating amount of each layer given in g/m$^2$ are described below. The numeral for the silver halide represents the coating amount in terms of silver.

| | |
|---|---|
| First Layer (gelatin layer) | |
| Gelatin | 0.30 |
| Second Layer (antihalation layer) | |
| Black Colloidal Silver | 0.07 |
| Gelatin | 0.50 |
| Third Layer (low sensitive red-sensitive layer) | |
| Silver chloroiodobromide spectrally sensitized with red sensitizing dyes (ExS-1, -2, -3) (silver chloride: 1 mol%, silver iodide: 4 mol%, average grain size: 0.3 μm, grain size distribution: 10%, cubic, core iodide rich type core/shell structure) | 0.06 |
| Silver iodobromide spectrally sensitized with red sensitizing dyes (ExS-1, -2, -3) (silver iodide: 4 mol%, average grain size: 0.5 μm, grain size distribution: 15%, cubic) | 0.07 |
| Gelatin | 1.00 |
| Cyan Coupler (ExC-1) | 0.07 |
| Cyan Coupler (ExC-2) | 0.07 |
| Cyan Coupler (ExC-3) | 0.07 |
| Discoloration Inhibitor (Cpd-22, -23, -24 in equal amounts) | 0.12 |
| Coupler Dispersion Medium (Cpd-26) | 0.03 |
| Coupler Solvent (Solv-11, -12, -13 in equal amounts) | 0.06 |
| Development Accelerator (Cpd-33) | 0.05 |
| Fourth Layer (high sensitive red-sensitive layer) | |
| Silver iodobromide spectrally sensitized with red sensitizing dyes (ExS-1, -2, -3) (silver iodide: 6 mol%, average grain size: 0.8 μm, grain size distribution: 20%, tabular (aspect ratio: 8, core iodide rich type)) | 0.15 |
| Gelatin | 1.00 |
| Cyan Coupler (ExC-1) | 0.10 |
| Cyan Coupler (ExC-2) | 0.10 |
| Cyan Coupler (ExC-3) | 0.10 |
| Discoloration Inhibitor (Cpd-22, -23, -24 in equal amounts) | 0.15 |
| Coupler Dispersion Medium (Cpd-26) | 0.03 |
| Coupler Solvent (Solv-11, -12, -13 in equal amounts) | 0.10 |
| Fifth Layer (interlayer) | |
| Magenta Colloidal Silver | 0.02 |
| Gelatin | 1.00 |
| Color Mixture Inhibitor (Cpd-27 and -36) | 0.08 |
| Color Mixture Inhibitor Solvent (Solv-14 and -17 in equal amounts) | 0.16 |
| Polymer Latex (Cpd-28) | 0.10 |
| Sixth Layer (low sensitive green-sensitive layer) | |
| Silver chloroiodobromide spectrally sensitized with green sensitizing dye (ExS-4) (silver chloride: mol%, silver iodide: 2.5 mol%, average grain size: 0.28 μm, grain size distribution: 8%, cubic, core iodide rich type core/shell structure) | 0.04 |
| Silver iodobromide spectrally sensitized with green sensitizing dye (ExS-4) (silver iodide: 2.5 mol%, average grain size: 0.48 μm, grain size distribution: 12%, cubic) | 0.06 |
| Gelatin | 0.80 |
| Magenta Coupler (ExM-1 and -2 in equal amounts) | 0.10 |
| Discoloration Inhibitor (Cpd-29) | 0.10 |
| Antistaining Agent (Cpd-30 and -31 in equal amounts) | 0.01 |
| Antistaining Agent (Cpd-25) | 0.001 |
| Antistaining Agent (Cpd-32) | 0.01 |
| Coupler Dispersion Medium (Cpd-26) | 0.05 |
| Coupler Solvent (Solv-14 and -16) | 0.15 |
| Seventh Layer (high sensitive green-sensitive layer) | |
| Silver iodobromide spectrally sensitized with green sensitizing dye (ExS-4) (silver iodide: 3.5 mol%, average grain size: 1.0 μm, grain size distribution: 21%, tabular (aspect ratio: 9, uniform iodide type)) | 0.10 |
| Gelatin | 0.80 |
| Magenta Coupler (ExM-1 and -2 in equal amounts) | 0.10 |
| Discoloration Inhibitor (Cpd-29) | 0.10 |
| Antistaining Agent (Cpd-30 and -31 in equal amounts) | 0.01 |
| Antistaining Agent (Cpd-25) | 0.001 |
| Antistaining Agent (Cpd-32) | 0.01 |
| Coupler Dispersion Medium (Cpd-26) | 0.05 |
| Coupler Solvent (Solv-14 and -16) | 0.15 |
| Eighth Layer (yellow filter layer) | |
| Yellow Colloidal Silver | 0.14 |
| Gelatin | 1.00 |
| Color Mixture Inhibitor (Cpd-27) | 0.06 |
| Color Mixture Inhibitor Solvent (Solv-14 and -15) | 0.15 |
| Polymer Latex (Cpd-18) | 0.10 |
| Ninth Layer (low sensitive blue-sensitive layer) | |
| Silver chloroiodobromide spectrally sensitized with blue sensitizing dyes (ExS-5 and -6) (silver chloride: 2 mol%, silver iodide: 2.5 mol%, average grain size: 0.38 μm, grain size distribution: 8%, cubic, core iodide rich type core/shell structure) | 0.07 |
| Silver iodobromide spectrally sensitized with blue sensitizing dyes (ExS-5 and -6) (silver iodide: 2.5 mol%, average grain size: 0.55 μm, grain size distribution: cubic) | 0.10 |
| Gelatin | 0.50 |
| Yellow Coupler (ExY-1, -2 and -3 in equal amounts) | 0.20 |
| Antistaining Agent (Cpd-25) | 0.001 |
| Discoloration Inhibitor (Cpd-34) | 0.10 |
| Coupler Dispersion Medium (Cpd-26) | 0.05 |
| Coupler Solvent (Solv-12) | 0.05 |
| Tenth Layer (high sensitive blue-sensitive layer) | |
| Silver iodobromide spectrally sensitized with blue sensitizing dyes (ExS-5 and -6) (silver iodide: 2.5 mol%, average grain size: 1.4 μm, grain size distribution: 21%, tabular (aspect ratio: 14)) | 0.25 |
| Gelatin | 1.00 |
| Yellow Coupler (ExY-1, -2 and -3 in equal amounts) | 0.40 |
| Antistaining Agent (Cpd-25) | 0.002 |
| Discoloration Inhibitor (Cpd-34) | 0.10 |
| Coupler Dispersion Medium (Cpd-26) | 0.15 |
| Coupler Solvent (Solv-12) | 0.10 |
| Eleventh Layer (ultraviolet absorbing layer) | |
| Gelatin | 1.50 |
| UV Absorbing Agent (Cpd-21, -22, -24 and -35 in equal amounts) | 1.00 |
| Color Mixture Inhibitor (Cpd-27 and -36) | 0.06 |
| Coupler Dispersion Medium (Cpd-26) | 0.30 |
| UV Absorbing Agent Solvent (Solv-11 and -12) | 0.15 |
| Irradiation Preventing Dye (Cpd-37 and -38) | 0.02 |
| Irradiation Preventing Dye (Cpd-39 and -40) | 0.02 |
| Twelfth Layer (protective layer) | |
| Fine Grain Silver Chlorobromide | 0.07 |

-continued

| | |
|---|---|
| (silver chloride: 97 mol%, average grain size: 0.2 μm) | |
| Modified Poval | 0.02 |
| Gelatin | 1.50 |
| Gelatin Hardening Agent (H-1 and -2 in equal amounts) | 0.17 |

Further, to each layer were added Alkanol XC (Du Pont) and sodium alkylbenzenesulfonate as an emulsion dispersing assistant, succinate and Magefac F-120 (Dainippon Ink & Chemicals, Inc.) as a coating aid, and Cpd-44, -45 and -46 as a preservative. Cpd-41, -42 and -43 were added to the layer containing silver halide or colloidal silver as a stabilizer. The compounds which were used in the example are shown below.

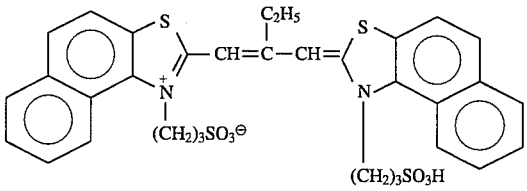
ExS-1

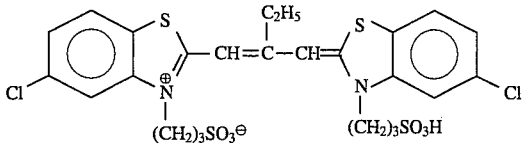
ExS-2

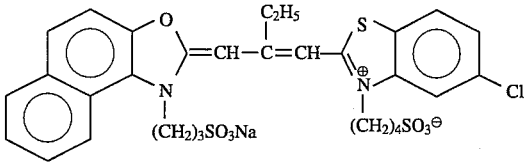
ExS-3

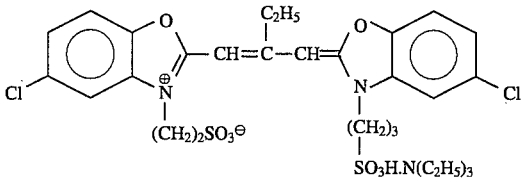
ExS-4

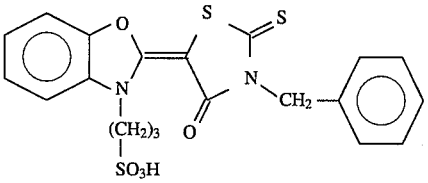
ExS-5

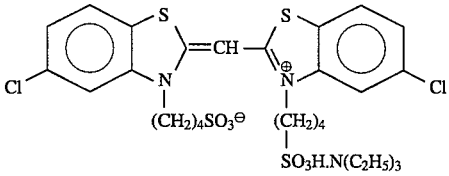
ExS-6

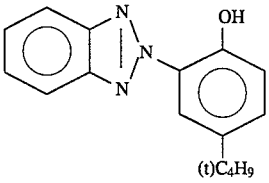
Cpd-21

-continued
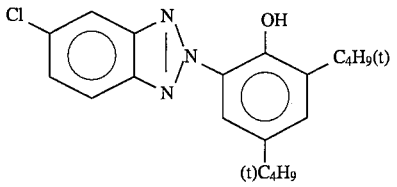
Cpd-22
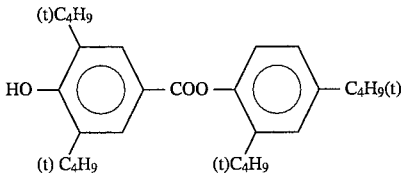
Cpd-23
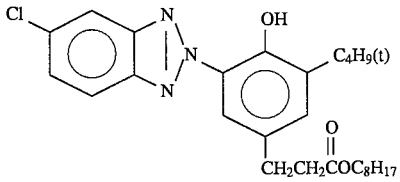
Cpd-24
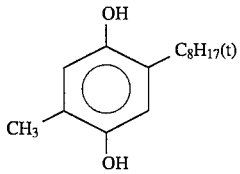
Cpd-25
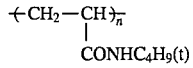
(n = 100 ~ 1000)
Cpd-26
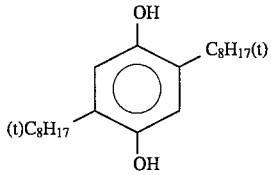
Cpd-27
Polyethyl Acrylate
(MW = 10,000 to 100,000)
Cpd-28
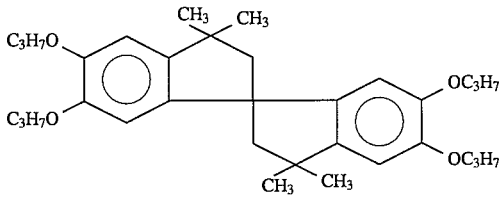
Cpd-29
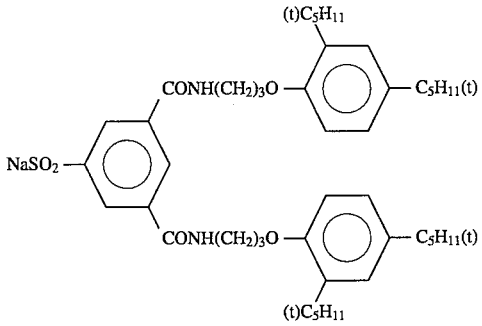
(Cpd-30

-continued
Cpd-31
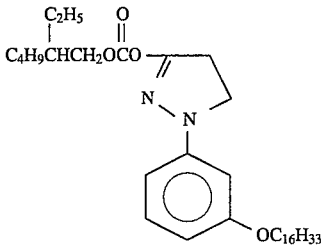
Cpd-32
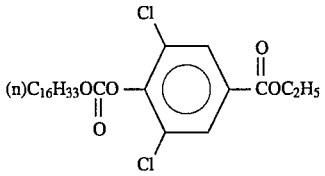
Cpd-33
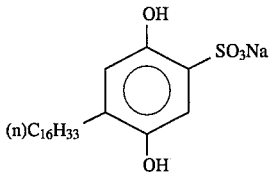
Cpd-34
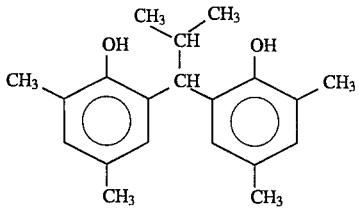
Cpd-35
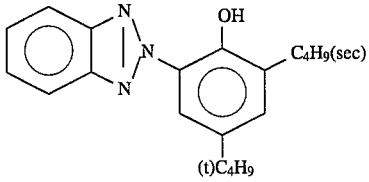
Cpd-36
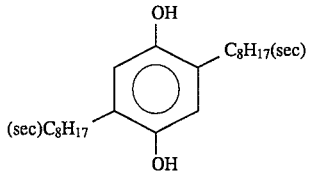
Cpd-37
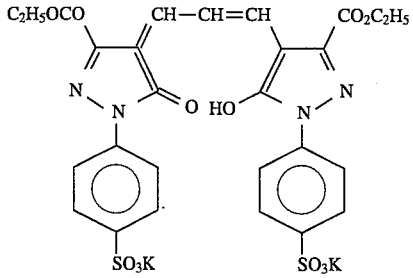
Cpd-38
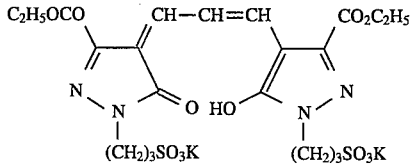

-continued
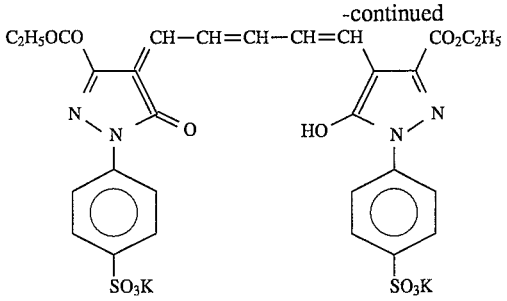
Cpd-39
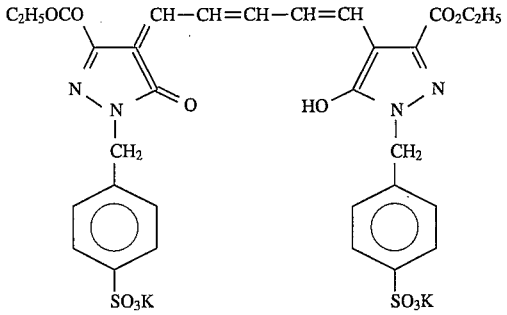
Cpd-40
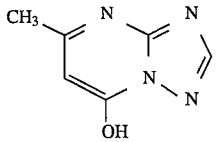
Cpd-41
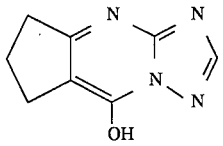
Cpd-42
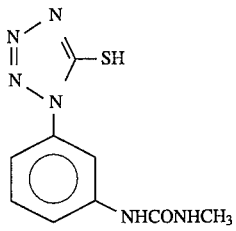
Cpd-43
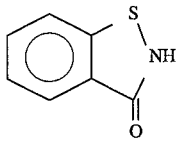
Cpd-44
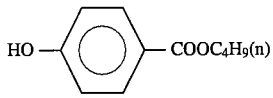
Cpd-45
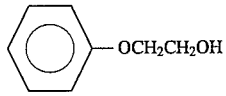
Cpd-46
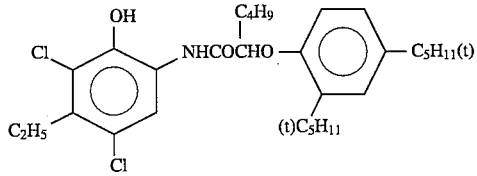
ExC-1

-continued
ExC-2
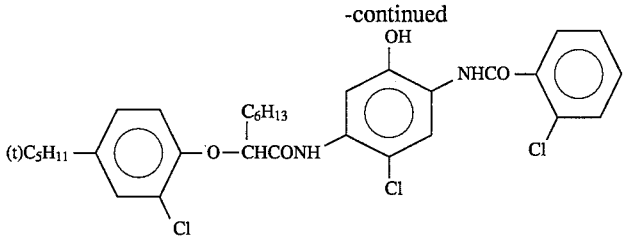
ExC-3
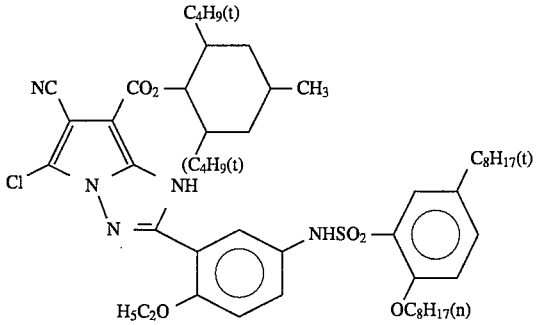
ExM-1
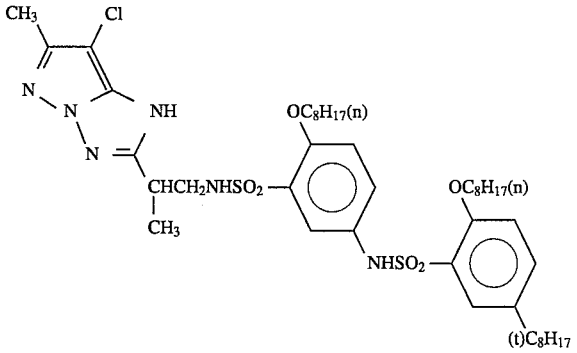
ExM-2
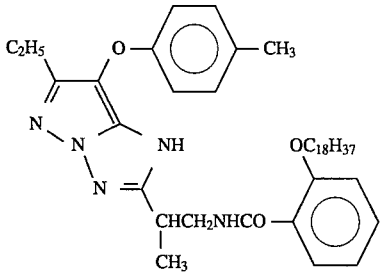
ExY-1
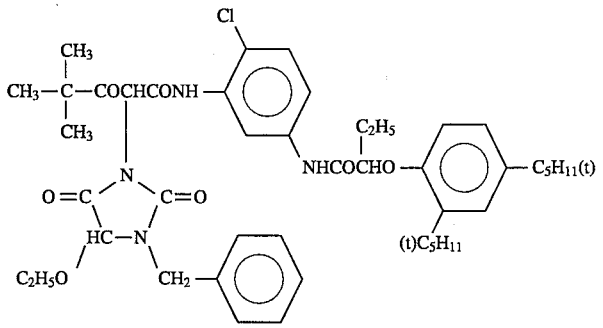

-continued

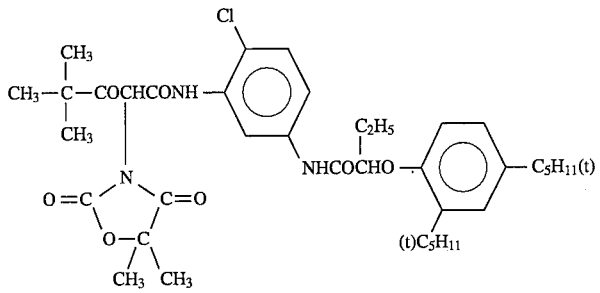

ExY-2

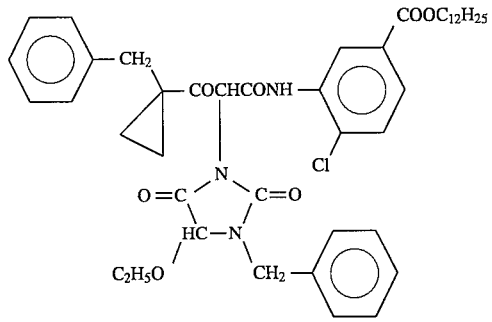

ExY-3

| | |
|---|---|
| Di(2-ethylhexyl)phthalate | Solv-11 |
| Trinonyl phosphate | Solv-12 |
| Di(3-methylhexyl)phthalate | Solv-13 |
| Tricresyl phosphate | Solv-14 |
| Dibutyl phthalate | Solv-15 |
| Trioctyl phosphate | Solv-16 |
| $C_8H_{11}CH(O)CH(CH_2)_7COOC_8H_{17}$ | Solv-17 |
| 1,2-Bis(vinylsulfonylacetamido)ethane | H-1 |
| 4,6-Dichloro-2-hydroxy-1,3,5-triazine sodium salt | H-2 |

The thus prepared silver halide photographic material was imagewise exposed and continuously processed using an automatic processor according to the following processing step using the following processing solutions until the total amount of the bleach-fixing solution replenisher reached 25 liters. The compounds represented by formula (α) in the bleach-fixing solution were changed as shown in Table 15.

| | Processing Step | | | |
|---|---|---|---|---|
| Step | Processing Time (sec) | Processing Temperature (°C.) | Tank Capacity (liter) | Replenishment Rate (ml/m²) |
| First Development | 75 | 38 | 8 | 160 |
| First Washing (1) | 45 | 33 | 5 | — |
| First Washing (2) | 45 | 33 | 5 | 500 |
| Reversal Exposure | 15 | 100 lux | | |
| Color Development | 135 | 38 | 15 | 330 |
| Second Washing | 45 | 33 | 5 | 1,000 |
| Bleach-Fixing (1) | 60 | 38 | 7 | — |
| Bleach-Fixing (2) | 60 | 38 | 7 | 110 |
| Third Washing (1) | 45 | 33 | 5 | — |
| Third Washing (2) | 45 | 33 | 5 | — |
| Third Washing (3) | 45 | 33 | 5 | 5,000 |
| Drying | 45 | 75 | | |

First washing and third washing were conducted in a counter-current system, that is, washing water was poured into the first washing tank (2) and the overflow of the first washing tank (2) was introduced to the first washing tank (1), and washing water was poured into the third washing tank (3) and the overflow of the third washing tank (3) was introduced to the third washing tank (2), and the overflow of the third washing tank (2) was introduced to the third washing tank (1).

The composition of each processing solution used is described below.

| | Tank Solution | Replenisher |
|---|---|---|
| First Developing Solution | | |
| Diethylenetriaminepentaacetic Acid.Pentasodium Salt | 6.0 g | 6.0 g |
| Potassium Sulfite | 30.0 g | 30.0 g |
| Potassium Thiocyanate | 1.2 g | 1.2 g |
| Potassium Carbonate | 35.0 g | 35.0 g |
| Potassium Hydroquinone-monosulfonate | 25.0 g | 25.0 g |
| 1-Phenyl-4-hydroxymethyl-4-methyl-3-pyrazolidone | 1.6 g | 1.6 g |
| Potassium Bromide | 4.0 g | — |

-continued

| | Tank Solution | Replenisher |
|---|---|---|
| Potassium Iodide | 6.0 mg | — |
| Water to make | 1,000 ml | 1,000 ml |
| pH (adjusted with hydrochloric acid or potassium hydroxide) | 9.65 | 9.70 |
| Color Developing Solution | | |
| Benzyl Alcohol | 15.0 ml | 15.0 ml |
| Ethylene Glycol | 12.0 ml | 14.0 ml |
| 3,6-Dithia-1,8-octanediol | 0.20 g | 0.25 g |
| Sodium 4,5-dihydroxybenzene-1,3-disulfonate | 0.5 g | 0.5 g |
| Ethylenediaminetetraacetic Acid | 2.0 g | 3.0 g |
| Sodium Sulfite | 2.0 g | 2.5 g |
| Hydroxylaminesulfate | 3.0 g | 3.6 g |
| N-Ethyl-N-(β-methanesulfonamidoethyl)-3-methyl-4-aminoaniline.3/2 Sulfate. Monohydrate | 6.0 g | 9.0 g |
| Brightening Agent (SR-13) | 1.0 g | 1.2 g |
| Potassium Bromide | 0.5 g | — |
| Potassium Iodide | 1.0 mg | — |
| Water to make | 1,000 ml | 1,000 ml |
| pH (adjusted with hydrochloric acid or potassium hydroxide) | 10.25 | 10.40 |
| Bleach-Fixing Solution | | |
| Ammonium Thiosulfate (750 g/liter) | 20 ml | 30 ml |
| Sodium Thiosulfate | 80.0 g | 115 g |
| Ethylenediaminetetraacetic Acid | 4.5 g | 7.0 g |
| Compound of formula (α) (shown in Table 15) | 0.07 mol | 1.0 mol |
| Sodium Bisulfite | 20.0 g | 30.0 g |
| 2-Mercapto-1,3,4-triazol | 0.43 g | 0.65 g |
| Compound (S-9) | 4.0 g | 5.8 g |
| Ammonium Ethylenediamine-tetraacetato Ferrate | 56.0 g | 85.0 g |
| Water to make | 1,000 ml | 1,000 ml |
| pH (adjusted with acetic acid or aqueous ammonia) | 6.70 | 6.30 |

When the above each processing was finished, the photographic material was subjected to 100 CMS white light exposure and the above processing. The density of the white portion of the photographic material after being processed was measured from the reflection density of cyan, magenta and yellow using an X-rite densitometer. The results obtained are shown in Table 15.

TABLE 15

| Compound (α) | Cyan Reflection Density | Magenta Reflection Density | Yellow Reflection Density | Remarks |
|---|---|---|---|---|
| None | 0.108 | 0.138 | 0.132 | Comparison |
| Imidazole | 0.080 | 0.111 | 0.085 | Invention |
| 1-Methyl-imidazole | 0.094 | 0.122 | 0.094 | Invention |
| 2-Methyl-imidazole | 0.088 | 0.115 | 0.090 | Invention |

As can be seen from the results in Table 15, whiteness after exposure was also apparently improved in the color reversal processing system by the use of the compounds of the present invention.

Example 6

The surface of a paper support laminated on both sides with polyethylene was corona discharged. The support was provided with a subbing layer containing sodium dodecylbenzenesulfonate, and further, the various photographic constituting layers were multilayer coated to have the following composition and a multilayer color photographic paper Sample (101) was prepared.

122.0 g of a yellow coupler (ExY-4), 15.4 g of a color image stabilizer (Cpd-51), 7.5 g of a color image stabilizer (Cpd-52), 16.7 g of a color image stabilizer (Cpd-53) were dissolved in 44 g of a solvent (Solv-21) and 180 ml of ethyl acetate, and this solution was mixed to 1,000 g of a 10% aqueous gelatin solution containing 86 ml of 10% sodium dodecylbenzenesulfonate and dispersed in an emulsified condition to obtain Emulsified Dispersion A. On the other hand, two kinds of silver chlorobromide emulsions A were prepared (cubic form, a mixture in a ratio of 3/7 (silver mol ratio) of a large grain size emulsion A having an average grain size of 0.88 μm, and a small grain size emulsion A having an average grain size of 0.70 μm; variation coefficients of the grain size distribution were 0.08 and 0.10, respectively, both of them contained 0.3 mol % of silver bromide localized at a part of the grain surface, and the remaining substrate being comprising silver chloride). The blue-sensitive Sensitizing Dyes A, B, and C shown below were added respectively in an amount of $8.0\times10^{-5}$ mol per mol of silver to the large grain size emulsion A, and $1.0\times10^{-4}$ mol per mol of silver to the small grain size emulsion A. Chemical ripening was conducted by addition of a sulfur sensitizer and a gold sensitizer. The foregoing Emulsified Dispersion A was mixed with this silver chlorobromide emulsion A and dissolved to obtain a coating solution for the first layer having the composition described below. The coating amount of the emulsion was calculated in terms of silver.

The coating solutions for from the second to seventh layers were prepared in the same manner as the coating solution for the first layer. 1-Oxo-3,5-dichloro-s-triazine sodium salt was used as a gelatin hardening agent in each layer.

Further, Cpd-62, Cpd-63, Cpd-64 and Cpd-65 were added to each layer so that the total coating amount became 15.0 mg/m$^2$, 60.0 mg/m$^2$, 5.0 mg/m$^2$ and 10.0 mg/m$^2$, respectively.

The spectral sensitizing dyes described below were used in the silver chlorobromide emulsion of each light-sensitive emulsion layer.

Blue-Sensitive Emulsion Layer:

Spectral Sensitizing Dye A

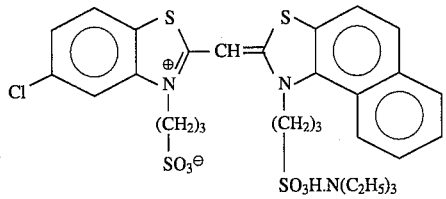

Spectral Sensitizing Dye B

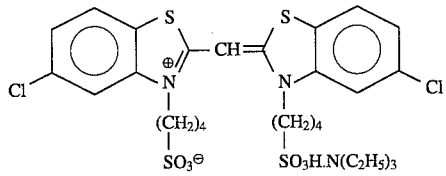

Spectral Sensitizing Dye C

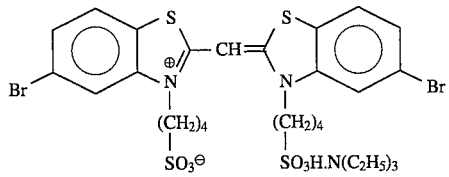

(each in an amount of $8.0 \times 10^{-5}$ mol/mol Ag to the large grain size emulsion, and each in an amount of $1.0 \times 10^{-4}$ mol/mol Ag to the small grain size emulsion)

Green-Sensitive Emulsion Layer:

Spectral Sensitizing Dye D

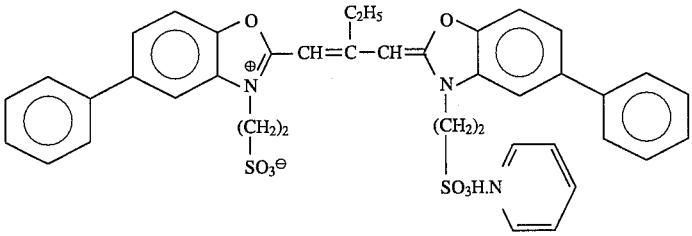

(in an amount of $3.0 \times 10^{-4}$ mol/mol Ag)

Spectral Sensitizing Dye E

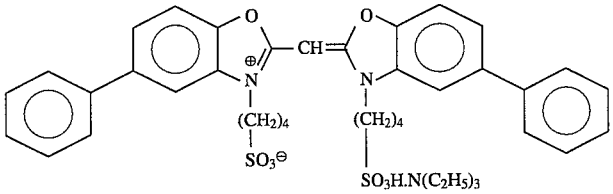

(in an amount of $4.0 \times 10^{-5}$ mol/mol Ag)

-continued

Spectral Sensitizing Dye F

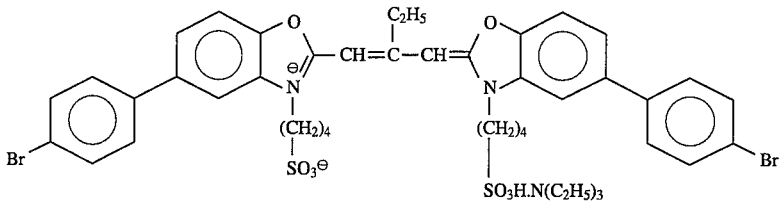

(in an amount of $2.0 \times 10^{-4}$)

Red-Sensitive Emulsion Layer:

Spectral Sensitizing Dye G

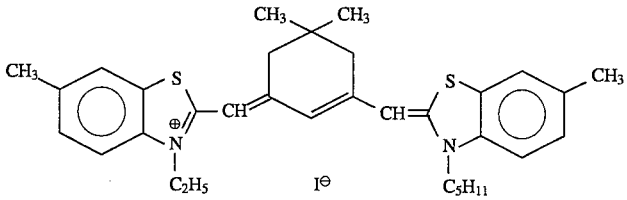

(in an amount of $5.0 \times 10^{-5}$ mol/mol Ag to the large grain size emulsion, and in an amount of $8.0 \times 10^{-5}$ mol/mol Ag to the small grain size emulsion)

Spectral Sensitizing Dye H

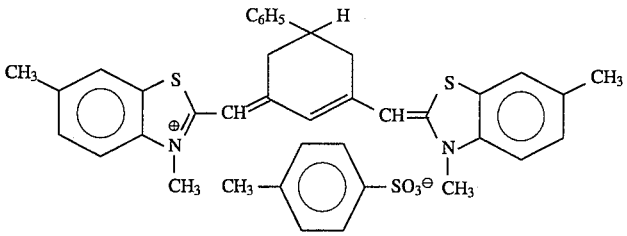

(in an amount of $5.0 \times 10^{-5}$ mol/mol Ag to the large grain size emulsion, and in an amount of $8.0 \times 10^{-5}$ mol/mol Ag to the small grain size emulsion)

The following compound was further added to the red-sensitive emulsion layer in an amount of $2.6 \times 10^{-3}$ mol per mol of silver halide.

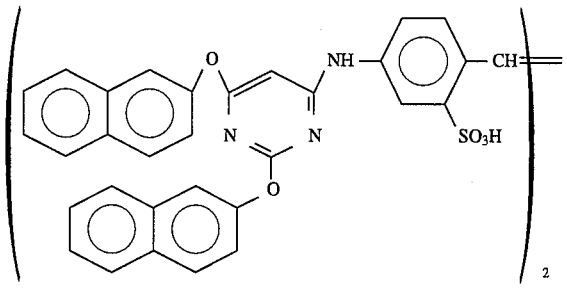

Further, 1-(5-methylureidophenyl)-5-mercaptotetrazole was added to the blue-sensitive emulsion layer, the green-sensitive emulsion layer and the red-sensitive emulsion layer in an amount of $3.3 \times 10^{-4}$ mol, $1.0 \times 10^{-3}$ mol and $5.9 \times 10^{-4}$ mol, respectively, per mol of silver halide.

Further, 1-(5-methylureidophenyl)-5-mercaptotetrazole was added to the second layer, the fourth layer, the sixth layer, and the seventh layer so that the coating amount becomes 0.2 mg/m$^2$, 0.6 mg/m$^2$, and 0.1 mg/m$^2$, respectively.

In addition, 4-hydroxy-6-methyl-1,3,3a,7-tetraazaindene was added to the blue-sensitive emulsion layer and the green-sensitive emulsion layer in an amount of $1 \times 10^{-4}$mol and $2 \times 10^{-4}$ mol, respectively, per mol of silver halide.

Moreover, the following dyes were added to the emulsion layer for preventing irradiation (the numerals in parentheses represent the coating amount).

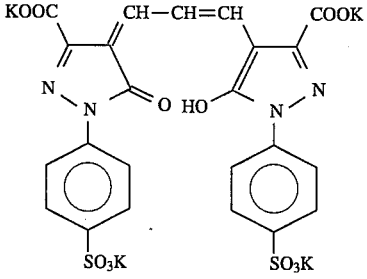

(10 mg/m$^2$)

and

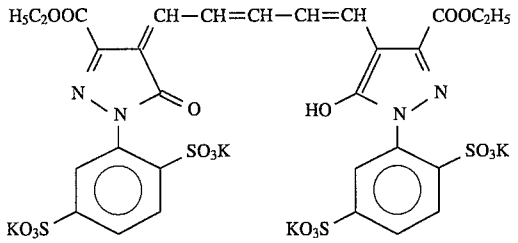

(40 mg/m²)

Layer Composition

The composition of each layer is described below. The numeral represents the coating amount (g/m²). The numeral for the silver halide emulsion represents the coating amount in terms of silver.

Support:

Polyethylene-laminated paper (a white pigment ($TiO_2$) and a blue dye (ultramarine) were added to the polyethylene of the first layer side).

| | |
|---|---|
| First Layer (blue-sensitive emulsion layer) | |
| Silver Chlorobromide Emulsion A described above | 0.24 |
| Gelatin | 1.33 |
| Yellow Coupler (ExY-4) | 0.61 |
| Color Image Stabilizer (Cpd-51) | 0.08 |
| Color Image Stabilizer (Cpd-52) | 0.04 |
| Color Image Stabilizer (Cpd-53) | 0.08 |
| Solvent (Solv-21) | 0.22 |
| Second Layer (color mixture inhibiting layer) | |
| Gelatin | 1.09 |
| Color Mixture Inhibitor (Cpd-54) | 0.11 |
| Solvent (Solv-21) | 0.07 |
| Solvent (Solv-22) | 0.25 |
| Solvent (Solv-23) | 0.19 |
| Solvent (Solv-27) | 0.09 |
| Third Layer (green-sensitive emulsion layer) | |
| Silver Chlorobromide Emulsion (cubic form, a mixture in a ratio of 3/7 (Ag mol ratio) of a large grain size emulsion B having an average grain size of 0.50 μm, and a small grain size emulsion B having an average grain size of 0.40 μm; variation coefficients of the grain size distribution are 0.08 and 0.10, respectively, both of them contained 1.0 mol% of AgBr localized at a part of the grain surface of substrate of silver chloride) | 0.11 |

| | |
|---|---|
| Gelatin | 1.19 |
| Magenta Coupler (ExM-3) | 0.12 |
| UV Absorbing Agent (UV-4) | 0.12 |
| Color Image Stabilizer (Cpd-52) | 0.01 |
| Color Image Stabilizer (Cpd-55) | 0.01 |
| Color Image Stabilizer (Cpd-56) | 0.01 |
| Color Image Stabilizer (Cpd-57) | 0.08 |
| Color Image Stabilizer (Cpd-58) | 0.01 |
| Compound (Cpd-66) | 0.0001 |
| Solvent (Solv-24) | 0.30 |
| Solvent (Solv-25) | 0.15 |
| Antifoggant (Cpd-67) | 0.001 |
| Fourth Layer (color mixture inhibiting layer) | |
| Gelatin | 0.77 |
| Color Mixture Inhibitor (Cpd-54) | 0.08 |
| Solvent (Solv-21) | 0.05 |
| Solvent (Solv-22) | 0.18 |
| Solvent (Solv-23) | 0.14 |
| Solvent (Solv-27) | 0.06 |
| Fifth Layer (red-sensitive emulsion layer) | |
| Silver Chlorobromide Emulsion (cubic form, a mixture in a ratio of 1/4 (Ag mol ratio) of a large grain size emulsion C having an average grain size of 0.54 μm, and a small grain size emulsion C having an average grain size of 0.48 μm; variation coefficients of the grain size distribution are 0.09 and 0.11, respectively, both of them contained 0.8 mol% of AgBr localized at a part of the grain surface of substrate of silver chloride) | 0.18 |
| Gelatin | 0.80 |
| Cyan Coupler (ExC-4) | 0.28 |
| UV Absorbing Agent (UV-6) | 0.19 |
| Color Image Stabilizer (Cpd-51) | 0.24 |
| Color Image Stabilizer (Cpd-56) | 0.01 |
| Color Image Stabilizer (Cpd-58) | 0.01 |
| Color Image Stabilizer (Cpd-59) | 0.04 |
| Color Image Stabilizer (Cpd-60) | 0.01 |
| Solvent (Solv-21) | 0.01 |
| Solvent (Solv-26) | 0.21 |
| Sixth Layer (UV absorbing layer) | |
| Gelatin | 0.64 |
| UV Absorbing Agent (UV-5) | 0.39 |
| Color Image Stabilizer (Cpd-57) | 0.05 |
| Solvent (Solv-28) | 0.05 |
| Seventh Layer (protective layer) | |
| Gelatin | 1.01 |
| Acryl-Modified Copolymer of Polyvinyl Alcohol (modification degree: 17%) | 0.04 |
| Liquid Paraffin | 0.02 |
| Surfactant (Cpd-61) | 0.01 |

The compounds which were used in this example are shown below.

(ExY-4) Yellow Coupler

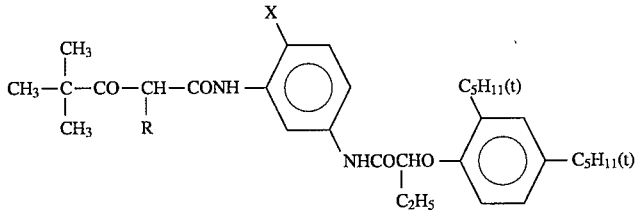

-continued
R = 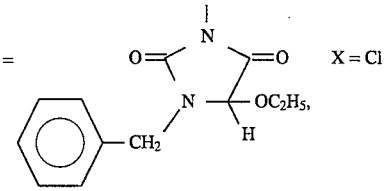
X = Cl
(ExM-3) Magenta Coupler
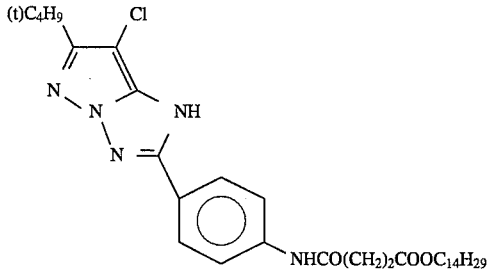
(ExC-4) Cyan Coupler
25/75 mixture (by mol ratio) of
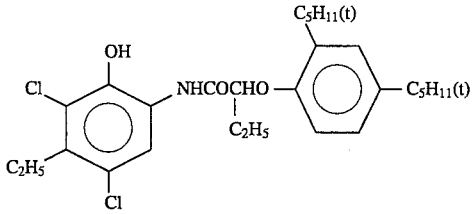
and
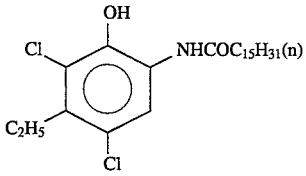
(ExH) Antifoggant
(Cpd-51) Color Image Stabilizer
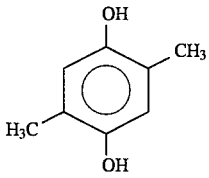
Mw 138
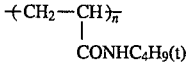
average molecular weight: 60,000
(Cpd-52) Color Image Stabilizer
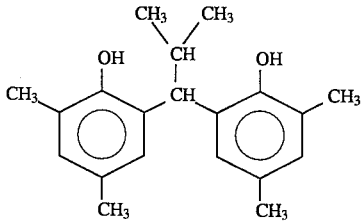
(Cpd-53) Color Image Stabilizer
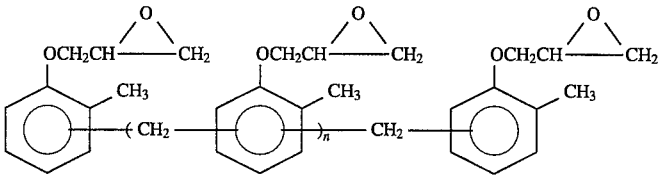
n = 7–8 (average value)

-continued
(Cpd-54) Color Mixture Inhibitor
1:1:1 mixture (by weight ratio) of (1):(2):(3)
(1)
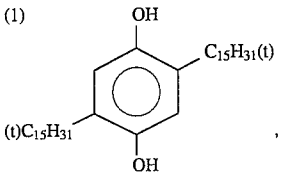
,
(2)
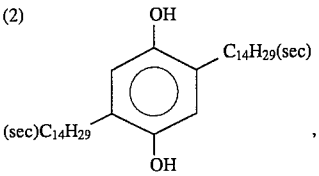
, and
(3)
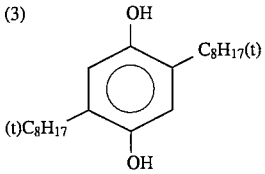
(Cpd-55) Color Image Stabilizer
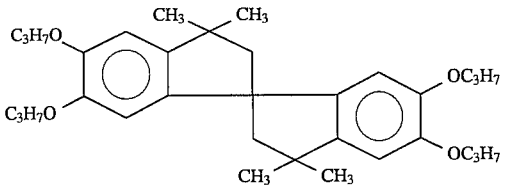
(Cpd-56) Color Image Stabilizer
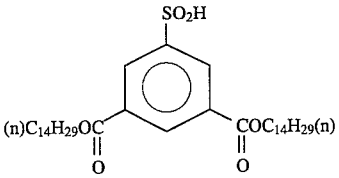
(Cpd-57) Color Image Stabilizer
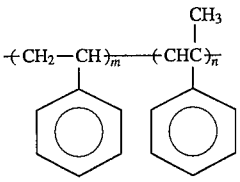
number average molecular weight: 600
m/n = 9/1
(Cpd-58) Color Image Stabilizer
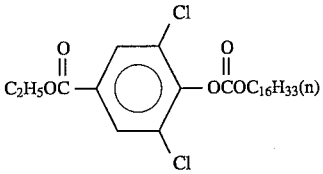
(Cpd-59) Color Image Stabilizer
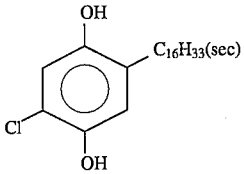
(Cpd-60) Color Image Stabilizer
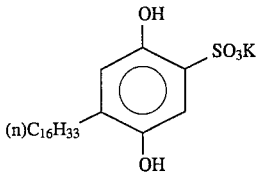
(Cpd-61) Surfactant
7/3 mixture (by weight ratio) of
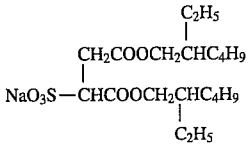
and
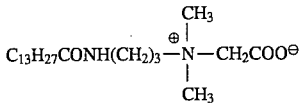
(Cpd-62) Preservative
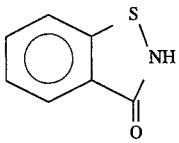

(Cpd-63) Preservative
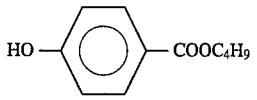
-continued
(Cpd-64) Preservative
1/1/1/1 mixture (by weight ratio) of a/b/c/d
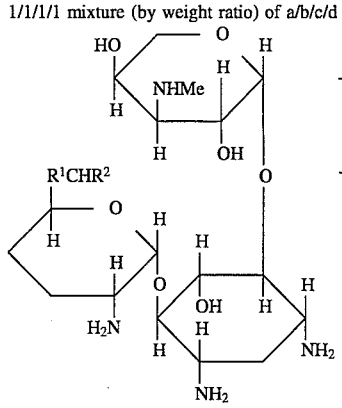
| | $R^1$ | $R^2$ |
|---|---|---|
| a | —Me | —NHMe |
| b | —Me | —$NH_2$ |
| c | —H | —$NH_2$ |
| d | —H | —NHMe |
(Cpd-65) Preservative
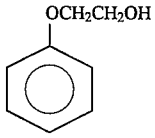
(Cpd-66) Preservative
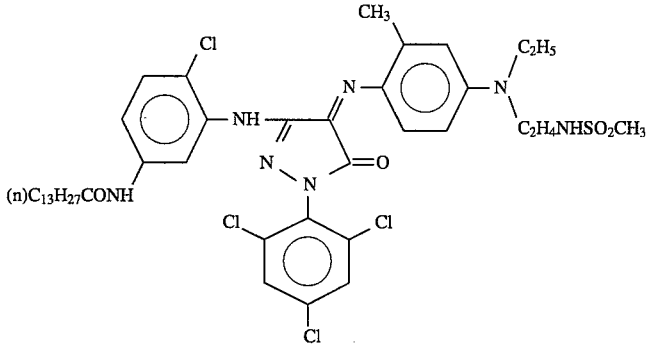
(Cpd-67) Antiffogant
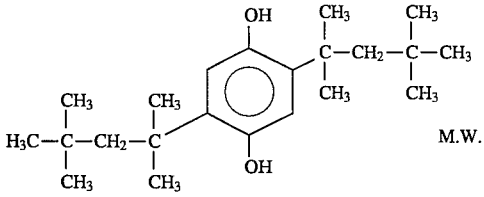
M.W. = 334.5
(UV-4) UV Absorbing Agent
1/3/4 mixture (by weight ratio) of (1)/(2)/(3)
(1)
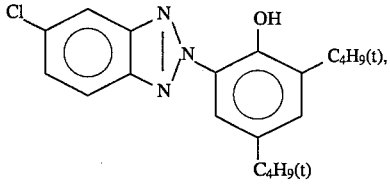
(2)
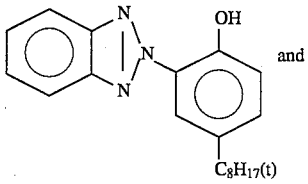

-continued
(3)
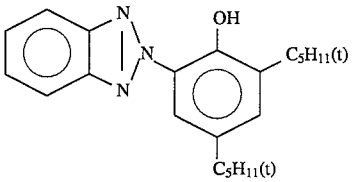
(UV-5) UV Absorbing Agent
1/2/2/3/1 mixture (by weight ratio) of (1)/(2)/(3)/(4)/(5)
(1)
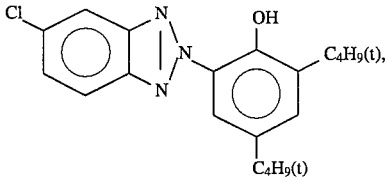
(2)
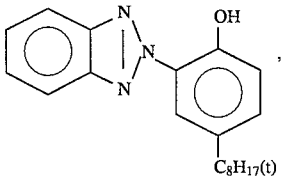
(3)
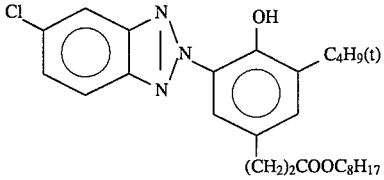
(4)
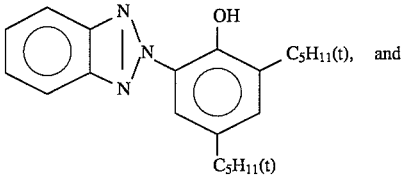
(5)
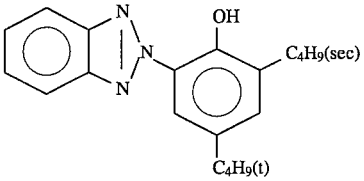
(UV-6) UV Absorbing Agent
1/3/2/1 mixture (by weight ratio) of (1)/(2)/(3)/(4)
(1)
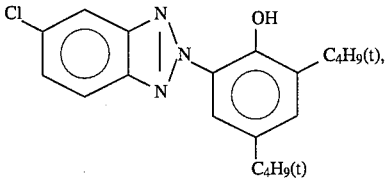
(2)
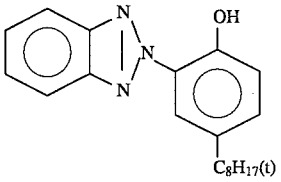
(3)
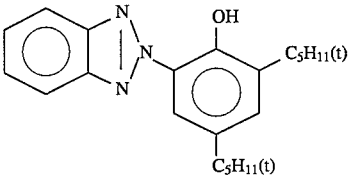
(4)
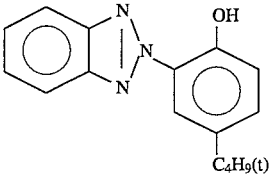
(Solv-21) Solvent
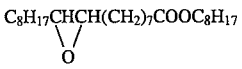
(Solv-22) Solvent
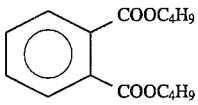

(Solv-23) Solvent

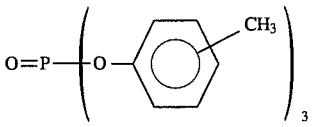

(Solv-25) Solvent $COOC_4H_9$
|
$(CH_2)_8$
|
$COOC_4H_9$ (Solv-27) Solvent

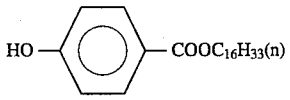

The composition of each processing solution used is described below.

| | Tank Solution | Replenisher |
|---|---|---|
| Color Developing Solution | | |
| Cation Exchange Water | 800 ml | 400 ml |
| Compound A (shown below) | 0.10 g | 0.10 g |
| Triethanolamine | 14.5 g | 14.5 g |
| Potassium Hydroxide | 3.0 g | 10.0 g |
| Ethylenediaminetetraacetic Acid | 4.0 g | 4.0 g |
| Sodium 4,5-dihydroxybenzene-1,3-disulfonate | 0.5 g | 0.5 g |
| Potassium Chloride | 14.0 g | — |
| Potassium Bromide | 0.04 g | 0.01 g |
| Brightening Agent (SR-13) | 2.5 g | 4.5 g |
| Sodium Sulfite | 0.1 g | 0.2 g |
| Sodium p-Toluenesulfonate | 5.0 g | 15.0 g |
| Disodium-N,N-bis(sulfonato-ethyl)hydroxylamine | 8.5 g | 11.1 g |
| N-Ethyl-N-(β-methanesulfon-amidoethyl)-3-methyl-4-amino-4-aminoaniline·3/2 Sulfate·Monohydrate | 5.0 g | 15.7 g |
| Potassium Carbonate | 26.3 g | 26.3 g |
| Water to make | 1,000 ml | 500 ml |
| pH (25° C., adjusted with KOH or sulfuric acid) | 10.15 | 12.50 |

Compound A

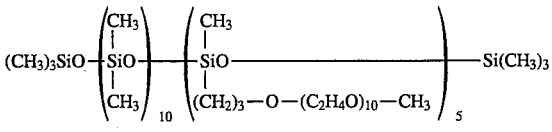

Bleach-Fixing Solution

| | | |
|---|---|---|
| Water | 700 ml | 600 ml |
| Ammonium Thiosulfate (750 g/liter) | 100 ml | 215 ml |
| Ammonium Sulfite | 35.0 g | 90.0 g |
| Ammonium Ethylenediamine-tetraacetato Ferrate | 43.0 g | 90.0 g |
| Imidazole | 0.2 mol | 0.43 mol |
| Compound (S-9) | 5.2 g | 12.0 g |

-continued (Solv-24) Solvent $O{=}P{+}O{-}C_6H_{13}(n))_3$ (Solv-26) Solvent

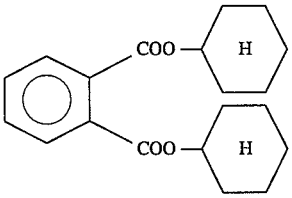

(Solv-28) Solvent $COOC_8H_{17}$
|
$(CH_2)_8$
|
$COC_8H_{17}$

-continued

| | Tank Solution | Replenisher |
|---|---|---|
| Water to make | 1,000 ml | 500 ml |
| pH (25° C., adjusted with nitric acid or aqueous ammonia) | 7.00 | 6.00 |
| Rinsing Solution (the tank solution and the replenisher are the same) | | |
| Sodium Chlorinated Isocyanurate | | 0.02 g |
| Demineralized Water (electric conductivity: 5 μs/cm or less) | | 1,000 ml |
| pH | | 6.5 |

The above color developing tank solution, color developing solution replenisher, bleach-fixing solution and bleach-fixing solution replenisher were each put in the flexible vessel for a processing solution having a bellows part described in the present specification and each photographic processing solution was prepared as follows.

Color Developing Tank Solution:

Content volume: 2,500 ml, Vessel D

Color Developing Solution Replenisher:

Content volume: 2,500 ml, Vessel D

Bleach-Fixing Tank Solution:

Content volume: 2,500 ml, Vessel D

Bleach-Fixing Solution Replenisher:

Content volume: 2,500 ml, Vessel D

Each of the above processing tank solutions was put in the processing tank of the color photographic paper processor used in Example 1 and each of the replenishers was put in the replenishing tank. The replenishment rate was as shown below. The same amount of water was supplied to the processing tank in linking with replenishing. This water was introduced from the rinsing replenishing tank and the composition was the same as the rinsing solution. Continuous processing was carried out according to the above processing system until the total amount of the bleach-fixing solution replenisher reached 10 liters.

| Step | Processing Step: Processing Temperature (°C.) | Processing Time (sec) | Replenishment Rate* (ml) | Tank Capacity (liter) |
|---|---|---|---|---|
| Color Development | 38.5 | 45 | 22.5** | 5 |
| Bleach-Fixing | 35.0 | 45 | 17.5** | 5 |
| Rinsing (1) | 35.0 | 20 | — | 2 |
| Rinsing (2) | 35.0 | 20 | — | 2 |
| Rinsing (3)*** | 35.0 | 20 | — | 2 |
| Rinsing (4)*** | 35.0 | 30 | 85 | 3 |

Rinsing was conducted in a 4-tank countercurrent system from rinsing (4) to (1).
*Replenishment rate per $m^2$ of the photographic material
**The solution was directly replenished to the tank, and the same amount of water was replenished to the processing tank.
***RC-30 (reverse osmosis membrane module), a product of Fuji Photo Film Co., Ltd., was installed, and the solution in tank (3) was removed, and the removed solution was supplied to RC-30 by a pump. The permeated water obtained by this apparatus was supplied to rinsing tank (4) and the concentrated solution was returned to rinsing tank (3). The pressure of the pump was controlled to maintain the permeation rate of the solution by RC-30 of from 200 to 300 ml/min and was operated for#
10 hours a day.

After the termination of the running test, evaluation of the whiteness was conducted in the same manner as in Example 1 using the sample prepared in Example 1 and the sample prepared in this example. The result was that the change in absorbance at 450 nm after rewashing was 0.001 or less with both samples, and was excellent as in Example 1.

Example 7

A color photographic paper was prepared according to the method shown below.

Preparation of Support 30 wt % of titanium dioxide was added to a low density polyethylene of MRF=3, 3.0 wt % of zinc stearate based on the amount of the titanium dioxide was added thereto, and kneaded in a Banbury mixer together with an ultramarine blue dye (DV-1 manufactured by Daiichi Kasei Kogyo K.K.), and then used for melt extrusion. The titanium dioxide used was from 0.15 μm to 0.35 μm by an electron microscope and 0.75 wt % based on titanium dioxide in the form of the coating amount of hydrate aluminum oxide of Al203.

After a paper substrate weighing 170 g/$m^2$ was corona discharged at 10 kVA, the above polyethylene composition of 30 wt % of titanium dioxide, the polyethylene composition of 18 wt % of titanium dioxide prepared in the same manner, and the polyethylene containing an ultramarine blue dye were melt extruded at 320° C. using a multilayer extrusion coating die on the above paper substrate to obtain a polyethylene laminate layer comprising the film thicknesses of the upper layer of 2 μm (titanium dioxide: 18 wt %), the intermediate layer of 21 μm (titanium dioxide: 30 wt %) and the lower layer of 10 μm (titanium dioxide: 0 wt %) (the lower layer is nearer the paper substrate). The surface of the polyethylene layer was glow discharged.

Preparation of Color Photographic Paper

Various photographic constitutional layers were coated on the above reflective support and a multilayer color photographic paper having the layer constitution shown below was prepared. The coating solution was prepared as described below.

Preparation of Coating Solution for Third Layer 40.0 g of a magenta coupler (ExM), 40.0 g of a UV absorbing agent (UV-2), 7.5 g of a color image stabilizer (Cpd-2), 25.0 g of a color image stabilizer (Cpd-5), 2.5 g of a color image stabilizer (Cpd-6), 20.0 g of a color image stabilizer (Cpd-7), 2.5 g of a color image stabilizer (Cpd-8), 5.0 g of a color image stabilizer (Cpd-10) were dissolved in 32.5 g of a solvent (Solv-3), 97.5 g of a solvent (Solv-4), 65.0 g of a solvent (Solv-6) and 110 ml of ethyl acetate, and this solution was mixed to 1,500 g of a 7% aqueous gelatin solution containing 90 ml of 10% sodium dodecylbenzenesulfonate and dispersed in an emulsified condition to obtain Emulsified Dispersion A-1. On the other hand, two kinds of silver chlorobromide Emulsions B-1 were prepared (cubic form, a mixture in a ratio of 1/3 (silver mol ratio) of a large grain size emulsion having an average grain size of 0.55 μm, and a small grain size emulsion having an average grain size of 0.39 μm; variation coefficients of the grain size distribution were 0.08 and 0.06, respectively, both of them contained 0.8 mol % of silver bromide localized at a part of the grain surface, and the remaining substrate being comprising silver chloride, and potassium hexachloroiridate(IV) in the total amount of 0.1 mg and potassium ferrocyanide in the total amount of 1.0 mg, respectively, were contained in the inside and at the silver bromide rich localized phase of the grains). The green-sensitive Sensitizing Dyes D, E and F shown below were added in an amount of $3.0\times10^{-4}$ mol, $4.0\times10^{-5}$ mol and $2.0\times10^{-4}$ mol, respectively, per mol of silver to the large grain size emulsion, and $3.6\times10^{-4}$ mol, $7.0\times10^{-5}$ mol and $2.8\times10^{-4}$mol, respectively, per mol of silver to the small grain size emulsion. Subsequently, chemical sensitization was conducted optimally by addition of a sulfur sensitizer and a gold sensitizer in the presence of the decomposition product of a nucleic acid. The foregoing Emulsified Dispersion A-1 was mixed with this silver chlorobromide Emulsion B-1 and dissolved to obtain a coating solution for the third layer having the composition described below.

The coating solutions for from the first to seventh layers other than the third layer were prepared in the same manner as the coating solution for the third layer. 1-Oxy-3,5-dichloro-s-triazine sodium salt was used as a gelatin hardening agent in each layer.

Further, Cpd-12 and Cpd-13 were added to each layer so that the total coating amount became 25.0 mg/$m^2$ and 50.0 mg/$m^2$, respectively.

The grain size of the silver chlorobromide emulsion of each light-sensitive emulsion layer was adjusted in the same preparation method as the above silver chlorobromide Emulsion B-1 and the spectral sensitizing dyes described below were used in the silver chlorobromide emulsion of each light-sensitive emulsion layer.

Blue-Sensitive Emulsion Layer:

Spectral Sensitizing Dye A

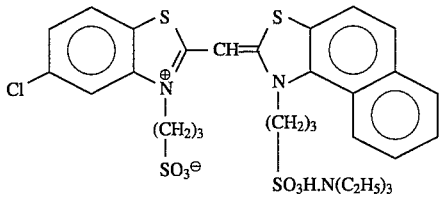

Spectral Sensitizing Dye B

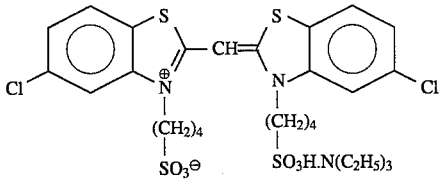

Spectral Sensitizing Dye C

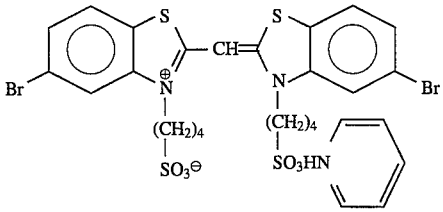

(each in an amount of $1.4 \times 10^{-4}$ mol/mol Ag to the large grain size emulsion, and each in an amount of $1.7 \times 10^{-4}$ mol/mol Ag to the small grain size emulsion)

Green-Sensitive Emulsion Layer:

Spectral Sensitizing Dye D

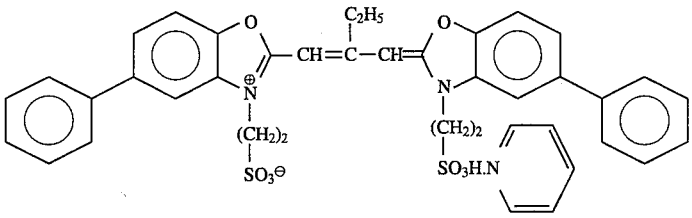

(in an amount of $3.0 \times 10^{-4}$ mol/mol Ag to the large grain size emulsion and in an amount of $3.6 \times 10^{-4}$ mol/mol Ag to the small grain size emulsion)

Spectral Sensitizing Dye E

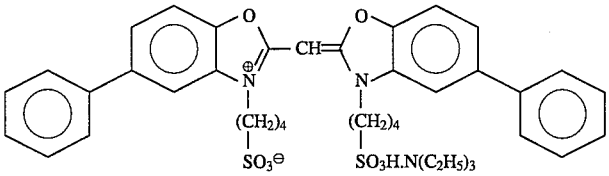

(in an amount of $4.0 \times 10^{-5}$ mol/mol Ag to the large grain size emulsion and in an amount of $7.0 \times 10^{-5}$ mol/mol Ag to the small grain size emulsion)

-continued

Spectral Sensitizing Dye F

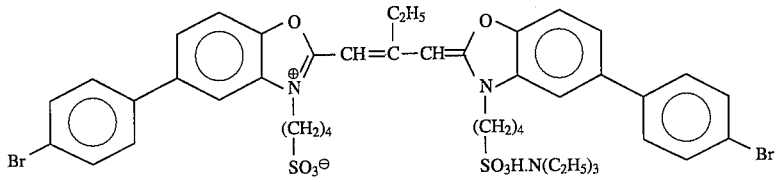

(in an amount of $2.0\times10^{-4}$ mol/mol Ag to the large grain size emulsion and in an amount of $2.8\times10^{-4}$ mol/mol Ag to the small grain size emulsion)

Red-Sensitive Emulsion Layer:

Spectral Sensitizing Dye G

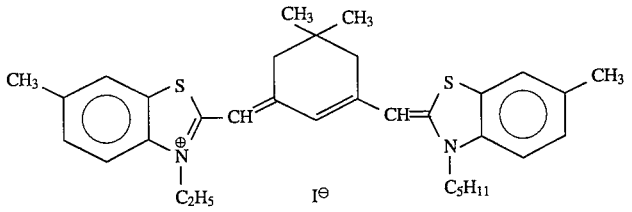

(in an amount of $4.0\times10^{-5}$ mol/mol Ag to the large grain size emulsion, and in an amount of $5.0\times10^{-5}$ mol/mol Ag to the small grain size emulsion)

Spectral Sensitizing Dye H

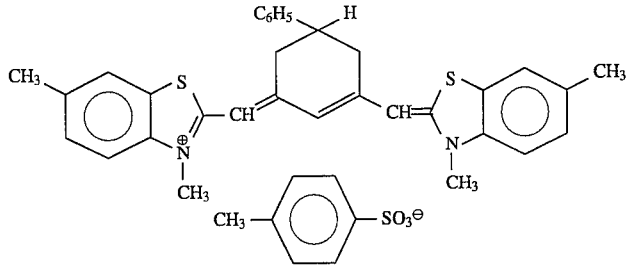

(in an amount of $5.0\times10^{-5}$ mol/mol Ag to the large grain size emulsion, and in an amount of $6.0\times10^{-5}$ mol/mol Ag to the small grain size emulsion)

The following compound was further added to the red-sensitive emulsion layer in an amount of $2.6\times10^{-5}$ mol per mol of silver halide.

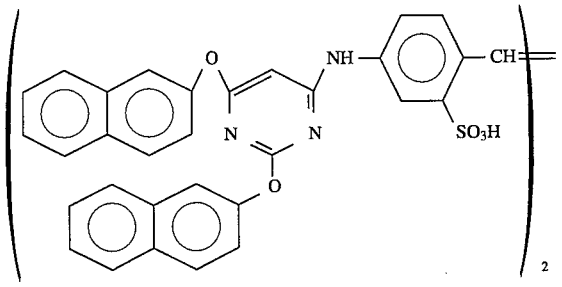

Further, 1-(5-methylureidophenyl)-5-mercaptotetrazole was added to the blue-sensitive emulsion layer, the green-sensitive emulsion layer and the red-sensitive emulsion layer in an amount of $8.5\times10^{-4}$ mol, $3.0\times10^{-3}$ mol and $2.5\times10^{-4}$ mol, respectively, per mol of silver halide.

In addition, 4-hydroxy-6-methyl-1,3,3a,7-tetraazaindene was added to the blue-sensitive emulsion layer and the green-sensitive emulsion layer in an amount of $1\times10^{-4}$ mol and $2\times10^{-4}$ mol, respectively, per mol of silver halide.

Moreover, the following dyes were added to the emulsion layer for preventing irradiation (the numerals in parentheses represent the coating amount).

Yellow Dye
(2.6mg/m²)
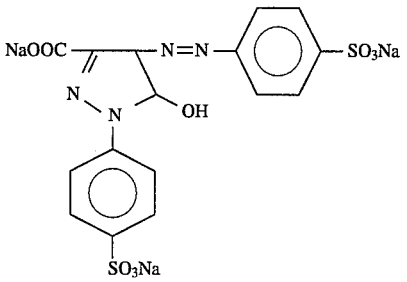
Magenta Dye
(60mg/m²)
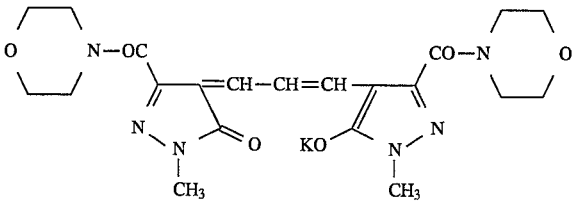
Cyan Dye
(42mg/m²)
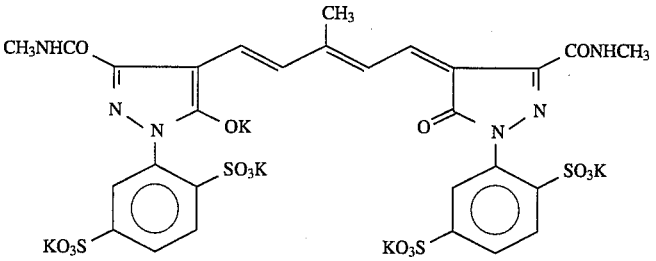
Layer Composition
The composition of each layer is described below. The numeral represents the coating amount (g/m²). The numeral for the silver halide emulsion represents the coating amount in terms of silver.
Support (A):
A blue dye (ultramarine) was added to the polyethylene of the first layer side.

| | |
|---|---|
| First Layer (blue-sensitive emulsion layer) | |
| Silver Chlorobromide Emulsion A-1 (cubic form, a mixture in a ratio of 5/5 (silver mol ratio) of a large grain size emulsion having an average grain size of 0.88 μm, and a small grain size emulsion having an average grain size of 0.70 μm; variation coefficients of the grain size distribution were 0.08 and 0.10, respectively, both of them contained 0.3 mol % of silver bromide localized at a part of the grain surface, and the remaining substrate being comprising silver chloride, and potassium hexachloroiridate(IV) in the total amount of 0.1 mg and potassium ferrocyanide in the total amount of 1.0 mg, respectively, were contained in the inside and at the silver bromide rich localized phase of the grains) | 0.27 |
| Gelatin | 1.22 |
| Yellow Coupler (ExY) | 0.79 |
| Color Image Stabilizer (Cpd-1) | 0.08 |
| Color Image Stabilizer (Cpd-2) | 0.04 |
| Color Image Stabilizer (Cpd-3) | 0.08 |
| Color Image Stabilizer (Cpd-5) | 0.01 |
| Solvent (Solv-1) | 0.13 |
| Solvent (Solv-5) | 0.13 |
| Second Layer (color mixture inhibiting layer) | |
| Gelatin | 0.90 |
| Color Mixture Inhibitor (Cpd-4) | 0.08 |
| Solvent (Solv-1) | 0.10 |
| Solvent (Solv-2) | 0.15 |
| Solvent (Solv-3) | 0.25 |
| Solvent (Solv-8) | 0.03 |
| Third Layer (green-sensitive emulsion layer) | |
| Silver Chlorobromide Emulsion B-1 described above | 0.13 |
| Gelatin | 1.45 |
| Magenta Coupler (ExM) | 0.16 |
| UV Absorbing Agent (UV-2) | 0.16 |
| Color Image Stabilizer (Cpd-2) | 0.03 |
| Color Image Stabilizer (Cpd-5) | 0.10 |
| Color Image Stabilizer (Cpd-6) | 0.01 |
| Color Image Stabilizer (Cpd-7) | 0.08 |
| Color Image Stabilizer (Cpd-8) | 0.01 |
| Color Image Stabilizer (Cpd-10) | 0.02 |
| Solvent (Solv-3) | 0.13 |
| Solvent (Solv-4) | 0.39 |
| Solvent (Solv-6) | 0.26 |
| Fourth Layer (color mixture inhibiting layer) | |
| Gelatin | 0.68 |
| Color Mixture Inhibitor (Cpd-4) | 0.06 |
| Solvent (Solv-1) | 0.07 |
| Solvent (Solv-2) | 0.11 |
| Solvent (Solv-3) | 0.18 |
| Solvent (Solv-8) | 0.02 |
| Fifth Layer (red-sensitive emulsion layer) | |
| Silver Chlorobromide Emulsion C-1 (cubic form, a mixture in a ratio of 1/4 (silver mol ratio) of a large grain size emulsion having an average grain size of 0.50 μm, and a small grain size emulsion having an average grain size of 0.41 μm; variation coefficients of the grain size distribution were 0.09 and 0.11, respectively, both of them contained 0.8 mol % of silver bromide localized at a part of the grain surface, and the remaining substrate being comprising silver chloride, and further, potassium hexachloroiridate(IV) in the total amount of 0.1 mg and potassium ferrocyanide in the total amount of 1.0 mg, respectively, per mol of silver were contained in the inside and at the silver bromide rich localized phase of the grains) | 0.18 |
| Gelatin | 0.80 |
| Cyan Coupler (ExC) | 0.33 |
| UV Absorbing Agent (UV-2) | 0.18 |
| Color Image Stabilizer (Cpd-1) | 0.33 |
| Color Image Stabilizer (Cpd-2) | 0.03 |
| Color Image Stabilizer (Cpd-6) | 0.01 |
| Color Image Stabilizer (Cpd-8) | 0.01 |
| Color Image Stabilizer (Cpd-9) | 0.02 |
| Color Image Stabilizer (Cpd-10) | 0.01 |
| Solvent (Solv-1) | 0.01 |
| Solvent (Solv-7) | 0.22 |
| Sixth Layer (UV absorbing layer) | |
| Gelatin | 0.48 |
| UV Absorbing Agent (UV-1) | 0.38 |
| Color Image Stabilizer (Cpd-5) | 0.01 |
| Color Image Stabilizer (Cpd-7) | 0.05 |
| Solvent (Solv-9) | 0.05 |
| Seventh Layer (protective layer) | |
| Gelatin | 0.90 |

-continued
| | |
|---|---|
| Acryl-Modified Copolymer of Polyvinyl Alcohol (modification degree: 17%) | 0.05 |
| Liquid Paraffin | 0.02 |
| Color Image Stabilizer (Cpd-11) | 0.01 |
(ExY) Yellow Coupler
1/1 mixture (by mol ratio) of
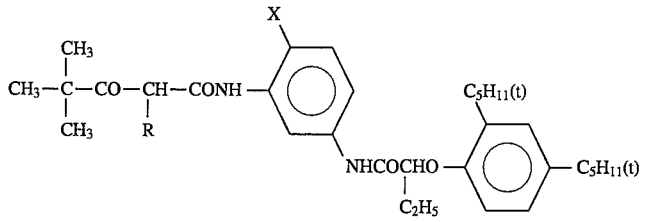
R = 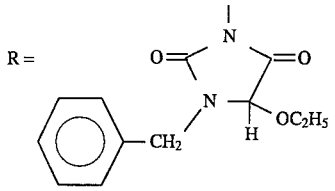 X = Cl and R = 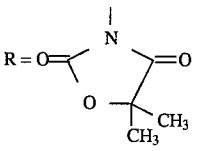 X = $OCH_3$
(ExM) Magenta Coupler
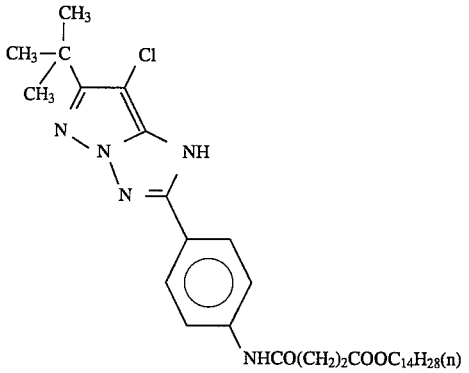
(ExC) Cyan Coupler
25/75 mixture (by mol ratio) of
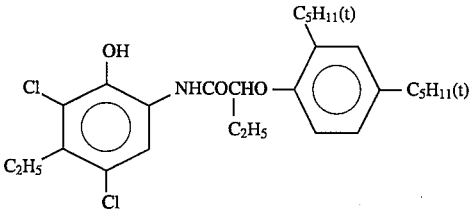 and 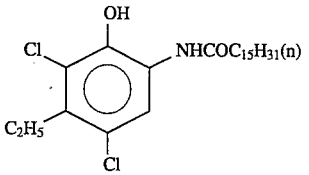
(Cpd-1) Color Image Stabilizer
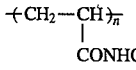
average molecular weight: 60,000
(Cpd-2) Color Image Stabilizer
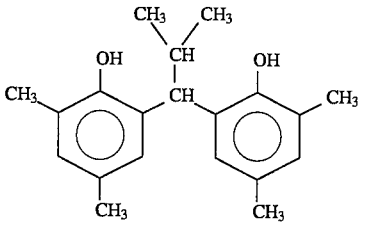

(Cpd-3) Color Image Stabilizer
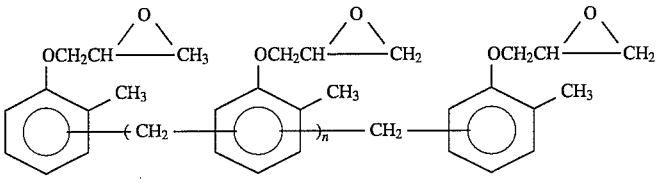
n = 7–8 (average value)
(Cpd-4) Color Mixture Inhibitor
1/1/1 mixture (by weight ratio) of
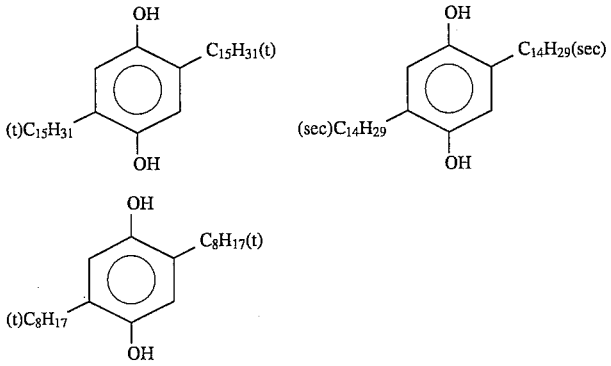
(Cpd-5) Color Image Stabilizer
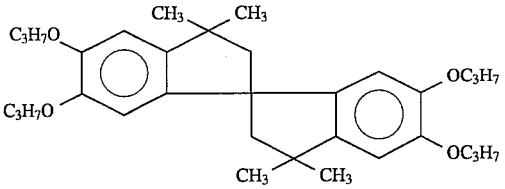
(Cpd-6) Color Image Stabilizer
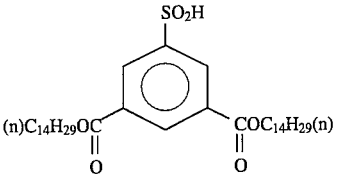
(Cpd-7) Color Image Stabilizer
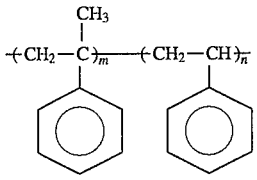
m/n = 9/1
number average molecular weight: 600
(Cpd-8) Color Image Stabilizer
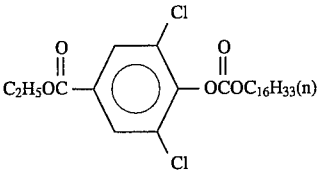
(Cpd-9) Color Image Stabilizer
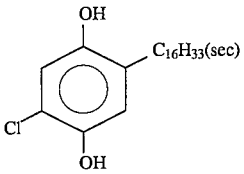
(Cpd-10) Color Image Stabilizer
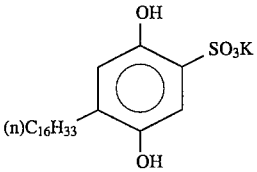

(Cpd-11) Color Image Stabilizer
1/2/1 mixture (by weight ratio) of i)/ii)/iii)
i)
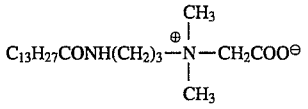
ii)
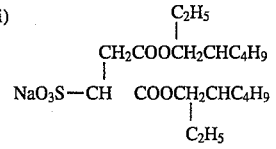
iii) $C_8F_{17}SO_2N(C_3H_7)CH_2COOK$
(Cpd-12) Preservative
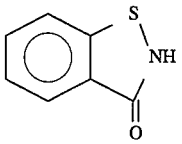
(Cpd-13) Preservative
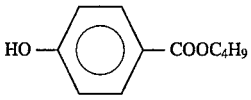
(UV-1) UV Absorbing Agent
1/2/2/3/1 mixture (by weight ratio) of (iv)/(v)/(vi)/(vii)/(viii)
(iv)
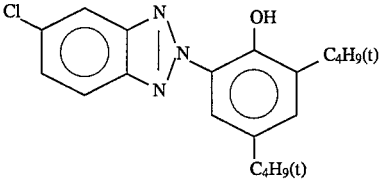
(v)
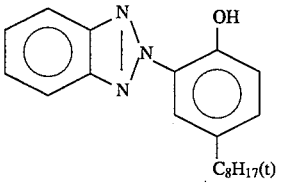
(vi)
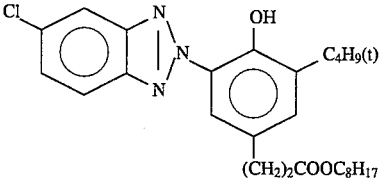
(vii)
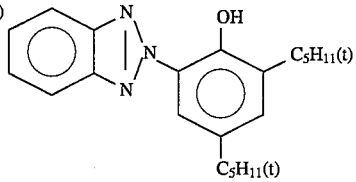
(viii)
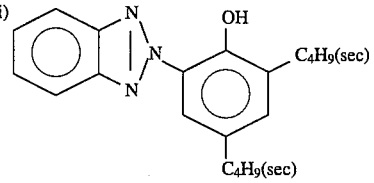
(UV-2) UV Absorbing Agent
2/3/4/1 mixture (by weight ratio) of (ix)/(x)/(xi)/(xii)
(ix)
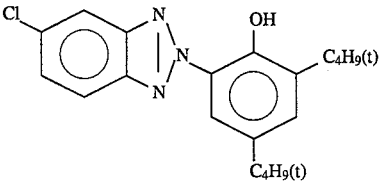
(x)
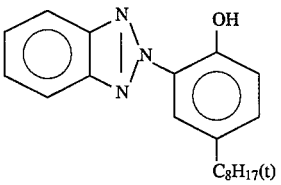
(xi)
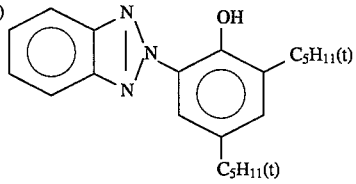
(xii)
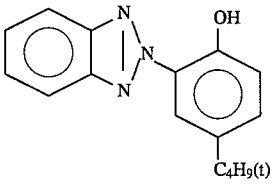

-continued (Solv-1) Solvent

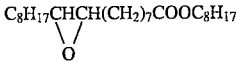

(Solv-2) Solvent

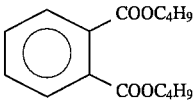

(Solv-3) Solvent

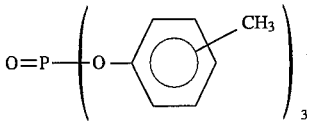

(Solv-4) Solvent

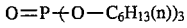

(Solv-5) Solvent

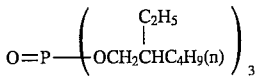

(Solv-6) Solvent

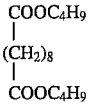

(Solv-7) Solvent

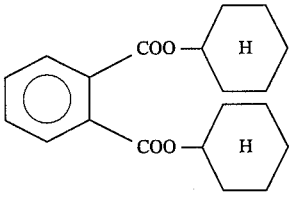

(Solv-8) Solvent

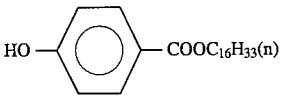

(Solv-9) Solvent

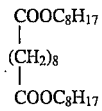

Running test was conducted with the above color photographic paper using Fuji Mini Labo Printer Processor PP720WR (rinse clean system RC50D standard equipment type, manufactured by Fuji Photo Film Co., Ltd.) according to the following processing steps and the processing compositions.

| | Processing Step | | |
|---|---|---|---|
| Processing Step | Processing Temperature (°C.) | Processing Time (sec) | Replenishment Rate* (ml) |
| Color Development | 38.5 | 45 | 45 |
| Bleach-Fixing | 38.0 | 45 | part A 17.5/ part B 17.5** |
| Rinsing (1) | 38.0 | 20 | — |
| Rinsing (2) | 38.0 | 20 | — |
| Rinsing (3)*** | 38.0 | 20 | — |
| Rinsing (4)*** | 38.0 | 20 | 90 |

*Replenishment rate per $m^2$ of the photographic material

**Part A and Part B were replenished from each replenishing tank separately.

***Reverse osmosis membrane module RC50D, a product of Fuji Photo Film Co., Ltd., was installed in rinsing tank (3), the solution in tank (3) was removed, and the removed solution was supplied to RC50D by a pump. The permeated solution obtained from this tank was supplied to rinsing tank (4) and the concentrated solution was returned back to rinsing tank (3). The pressure of the pump was adjusted to maintain the permeation rate of the solution by this reverse osmosis membrane module of from 200 to 300 ml/min. and the system was circulated for 10 hours a day with controlling temperature.

Color Developing Solution

The tank solution and the replenisher were the same with those in Example 3.

Bleach-Fixing Solution

Replenisher A: The same with bleach-fixing solution Part A in Example 3.

Replenisher B: The same with bleach-fixing solution Part B in Example 3.

Tank solution: The same with the tank solution in Example 3.

Rinsing Solution

The tank solution and the replenisher were the same with those in Example 3.

The imagewise exposed above coated sample was continuously processed according to the above processing step until the bleach-fixing solution replenisher amount reached 2 times the tank capacity using the above printer processor.

After completion of the running test, whiteness was determined in the same manner as in Example 1. The results obtained were superior to those in Example 1.

As can be seen from the specification and the examples described above, excellent whiteness can be obtained according to the present invention by containing imidazole compounds even when the replenishment rate of the bleach-fixing solution is extremely reduced.

When the replenishment rate of the bleach-fixing solution is reduced, usually the color developing solution component increases and whiteness is deteriorated, however, the presence of imidazole compounds in the bleach-fixing solution improves whiteness the more the replenishment rate is reduced. This is thought presumably because there exists a reciprocal action between imidazole compounds and the color developing solution component.

While the invention has been described in detail and with reference to specific examples thereof, it will be apparent to one skilled in the art that various changes and modifications can be made therein without departing from the spirit and scope thereof.

What is claimed is:

1. A method of processing a silver halide color photographic material by processing with a color developing solution an imagewise exposed silver halide color photographic material comprising a support having thereon at least one light-sensitive silver halide emulsion layer containing silver halide and a color dye forming coupler, and immediately thereafter processing said photographic material with a bleach-fixing solution, wherein said bleach-fixing solution contains an imidazole compound represented by the following formula (α) and the replenishment rate of said bleach-fixing solution is 200 ml or less per $m^2$ of the photographic material:

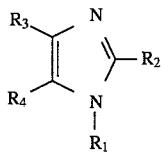

(α)

wherein $R_1$, $R_2$, $R_3$ and $R_4$ each represents a hydrogen atom, an alkyl group having 1 to 5 carbon atoms, a hydroxyalkyl group having from 1 to 5 carbon atoms, or an alkenyl group.

2. The method of processing a silver halide color photographic material as claimed in claim 1, wherein said color developing solution contains a triazinyl-4,4-diaminostilbene based brightening agent.

3. The method of processing a silver halide color photographic material as claimed in claim 1, wherein said bleach-fixing solution contains a compound represented by the following formula (S):

$$R(SO_2M)_n \quad (S)$$

wherein R represents an alkyl group, an alkenyl group, an aralkyl group, a cycloalkyl group, an aryl group or a heterocyclic group, any of which may be substituted; M represents a cation; and n represents 1 or 2.

4. The method of processing a silver halide color photographic material as claimed in claim 1, wherein said replenishment rate of the bleach-fixing solution is 5 to 100 ml/$m^2$.

5. The method of processing a silver halide color photographic material as claimed in claim 1, wherein said replenishment rate of the bleach-fixing solution is 10 to 60 ml/$m^2$.

6. The method of processing a silver halide color photographic material as claimed in claim 2, wherein said triazinyl-4,4-diaminostilbene based brightening agent is a compound represented by formula (SR):

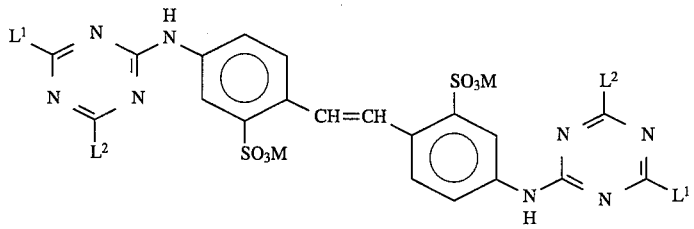

(SR)

wherein $L^1$ and $L^2$, which may be the same or different, each represents —$OR^1$ or —$NR^2R^3$ (wherein $R^1$, $R^2$ and $R^3$ each represents a hydrogen atom or an alkyl group) and M is a hydrogen atom, an alkaline earth metal, ammonium or pyridinium.

7. The method of processing a silver halide color photographic material as claimed in claim 2, wherein said triazinyl-4,4-diaminostilbene based brightening agent is a compound represented by formula (SR-c):

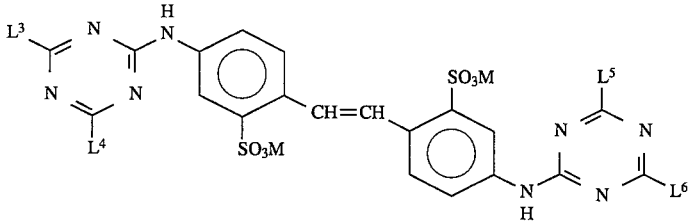

(SR-c)

wherein $L^3$, $L^4$, $L^5$ and $L^6$, which may be the same or different, each represents —$OR^8$ or —$NH^9R^{10}$; $R^8$, $R^9$ and $R^{10}$ each represents a hydrogen atom, an alkyl group, or an alkyl group which may be substituted and M is a hydrogen atom, an alkaline earth metal, ammonium or pyridinium.

8. The method of processing a silver halide color photographic material as claimed in claim 1, wherein said bleach-fixing solution contains an iron complex salt of a compound represented by formula (E):

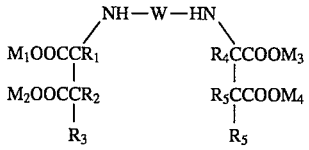

(E)

wherein $R_1$, $R_2$, $R_3$, $R_4$, $R_5$ and $R_6$ each represents a hydrogen atom, an aliphatic group, an aromatic group or a hydroxy group; W represents a divalent linking group containing at least one carbon atom; and $M_1$, $M_2$, $M_3$ and $M_4$ each represents a hydrogen atom or a cation.

9. The method of processing a silver halide color photographic material as claimed in claim 1, wherein said bleach-fixing solution contains the imidazole compound in an amount of 0.07 to 1.0 mol/l.

10. The method of processing a silver halide color photographic material as claimed in claim 1, wherein said color developing solution contains benzyl alcohol in an amount of 0.5 ml/l or less.

11. The method of processing a silver halide color photographic material as claimed in claim 1, wherein said color developing solution contains a compound represented by formula (I):

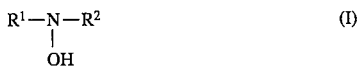

$$R^1-\underset{\underset{OH}{|}}{N}-R^2 \quad (I)$$

wherein $R^1$ and $R^2$ each represents a hydrogen atom, an alkyl group, a substituted or unsubstituted alkenyl group, a substituted or unsubstituted aryl group, or a substituted or unsubstituted heterocyclic aromatic group, provided $R^1$ and $R^2$ do not represent hydrogen atoms at the same time, and they may be linked to each other to form a heterocyclic ring together with a nitrogen atom.

12. The method of processing a silver halide color photographic material as claimed in claim 1, wherein the imidazole compound represented by formula (α) is imidazole, 1-methylimidazole, 1-ethylimidazole, 1-allylimidazole, 1-vinyl-imidazole, 1-(β-hydroxyethyl)imidazole, 2-methylimidazole, 2-ethylimidazole, 2-amylimidazole, 2-hydroxymethylimidazole, 1-isoamyl-2-methylimidazole, 4-methylimidazole, 4-hydroxy-methylimidazole, 4-(β-hydroxyethyl)imidazole, 2,4-dimethyl-imidazole, 2-ethyl-4-methylimidazole, 4,5-dimethylimidazole, 4-hydroxymethyl-5-methylimidazole, 4-(β-hydroxyethyl)-5-methylimidazole, or 2,4,5-trimethylimidazole.

13. The method of processing a silver halide color photographic material as claimed in claim 1, wherein said imidazole compound represented by formula (α) is added to said bleach-fixing solution in an amount from 0.02 to 2 mol per liter of the bleach-fixing solution.

14. The method of processing a silver halide color photographic material as claimed in claim 3, wherein R represents methyl, ethyl, n-propyl, hydroxyethyl, sulfoethyl, carboxyethyl, methoxyethyl, allyl, butenyl, benzyl, phenethyl, 4-carboxyphenylmethyl, 3-sulfophenylmethyl, cyclohexyl, phenyl, 4-methylphenyl, naphthyl, 3-carboxyphenyl, 4-methoxyphenyl, 3-sulfophenyl, 4-carboxy-methoxyphenyl, 3-carboxymethoxyphenyl, 4-carboxyethoxyphenyl, 4-sulfoethoxyphenyl, 4-carboxymethylphenyl, 4-(N-carboxy-methyl-N-methyl)phenyl, pyridyl, furyl, thienyl, pyrazolyl, or indolyl.

15. The method of processing a silver halide color photographic material as claimed in claim 3, wherein M is a hydrogen atom, an alkali metal, an alkaline earth metal, a nitrogen containing organic base, or an ammonium group.

16. The method of processing a silver halide color photographic material as claimed in claim 3, wherein R is substituted and the substituents are a nitro group, a halogen atom, a cyano group, an alkyl group, an aryl group, an alkenyl group, an aralkyl group, a sulfonyl group, an acyl group, a carbamoyl group, a sulfamoyl group, carbonamide group, a sulfonamide group, an acyloxy group, a sulfonyloxy group, a ureido group, a thioureido group, carboxylic acid or salts thereof, sulfonic acid or salts thereof, a hydroxy group, an alkoxy group, an alkylthio group or an amino group.

17. The method of processing a silver halide color photographic material as claimed in claim 11, wherein the compound represented by Formula (I) is present in an amount from 0.005 mol/liter to 0.5 mol/liter.

* * * * *